US011659884B2

(12) United States Patent
Durocher et al.

(10) Patent No.: US 11,659,884 B2
(45) Date of Patent: May 30, 2023

(54) PROTECTIVE HEADGEAR

(71) Applicant: Bauer Hockey LLC, Exeter, NH (US)

(72) Inventors: Jacques Durocher, St-Jerome (CA); Charles-Antoine Desrochers, Prevost (CA); Daniel Bourgeois, Rosemere (CA); Jean-Francois Laperriere, Prevost (CA); Philippe Jean, Terrebonne (CA); Thierry Krick, Coteau-du-Lac (CA); Marie-Claude Genereux, Ste-Therese (CA)

(73) Assignee: BAUER HOCKEY LLC, Exeter, NH (US)

( * ) Notice: Subject to any disclaimer, the term of this patent is extended or adjusted under 35 U.S.C. 154(b) by 17 days.

(21) Appl. No.: 17/306,812

(22) Filed: May 3, 2021

(65) Prior Publication Data

US 2021/0337912 A1 Nov. 4, 2021

Related U.S. Application Data

(60) Provisional application No. 63/026,046, filed on May 16, 2020, provisional application No. 63/019,259, filed on May 1, 2020.

(30) Foreign Application Priority Data

Jul. 6, 2020 (CA) ..... 3085700

(51) Int. Cl.
*A42B 3/20* (2006.01)

(52) U.S. Cl.
CPC ..... *A42B 3/205* (2013.01)

(58) Field of Classification Search
CPC ..... A42B 3/205
(Continued)

(56) References Cited

U.S. PATENT DOCUMENTS 4,633,532 A * 1/1987 Yagasaki ..... A42B 3/26 2/435
5,243,972 A * 9/1993 Huang ..... A62B 18/025 128/205.25

(Continued)

FOREIGN PATENT DOCUMENTS

CN 202145929 2/2012
CN 3085700 6/2022

OTHER PUBLICATIONS

Examiner Report dated Oct. 14, 2020 in connection with Canadian Patent Application No. 3,085,700, 7 pages.

(Continued)

*Primary Examiner* — Timothy K Trieu

(57) ABSTRACT

Protective headgear that is wearable on a head of a user and may be configured to provide impact protection and contaminant protection. The protective headgear may comprise a helmet configured to protect the user's head against impacts and a contaminant blocker configured to protect against contaminants (e.g., infectants), such as pathogens (e.g., viruses, bacteria, or other microorganisms) or other biohazards, chemical hazards, or other hazardous substances, transmittable to or from the user (e.g. as part of spatter, an aerosol, or other droplets). The helmet and the contaminant blocker may be configured to connect or otherwise interact with one another to be usable together. This may facilitate their use to enhance protection of the user and/or an environment of the user, while maintaining performance of the user, including by providing breathability, being spatter proof, ensuring proper vision, being antifogging, being customizable, and/or having other desirable attributes.

43 Claims, 64 Drawing Sheets

(58) Field of Classification Search
USPC ..... 2/424
See application file for complete search history.

(56) References Cited

U.S. PATENT DOCUMENTS

| | | | | |
|---|---|---|---|---|
| 5,448,780 | A * | 9/1995 | Gath | A42B 3/28 2/424 |
| 5,546,610 | A | 8/1996 | Herzig et al. | |
| 5,584,073 | A | 12/1996 | Radzelovage et al. | |
| 6,883,183 | B2 * | 4/2005 | Morrow | A42B 3/08 2/9 |
| 7,937,775 | B2 | 5/2011 | Manzella et al. | |
| 2008/0127400 | A1 | 6/2008 | Dupuis | |
| 2009/0014005 | A1 | 1/2009 | Mackinnon | |
| 2009/0151054 | A1 * | 6/2009 | VanDerWoude | A42B 3/286 2/410 |
| 2010/0300435 | A1 * | 12/2010 | Thiruppathi | A62B 18/04 128/201.25 |
| 2021/0392987 | A1 | 12/2021 | Johnson | |
| 2021/0392989 | A1 | 12/2021 | Cassidy et al. | |

OTHER PUBLICATIONS

Examiner's Report dated Mar. 29, 2021 in connection with Canadian Patent Application No. 3,085,700, 7 pages.
Examiner's Report dated Aug. 25, 2021 in connection with Canadian Patent Application No. 3,085,700, 3 pages.

* cited by examiner

PROTECTIVE HEADGEAR

CROSS-REFERENCE TO RELATED APPLICATIONS

This application claims the benefit of U.S. Provisional Patent Application Ser. No. 63/019,259, filed on May 1, 2020, U.S. Provisional Patent Application Ser. No. 63/026,046, filed on May 16, 2020 and Canadian Patent Application Serial No. 3,085,700 filed on Jul. 6, 2020. The contents of the aforementioned application are incorporated by reference herein.

FIELD

This disclosure relates generally to protective headgear such as helmets, masks and face shields that can be used in various activities, including sports (e.g., hockey, lacrosse, football, etc.), work, and other situations, where protection against pathogens or other contaminants is desired.

BACKGROUND

Protective headgear is used by individuals for various purposes in many activities and situations.

For example, helmets are worn in sports and other activities (e.g., motorcycling, industrial work, military activities, etc.) to protect their wearers against head injuries. To that end, helmets typically comprise a rigid outer shell and inner padding to absorb energy when impacted. For instance, in hockey, football, lacrosse, and other sports, a player wears a helmet to protect against head injuries from impacts that occur during a game.

Protection against contaminants (e.g., infectants), such as pathogens (e.g., viruses, bacteria, or other microorganisms) or other biohazards, chemical hazards, or other hazardous substances, transmittable between people (e.g. as part of spatter, an aerosol, or other droplets) may sometimes be required or otherwise desirable. In some cases, such as while engaging in sports and/or other activities, in which impact protection may also be desirable, contaminant protection may be less easily achievable.

For these and/or other reasons, there is a need to improve protective headgear, including for contaminant protection.

SUMMARY

According to various aspects, this disclosure relates to protective headgear that is wearable on a head of a user and may be configured to provide impact protection and contaminant protection. The protective headgear may comprise a helmet configured to protect the user's head against impacts and a contaminant blocker configured to protect against contaminants (e.g., infectants), such as pathogens (e.g., viruses, bacteria, or other microorganisms) or other biohazards, chemical hazards, or other hazardous substances, transmittable to or from the user (e.g. as part of spatter, an aerosol, or other droplets). The helmet and the contaminant blocker may be configured to connect or otherwise interact with one another to be usable together. This may facilitate their use to enhance protection of the user and/or an environment of the user, while maintaining performance of the user, including by providing breathability, being spatter proof, ensuring proper vision, being antifogging, being customizable, and/or having other desirable attributes.

In accordance with one aspect, there is provided a protective headgear wearable on a head of a user. The protective headgear comprises a helmet configured to protect the user's head against impacts. The protective headgear also comprises a contaminant blocker configured to cover at least part of a face of the user, protect against contaminants transmittable to or from the user, and be connected to the helmet.

In accordance with another aspect, there is provided protective headgear wearable on a head of a user. The protective headgear comprises a helmet configured to protect the user's head against impacts. The helmet comprises a faceguard configured to protect a face of the user against impacts. The protective headgear also comprises a contaminant blocker configured to cover at least part of the user's face, protect against contaminants transmittable to or from the user, and conform to the faceguard.

In accordance with another aspect, there is provided protective headgear wearable on a head of a user. The protective headgear comprises a helmet configured to protect the user's head against impacts. The helmet comprises a faceguard configured to protect a face of the user against impacts. The protective headgear also comprises a contaminant blocker configured to cover at least part of the user's face, protect against contaminants transmittable to or from the user, and be connected to the faceguard.

In accordance with another aspect, there is provided protective headgear wearable on a head of a user. The protective headgear comprises a helmet configured to protect the user's head against impacts. The helmet comprises a faceguard configured to protect a face of the user against impacts. The helmet also comprises a chin member configured to engage a chin of the user. The protective headgear further comprises a contaminant blocker configured to cover at least part of the user's face, protect against contaminants transmittable to or from the user, and be mounted between the faceguard and the chin member.

In accordance with another aspect, there is provided protective headgear wearable on a head of a user. The protective headgear comprises a helmet configured to protect the user's head against impacts. The helmet comprises a chin member configured to engage a chin of the user. The protective headgear further comprises a contaminant blocker configured to cover at least part of a face of the user, protect against contaminants transmittable to or from the user, and be connected to the chin member.

In accordance with another aspect, there is provided protective headgear wearable on a head of a user. The protective headgear comprises a helmet configured to protect the user's head against impacts. The protective headgear also comprises a contaminant blocker configured to cover at least part of a face of the user, protect against contaminants transmittable to or from the user, and be retained on the user's head solely by interacting with the helmet.

In accordance with another aspect, there is provided protective headgear wearable on a head of a user. The protective headgear comprises a helmet configured to protect the user's head against impacts. The protective headgear also comprises a contaminant blocker configured to cover at least part of a face of the user and protect against contaminants transmittable to or from the user, the contaminant blocker being strapless.

In accordance with another aspect, there is provided protective headgear wearable on a head of a user. The protective headgear comprises a helmet configured to protect the user's head against impacts. The helmet comprises a chin member configured to engage a chin of the user. The protective headgear also comprises a contaminant blocker configured to cover at least part of the user's face, protect against contaminants transmittable to or from the user, and be removable from the helmet while the chin member remains connected to a remainder of the helmet.

In accordance with another aspect, there is provided protective headgear wearable on a head of a user. The protective headgear comprises a helmet configured to protect the user's head against impacts. The helmet comprises a chin member configured to engage a chin of the user. The protective headgear also comprises a contaminant blocker configured to cover at least part of the user's face, protect against contaminants transmittable to or from the user, and be removable from the helmet without removing the chin member from the helmet.

In accordance with another aspect, there is provided protective headgear wearable on a head of a user. The protective headgear comprises a helmet configured to protect the user's head against impacts. The helmet comprises a faceguard configured to protect a face of the user against impacts. The helmet also comprises a chin member configured to engage a chin of the user. The protective headgear also comprises a contaminant blocker configured to cover at least part of the user's face, protect against contaminants transmittable to or from the user, and be removable from the helmet while the faceguard and the chin member remain connected to a remainder of the helmet.

In accordance with another aspect, there is provided a protective headgear wearable on a head of a user. The protective headgear comprises a helmet configured to protect the user's head against impacts. The helmet comprises a faceguard configured to protect a face of the user against impacts. The helmet also comprises a chin member configured to engage a chin of the user. The protective headgear also comprises a contaminant blocker configured to cover at least part of the user's face, protect against contaminants transmittable to or from the user, and be removable from the helmet without removing the faceguard and the chin member from the helmet.

In accordance with another aspect, there is provided a protective headgear wearable on a head of a user. The protective headgear comprises a helmet configured to protect the user's head against impacts. The helmet comprises a chin member configured to engage a chin of the user. The protective headgear also comprises a contaminant blocker configured to cover at least part of the user's face and protect against contaminants transmittable to or from the user. The contaminant blocker comprises a detachable fastener to detachably fasten the contaminant blocker to the chin member.

In accordance with another aspect, there is provided a contaminant blocker wearable on a head of a user to protect against contaminants transmittable to or from the user, the user wearing a helmet to protect the user's head against impacts. The contaminant blocker is configured to cover at least part of a face of the user and comprises a connector configured to connect the contaminant blocker to the helmet.

In accordance with another aspect, there is provided a contaminant blocker wearable on a head of a user to protect against contaminants transmittable to or from the user, the user wearing a helmet to protect the user's head against impacts. The helmet comprises a faceguard configured to protect a face of the user against impacts. The contaminant blocker is configured to cover at least part of the user's face and conform to the faceguard.

In accordance with another aspect, there is provided a contaminant blocker wearable on a head of a user to protect against contaminants transmittable to or from the user, the user wearing a helmet to protect the user's head against impacts. The helmet comprises a faceguard configured to protect a face of the user against impacts. The contaminant blocker is configured to cover at least part of the user's face. The contaminant blocker comprises a connector configured to be connected to the faceguard.

In accordance with another aspect, there is provided a contaminant blocker wearable on a head of a user to protect against contaminants transmittable to or from the user, the user wearing a helmet to protect the user's head against impacts. The helmet comprises a faceguard configured to protect a face of the user against impacts. The helmet also comprises a chin member configured to engage a chin of the user. The contaminant blocker is configured to cover at least part of the user's face and be mounted between the faceguard and the chin member.

In accordance with another aspect, there is provided a contaminant blocker wearable on a head of a user to protect against contaminants transmittable to or from the user, the user wearing a helmet to protect the user's head against impacts. The helmet comprises a chin member configured to engage a chin of the user. The contaminant blocker is configured to cover at least part of a face of the user. The contaminant blocker comprises a connector configured to be connected to the chin member.

In accordance with another aspect, there is provided a contaminant blocker wearable on a head of a user to protect against contaminants transmittable to or from the user, the user wearing a helmet to protect the user's head against impacts. The contaminant blocker is configured to cover at least part of a face of the user and be retained on the user's head solely by interacting with the helmet.

In accordance with another aspect, there is provided a contaminant blocker wearable on a head of a user to protect against contaminants transmittable to or from the user, the user wearing a helmet to protect the user's head against impacts. The contaminant blocker is configured to cover at least part of a face of the user and being strapless.

In accordance with another aspect, there is provided a clear shield wearable on a head of a user to protect against contaminants transmittable to or from the user. The clear shield is configured to cover at least part of a face of the user and comprises a clear material allowing the user to see therethrough. The clear shield also comprises a vent comprising a vent opening and a filter in the vent opening.

In accordance with another aspect, there is provided a clear shield wearable on a head of a user to protect against contaminants transmittable to or from the user. The clear shield is configured to cover at least part of a face of the user. The clear shield comprises a thin clear member including clear material allowing the user to see therethrough. The thin clear member is curved between a left lateral side of the clear shield and a right lateral side of the clear shield and shaped to bend towards the user's face towards a top of the thin clear member and towards a bottom of the thin clear member.

In accordance with another aspect, there is provided a clear shield wearable on a head of a user to protect against contaminants transmittable to or from the user. The clear shield is configured to cover at least part of a face of the user. The clear shield comprises a thin clear member including clear material allowing the user to see therethrough. The thin clear member is concave in a widthwise direction of the clear shield and in a heightwise direction of the clear shield.

In accordance with another aspect, there is provided a clear shield wearable on a head of a user to protect against contaminants transmittable to or from the user, the user wearing a helmet to protect the user's head against impacts. The helmet comprises a visor to protect a face of the user against impacts. The visor comprises a lens and a grid disposed below the lens and comprising vent openings. The clear shield is configured to cover at least part of the user's face and overlie the grid of the visor.

In accordance with another aspect, there is provided a clear shield wearable on a head of a user to protect against contaminants transmittable to or from the user, the user wearing a helmet to protect the user's head against impacts. The helmet comprises a visor to protect a face of the user against impacts. The visor comprises a lens and a grid disposed below the lens and comprising vent openings. The clear shield is configured to cover at least part of the user's face and interlock with the grid of the visor.

In accordance with another aspect, there is provided a mask wearable on a head of a user to protect against contaminants transmittable to or from the user, the user wearing a helmet to protect a head of the user against impacts. The mask is configured to engage and cover at least part of a face of the user. The mask comprises an opening to receive part of the helmet.

In accordance with another aspect, there is provided a mask wearable on a head of a user to protect against contaminants transmittable to or from the user, the user wearing a helmet to protect a head of the user against impacts. The mask is configured to engage and cover at least part of the user's face. The mask comprises a connector configured to be connected to the helmet.

In accordance with another aspect, there is provided a mask wearable on a head of a user to protect against contaminants transmittable to or from the user, the user wearing a helmet to protect a head of the user against impacts. The helmet comprises a faceguard configured to protect a face of the user against impacts. The mask is configured to engage and cover at least part of the user's face. The mask comprises a connector configured to be connected to the faceguard.

In accordance with another aspect, there is provided a mask wearable on a head of a user to protect against contaminants transmittable to or from the user, the user wearing a helmet to protect a head of the user against impacts. The helmet comprises a faceguard configured to protect a face of the user against impacts. The helmet also comprises a chin member configured to engage a chin of the user. The mask is configured to engage and cover at least part of the user's face and be mounted between the faceguard and the chin member.

In accordance with another aspect, there is provided a mask wearable on a head of a user to protect against contaminants transmittable to or from the user, the user wearing a helmet to protect a head of the user against impacts. The helmet comprises a chin member configured to engage a chin of the user. The mask is configured to engage and cover at least part of a face of the user. The mask comprises a connector configured to be connected to the chin member.

In accordance with another aspect, there is provided a mask wearable on a head of a user to protect against contaminants transmittable to or from the user, the user wearing a helmet to protect a head of the user against impacts. The mask is configured to engage and cover at least part of a face of the user and be retained on the user's head solely by interacting with the helmet.

In accordance with another aspect, there is provided a mask wearable on a head of a user to protect against contaminants transmittable to or from the user, the user wearing a helmet to protect a head of the user against impacts. The mask is configured to engage and cover at least part of a face of the user and being strapless.

In accordance with another aspect, there is provided a mask wearable on a head of a user to protect against contaminants transmittable to or from the user, the user wearing a helmet to protect a head of the user against impacts. The helmet comprises an outer shell. The mask is configured to engage and cover at least part of a face of the user. The mask comprises a strap system configured to fasten the mask to fastening elements disposed on the outer shell.

In accordance with another aspect, there is provided a mask wearable on a head of a user to protect against contaminants transmittable to or from the user, the user wearing a helmet to protect a head of the user against impacts. The helmet comprises a chin member configured to engage a chin of the user. The mask is configured to engage and cover at least part of a face of the user. The mask is removable from the helmet while the chin member remains connected to a remainder of the helmet.

In accordance with another aspect, there is provided a mask wearable on a head of a user to protect against contaminants transmittable to or from the user, the user wearing a helmet to protect a head of the user against impacts. The helmet comprises a chin member configured to engage a chin of the user. The mask is configured to engage and cover at least part of a face of the user. The mask is removable from the helmet without removing the chin member from the helmet.

In accordance with another aspect, there is provided a mask wearable on a head of a user to protect against contaminants transmittable to or from the user, the user wearing a helmet to protect a head of the user against impacts. The helmet comprises a faceguard to protect the user's face against impacts and a chin member configured to engage a chin of the user. The mask is configured to engage and cover at least part of a face of the user. The mask is removable from the helmet while the faceguard and the chin member remain connected to a remainder of the helmet.

In accordance with another aspect, there is provided a mask wearable on a head of a user to protect against contaminants transmittable to or from the user, the user wearing a helmet to protect a head of the user against impacts. The helmet comprises a faceguard to protect the user's face against impacts and a chin member configured to engage a chin of the user. The mask is configured to engage and cover at least part of a face of the user. The mask is removable from the helmet without removing the faceguard and the chin member from the helmet.

In accordance with another aspect, there is provided a mask wearable on a head of a user to protect against contaminants transmittable to or from the user, the user wearing a helmet to protect a head of the user against impacts. The helmet comprises a chin member configured to engage a chin of the user. The mask is configured to engage and cover at least part of a face of the user. The mask comprises a detachable fastener to detachably fasten the mask to the chin member.

In accordance with another aspect, there is provided a mask wearable on a head of a user to protect against contaminants transmittable to or from the user, the user wearing a helmet to protect a head of the user against impacts. The mask is configured to engage and cover at least part of a face of the user. The mask has a differential pressure of less than 6 mm $H_2O/cm^2$ according to ASTM F2100-19.

In accordance with another aspect, there is provided a mask wearable on a head of a user to protect against contaminants transmittable to or from the user, the user wearing a helmet to protect a head of the user against impacts. The mask is configured to engage and cover at least part of a face of the user. The mask is a level 2 barrier according to ASTM F2100-19.

In accordance with another aspect, there is provided a mask wearable on a head of a user to protect against contaminants transmittable to or from the user, the user wearing a helmet to protect a head of the user against impacts. The mask is configured to engage and cover at least part of a face of the user. The left and right lateral portions of the mask are more breathable than a central portion of the mask disposed between the left and right lateral portions of the mask in a widthwise direction of the mask.

In accordance with another aspect, there is provided a mask wearable on a head of a user to protect against contaminants transmittable to or from the user, the user wearing a helmet to protect a head of the user against impacts. The mask is configured to engage and cover at least part of a face of the user. The mask comprises a hydration opening configured to allow the user to drink potable liquid through the mask.

In accordance with another aspect, there is provided a mask wearable on a head of a user to protect against contaminants transmittable to or from the user, the user wearing a helmet to protect a head of the user against impacts. The mask is configured to engage and cover at least part of a face of the user. The mask comprises a hydration opening configured to allow the user to drink potable liquid through the mask. The mask comprises portions movable relative to one another to open and close the hydration opening.

In accordance with another aspect, there is provided a mask wearable on a head of a user to protect against contaminants transmittable to or from the user, the user wearing a helmet to protect a head of the user against impacts. The mask is configured to engage and cover at least part of a face of the user. The mask is customized for the user's face based on 3D model data representative of the user's face.

In accordance with another aspect, there is provided a mask wearable on a head of a user to protect against contaminants transmittable to or from the user, the user wearing a helmet to protect a head of the user against impacts. The mask comprises 3D-printed material.

In accordance with another aspect, there is provided a mask wearable on a head of a user to protect against contaminants transmittable to or from the user, the user wearing a helmet to protect a head of the user against impacts. The mask is configured to engage and cover at least part of the user's face and provide a cooling effect to the user.

In accordance with another aspect, there is provided a mask wearable on a head of a user to protect against contaminants transmittable to or from the user, the mask being configured to engage and cover at least part of a face of the user. The mask is customized for the user's face based on 3D model data representative of the user's face.

In accordance with another aspect, there is provided a mask wearable on a head of a user to protect against contaminants transmittable to or from the user. The mask comprises 3D-printed material.

In accordance with another aspect, there is provided a method of customizing a mask wearable on a head of a user to protect against contaminants transmittable to or from the user. The mask is configured to engage and cover at least part of a face of the user. The method comprises obtaining 3D model data representative of the user's face. The method also comprises generating 3D model data representative of the mask based on the 3D model data representative of the user's face. The method further comprises making the mask based on the 3D model data representative of the mask.

In accordance with another aspect, there is provided a method of customizing a mask wearable on a head of a user to protect against contaminants transmittable to or from the user. The mask is configured to engage and cover at least part of a face of the user. The method comprises obtaining 3D model data representative of the user's face. The method comprises generating 3D model data representative of the mask based on the 3D model data representative of the user's face. The method comprises 3D printing at least part of the mask based on the 3D model data representative of the mask.

In accordance with another aspect, there is provided a protective headgear wearable on a head of a user engaging in a sport. The protective headgear comprises a sport helmet configured to protect the user's head against impacts during the sport including with other individuals. The sport helmet comprises an outer shell, a liner disposed within and secured to the outer shell and a faceguard connected to the outer shell and configured to protect a face of the user against the impacts. The protective headgear also comprises an infectant blocker configured to cover at least part of the user's face, protect against infectants transmittable to or from the user, and be connected to the faceguard.

In accordance with another aspect, there is provided a protective headgear wearable on a head of a user engaging in a sport. The protective headgear comprises a sport helmet configured to protect the user's head against impacts during the sport including with other individuals. The sport helmet comprises an outer shell and a liner disposed within and secured to the outer shell. The protective headgear also comprises an infectant blocker configured to cover at least part of the user's face, protect against infectants transmittable to or from the user, and be connected to the helmet.

In accordance with another aspect, there is provided a protective headgear wearable on a head of a user engaging in a sport. The protective headgear comprises a sport helmet configured to protect the user's head against impacts during the sport including with other individuals. The sport helmet comprises an outer shell and a liner disposed within and secured to the outer shell. The protective headgear also comprises an infectant blocker configured to cover at least part of the user's face, protect against infectants transmittable to or from the user, and be detachably fastened to the helmet such that the infectant blocker is removable from the helmet and the helmet is usable by the user without the infectant blocker.

In accordance with another aspect, there is provided an infectant blocker wearable on a head of a user engaging in a sport, the user wearing a sport helmet configured to protect the user's head against impacts during the sport including with other individuals. The sport helmet comprises an outer shell, a liner disposed within and secured to the outer shell and a faceguard connected to the outer shell and configured to protect a face of the user against the impacts. The infectant blocker is configured to cover at least part of the user's face and protect against infectants transmittable to or from the user. The infectant blocker comprises a connector configured to connect the infectant blocker to the faceguard.

In accordance with another aspect, there is provided an infectant blocker wearable on a head of a user engaging in a sport, the user wearing a sport helmet configured to protect the user's head against impacts during the sport including with other individuals. The sport helmet comprises an outer shell and a liner disposed within and secured to the outer shell. The infectant blocker is configured to cover at least part of a face of the user and protect against infectants transmittable to or from the user. The infectant blocker comprises a connector configured to connect the infectant blocker to the helmet.

In accordance with another aspect, there is provided an infectant blocker wearable on a head of a user engaging in a sport, the user wearing a sport helmet configured to protect the user's head against impacts during the sport including with other individuals. The sport helmet comprises an outer shell and a liner disposed within and secured to the outer shell. The infectant blocker is configured to cover at least part of a face of the user and protect against infectants transmittable to or from the user. The infectant blocker comprises a connector configured to detachably fasten the infectant blocker to the helmet such that the infectant blocker is removable from the helmet and the helmet is usable by the user without the infectant blocker.

In accordance with another aspect, there is provided a mask wearable on a head of a user engaging in a sport, the user wearing a sport helmet configured to protect the user's head against impacts during the sport including with other individuals. The sport helmet comprises an outer shell, a liner disposed within and secured to the outer shell, and a faceguard connected to the outer shell and configured to protect a face of the user against the impacts. The mask is configured to cover at least part of the user's face and protect against infectants transmittable to or from the user. The mask comprises a connector configured to connect the mask to the faceguard.

In accordance with another aspect, there is provided a mask wearable on a head of a user engaging in a sport, the user wearing a sport helmet configured to protect the user's head against impacts during the sport including with other individuals. The sport helmet comprises an outer shell and a liner disposed within and secured to the outer shell. The mask is configured to cover at least part of a face of the user and protect against infectants transmittable to or from the user. The mask comprises a connector configured to connect the mask to the helmet.

In accordance with another aspect, there is provided a mask wearable on a head of a user engaging in a sport, the user wearing a sport helmet configured to protect the user's head against impacts during the sport including with other individuals. The sport helmet comprises an outer shell and a liner disposed within and secured to the outer shell. The mask is configured to cover at least part of a face of the user and protect against infectants transmittable to or from the user. The mask comprises a connector configured to detachably fasten the mask to the helmet such that the mask is removable from the helmet and the helmet is usable by the user without the mask.

In accordance with another aspect, there is provided a clear shield on a head of a user engaging in a sport, the user wearing a sport helmet configured to protect the user's head against impacts during the sport including with other individuals. The sport helmet comprises an outer shell, a liner disposed within and secured to the outer shell; and a faceguard connected to the outer shell and configured to protect a face of the user against the impacts. The clear shield is configured to cover at least part of the user's face and protect against infectants transmittable to or from the user. The clear shield comprises a connector configured to connect the clear shield to the faceguard.

In accordance with another aspect, there is provided a clear shield on a head of a user engaging in a sport, the user wearing a sport helmet configured to protect the user's head against impacts during the sport including with other individuals. The sport helmet comprises an outer shell and a liner disposed within and secured to the outer shell. The clear shield is configured to cover at least part of a face of the user and protect against infectants transmittable to or from the user. The clear shield comprises a connector configured to connect the clear shield to the helmet.

In accordance with another aspect, there is provided a clear shield on a head of a user engaging in a sport, the user wearing a sport helmet configured to protect the user's head against impacts during the sport including with other individuals. The sport helmet comprises an outer shell and a liner disposed within and secured to the outer shell. The clear shield is configured to cover at least part of a face of the user and protect against infectants transmittable to or from the user. The clear shield comprises a connector configured to detachably fasten the clear shield to the helmet such that the clear shield is removable from the helmet and the helmet is usable by the user without the clear shield.

These and other aspects of this disclosure will now become apparent to those ordinarily skilled upon review of a description of embodiments that follows in conjunction with accompanying drawings.

These and other aspects of this disclosure will now become apparent to those ordinarily skilled upon review of a description of embodiments that follows in conjunction with accompanying drawings.

BRIEF DESCRIPTION OF DRAWINGS

A detailed description of embodiments is provided below, by way of example only, with reference to drawings accompanying this description, in which:

FIG. 4H is a rear view of the clear shield of FIGS. 47A to 47D;

Figure 1:
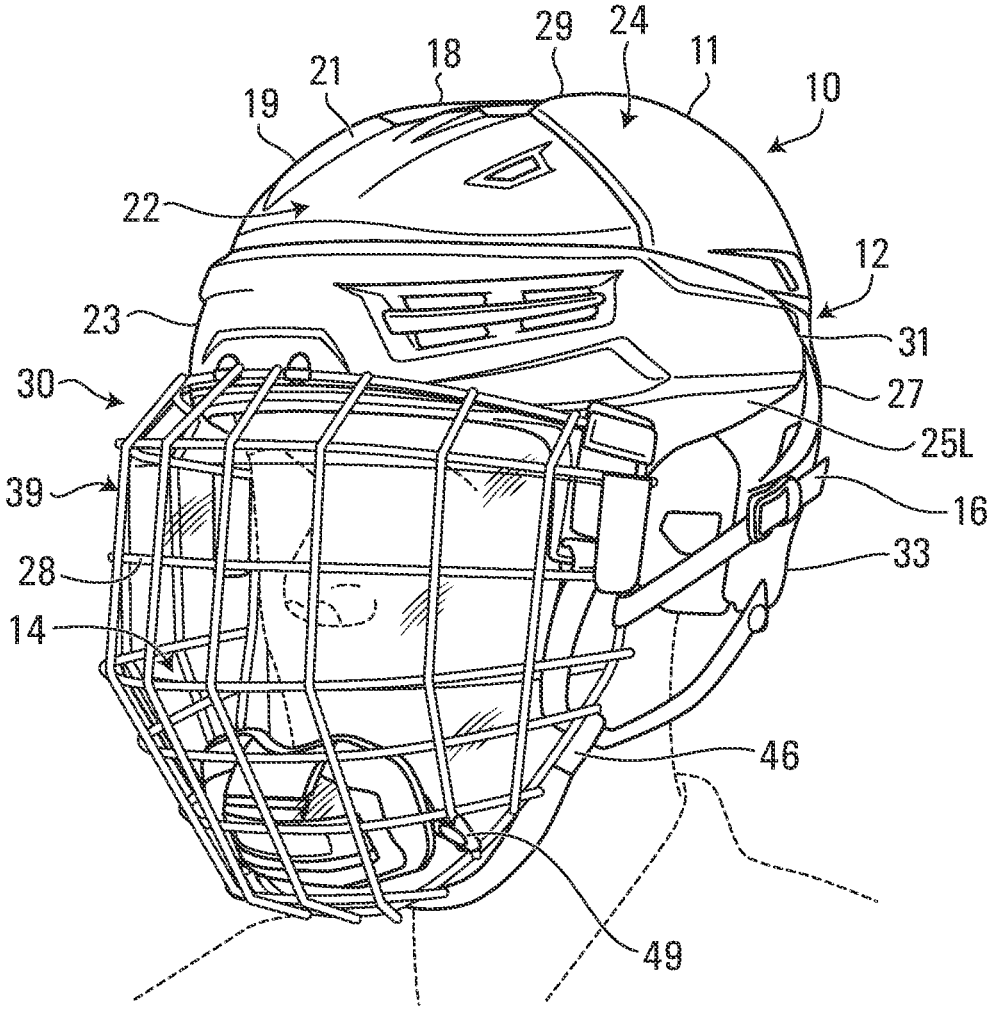
FIGS. 1 to 10 show embodiments of protective headgear wearable on a user's head and comprising a helmet to protect the user's head against impacts and a contaminant blocker, such as a clear shield or a mask, configured to protect the user against contaminants.

It is to be expressly understood that the description and drawings are only for purposes of illustrating certain embodiments and are an aid for understanding. They are not intended to be and should not be limiting.

DETAILED DESCRIPTION OF EMBODIMENTS

FIGS. 1 to 10 show embodiments of protective headgear 10 wearable on a head 100 of a user and configured to provide impact protection and contaminant protection. In this embodiment, the protective headgear 10 comprises a helmet 12 configured to protect the user's head 100 against impacts and a contaminant blocker 14 configured to protect against contaminants (e.g., infectants), such as pathogens (e.g., viruses, bacteria, or other microorganisms) or other biohazards, chemical hazards, or other hazardous substances, transmittable to or from the user.

In this embodiment, the helmet 12 is an athletic helmet for protecting the head 100 of the user who is engaging in a sport or other athletic activity against impacts. More particularly, in this embodiment, the helmet 12 is a hockey helmet for protecting the head 100 of the user, who is a hockey player, against impacts (e.g., from a puck or ball, a hockey stick, a board, ice or another playing surface, etc., with another player, etc.).

The contaminant blocker 14, which may sometimes be referred to as a hazardous-substance blocker or a respirator, is configured to block contaminants (i.e., hinder passage of contaminants by interposing an obstruction) from reaching a face of the user, entering a respiratory system of the user, and infecting or otherwise contaminating the user and/or from being shed or otherwise transmitted outwardly by the user. In this embodiment, the contaminant blocker 14 is configured to block pathogens or other biohazards, which may be part of spatter, an aerosol, or other droplets containing a virus, bacteria, or other microorganism, transmittable to or from the user while playing hockey. In that sense, in this embodiment, the contaminant blocker 14 may be referred to as a biohazard blocker.

As further discussed later, in this embodiment, the helmet 12 and the biohazard blocker 14 are configured to connect or otherwise interact with one another to be usable together. This may facilitate their use to enhance protection of the user and/or an environment of the user (e.g., including players or other individuals encountered or nearby during play) while maintaining performance of the user, including by providing breathability, being spatter proof, ensuring proper vision, being antifogging, being customizable, and/or having other desirable attributes.

The helmet 12 comprises an outer shell 11 and a liner 15 to protect the user's head 100. In this embodiment, the helmet 12 also comprises a faceguard 30 to protect at least part of the user's face, including eyes of the user, and a chin member 26 to engage a chin of the user for comfort and/or securing the helmet 12 to the user's head 100.

Figure 11:
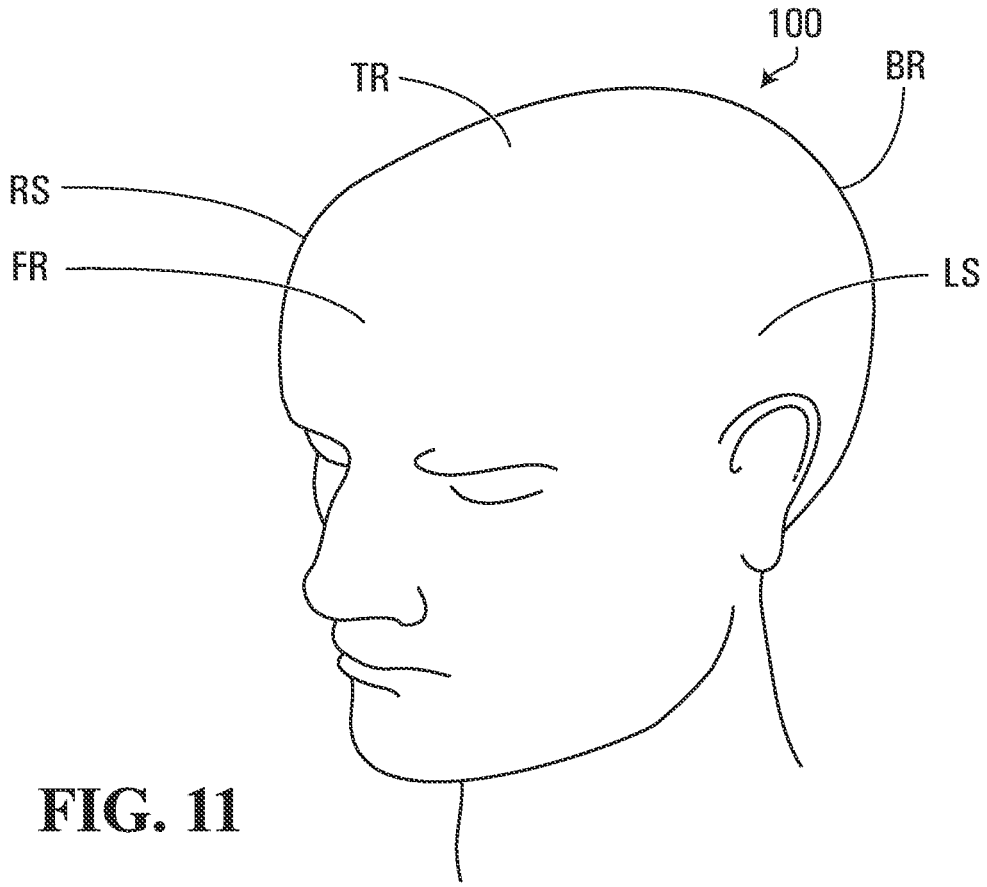
FIGS. 11 and 12 show perspective and elevational views of the user's head.
Figure 12:
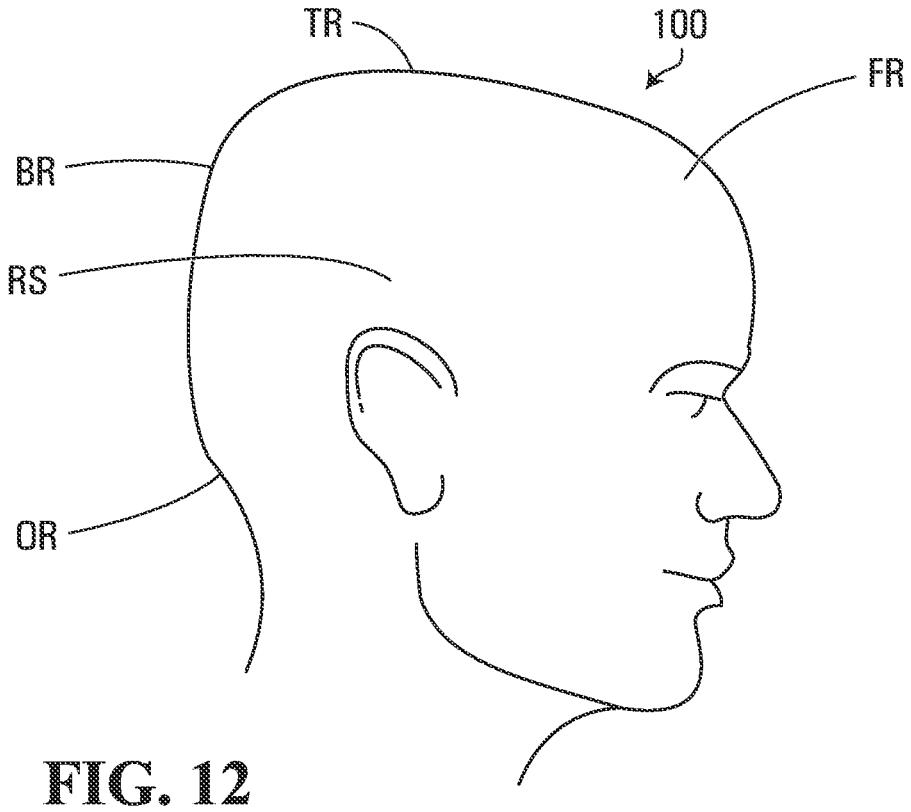

A cavity 13 of the helmet 12 is configured to receive the user's head 100. In response to an impact, the helmet 12 absorbs energy from the impact to protect the user's head 100. The helmet 12 protects various regions of the user's head 100. As shown in FIGS. 11 and 12, the user's head 100 comprises a front region FR, a top region TR, left and right side regions LS, RS, a back region BR, and an occipital region OR. The front region FR includes a forehead and a front top part of the user's head 100 and generally corresponds to a frontal bone region of the user's head 100. The left and right side regions LS, RS are approximately located above the user's ears. The back region BR is opposite the front region FR and includes a rear upper part of the user's head 100. The occipital region OR substantially corresponds to a region around and under the head's occipital protuberance.

Figure 14:
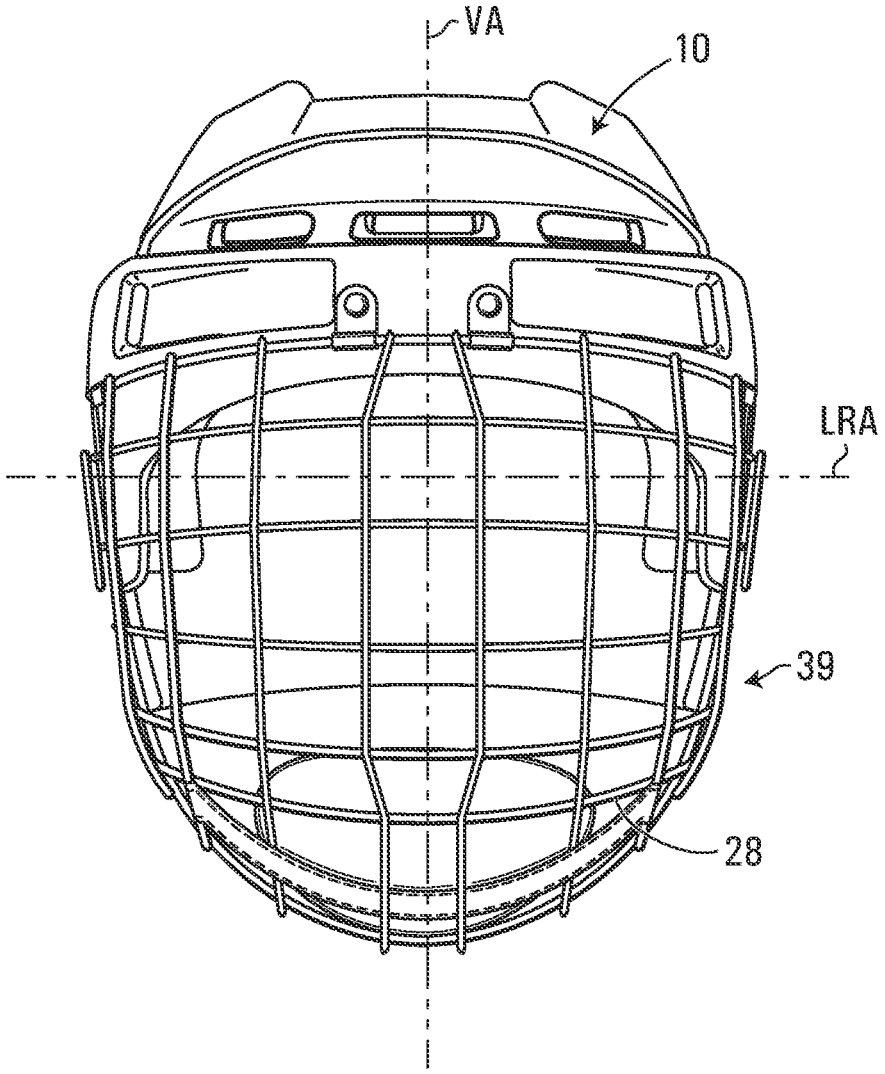
FIG. 14 shows a front view of the helmet comprising a faceguard.
Figure 15:
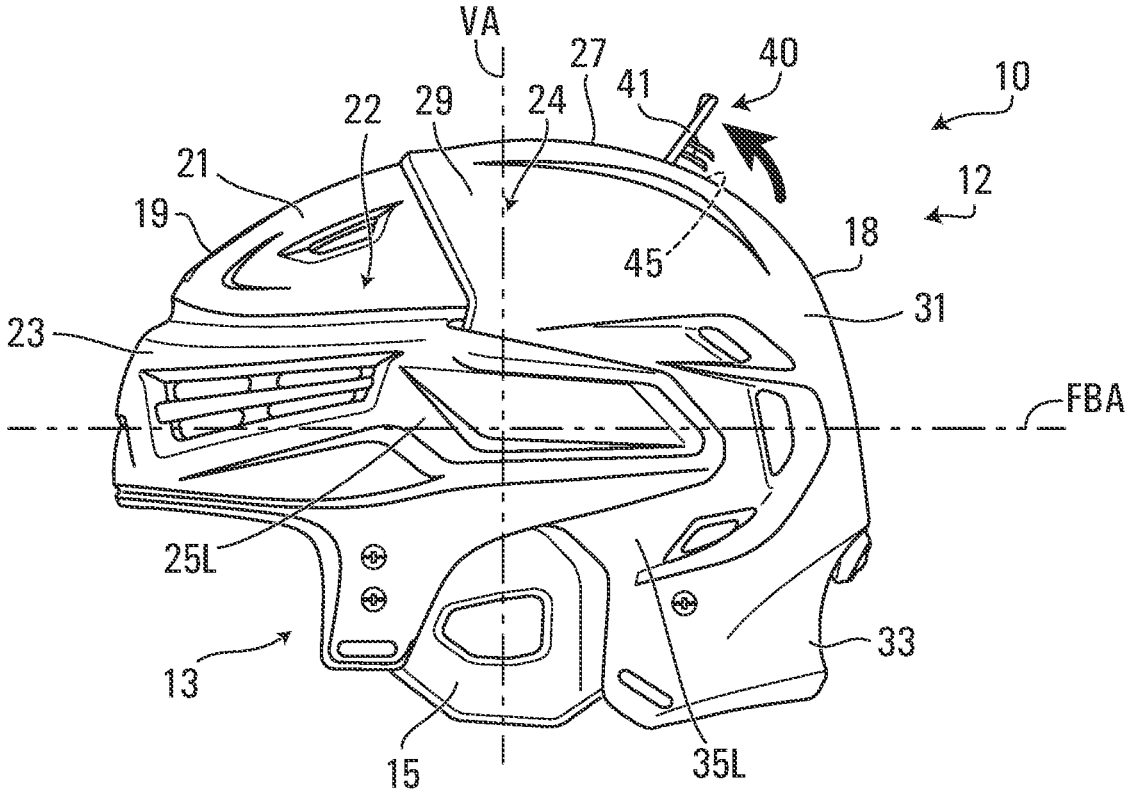
FIGS. 15 to 17 show elevational views of an outer shell of the helmet with shell members in different positions.

The helmet 12 comprises an external surface 18 and an internal surface 20 that contacts the user's head 100 when the helmet 12 is worn. As shown in FIGS. 14 and 15, the helmet 12 has a front-back axis FBA, a left-right axis LRA, and a vertical axis VA which are respectively generally parallel to a dorsoventral axis, a dextrosinistral axis, and a cephalocaudal axis of the player when the helmet 12 is worn and which respectively define a front-back direction, a lateral direction, and a vertical direction of the helmet 12. Since they are generally oriented longitudinally and transversally of the helmet 12, the front-back axis FBA and the left-right axis LRA can also be referred to as a longitudinal axis and a transversal axis, respectively, while the front-back direction and the lateral direction can also be referred to a longitudinal direction and a transversal direction, respectfully.

The outer shell 11 provides strength and rigidity to the helmet 12. To that end, the outer shell 11 typically comprises rigid material 27. For example, in various embodiments, the rigid material 27 of the outer shell 11 may be a thermoplastic material such as polyethylene (PE), polyamide (nylon), or polycarbonate, a thermosetting resin, or any other suitable material. The outer shell 11 includes an inner surface 17 facing the inner liner 15 and an outer surface 19 opposite the inner surface 17. The outer surface 19 of the outer shell 11 constitutes at least part of the external surface 18 of the helmet 12.

In this embodiment, the outer shell 11 comprises shell members 22, 24 that are connected to one another. In this example, the shell member 22 comprises a top portion 21 for facing at least part of the top region TR of the user's head 100, a front portion 23 for facing at least part of the front region FR of the user's head 100, and left and right lateral side portions 25L, 25R extending rearwardly from the front portion 23 for facing at least part of the left and right side regions LS, RS of the user's head 100, respectively. The shell member 24 comprises a top portion 29 for facing at least part of the top region TR of the user's head 100, a back portion 31 for facing at least part of the back region BR of the user's head 100, an occipital portion 33 for facing at least part of the occipital region OR of the user's head 100, and left and right lateral side portions 35L, 35R extending forwardly from the back portion 31 for facing at least part of the left and right side regions LS, RS of the user's head 100, respectively.

Figure 13:
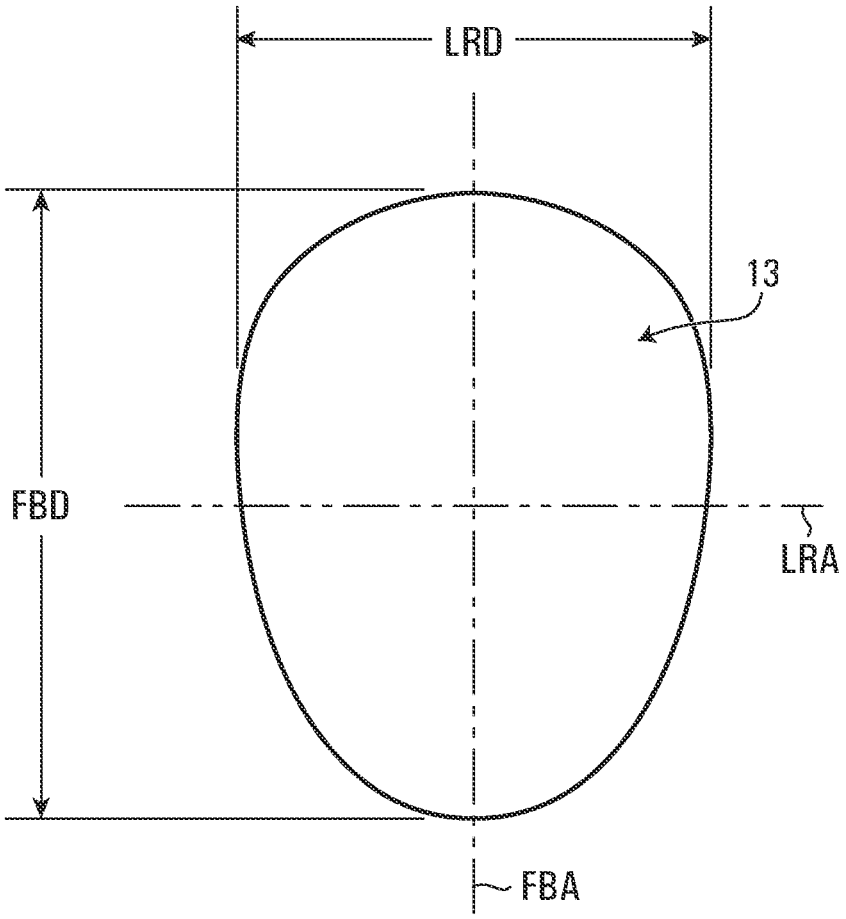
FIG. 13 shows internal dimensions of a cavity of the helmet.

In this embodiment, the helmet 12 is adjustable to adjust how it fits on the user's head 100. To that end, the helmet 12 comprises an adjustment mechanism 40 for adjusting a fit of the helmet 12 on the user's head 100. The adjustment mechanism 40 may allow the fit of the helmet 12 to be adjusted by adjusting one or more internal dimensions of the cavity 13 of the helmet 12, such as a front-back internal dimension FBD of the cavity 13 in the front-back direction of the helmet 12 and/or a left-right internal dimension LRD of the cavity 13 in the left-right direction of the helmet 12, as shown in FIG. 13.

Figure 16:
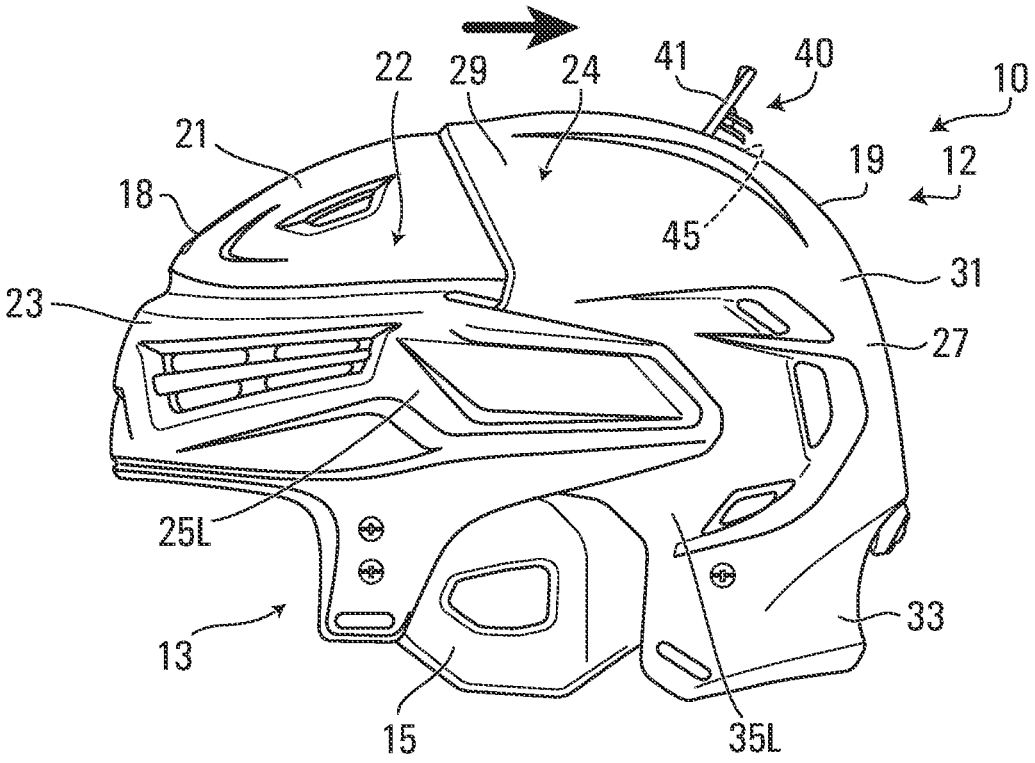
Figure 17:
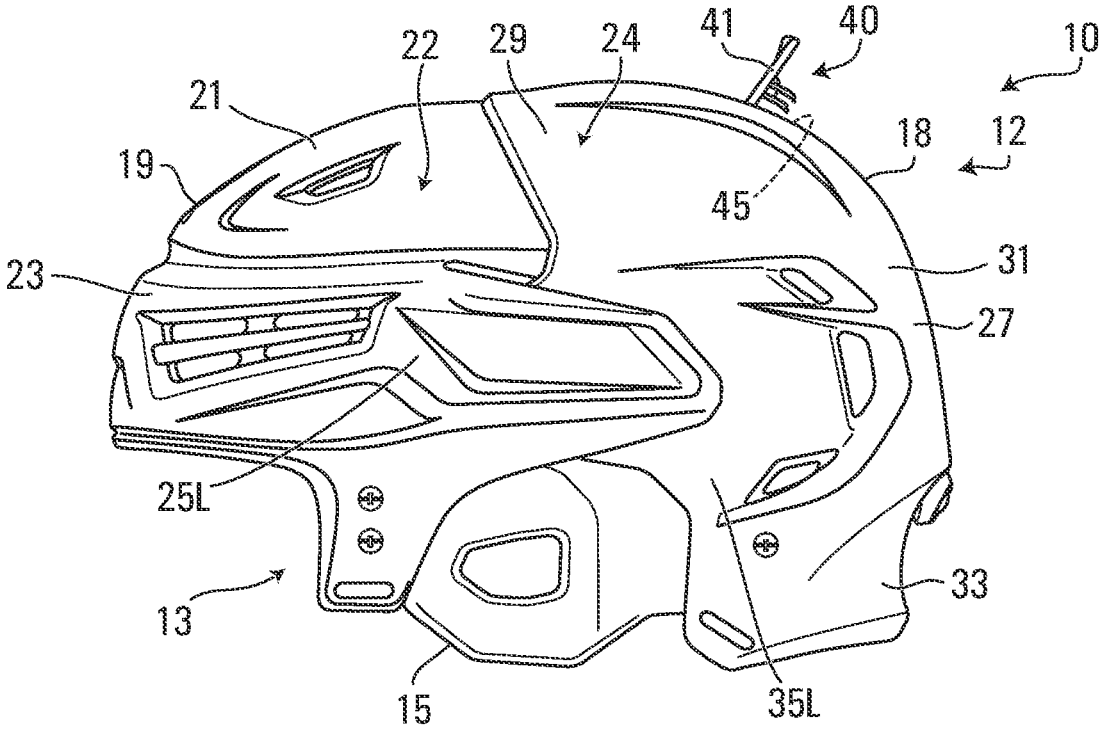
Figure 18:
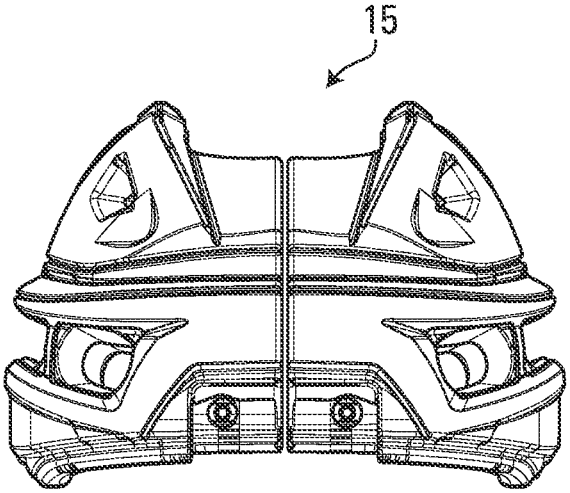
FIGS. 18 and 19 show pads of a liner of the helmet.

More particularly, in this embodiment, the adjustment mechanism 40 is configured such that the outer shell 11 and the inner liner 15 are adjustable to adjust the fit of the helmet 12 on the user's head 100. To that end, in this embodiment, the shell members 22, 24 are movable relative to one another to adjust the fit of the helmet 12 on the user's head 100. In this example, relative movement of the shell members 22, 24 for adjustment purposes is in the front-back direction of the helmet 12 such that the front-back internal dimension FBD of the cavity 13 of the helmet 12 is adjusted. This is shown in FIGS. 15, 16 and 17 in which the shell member 24 is moved relative to the shell member 22 from a first position, which is shown in FIG. 15 and which corresponds to a minimum size of the helmet 12, to a second position, which is shown in FIG. 16 and which corresponds to an intermediate size of the helmet 12, and to a third position, which is shown in FIG. 17 and which corresponds to a maximum size of the helmet 12.

In this example of implementation, the adjustment mechanism 40 comprises an actuator 41 that can be moved (in this case pivoted) by the player between a locked position, in which the actuator 41 engages a locking part 45 of the shell member 22 and thereby locks the shell members 22, 24 relative to one another, and a release position, in which the actuator 41 is disengaged from the locking part 45 of the shell member 22 and thereby permits the shell members 22, 24 to move relative to one another so as to adjust the size of the helmet 12. The adjustment mechanism 40 may be implemented in any other suitably way in other embodiments.

The liner 15 is disposed within the outer shell 11, i.e., between the outer shell 11 and the user's head 100 when the helmet 10 is worn. More particularly, the liner 15 comprises shock-absorbing material. For instance, in some cases, the shock-absorbing material may include a polymeric foam (e.g., expanded polypropylene (EPP) foam, expanded polyethylene (EPE) foam, expanded polymeric microspheres (e.g., Expancel™ microspheres commercialized by Akzo Nobel), or any other suitable polymeric foam material) and/or a polymeric structure comprising one or more polymeric materials. Any other material with suitable impact energy absorption may be used in other embodiments. Additionally or alternatively, in some embodiments, the inner liner 15 may comprise an array of shock absorbers that are configured to deform when the helmet 12 is impacted. For instance, in some cases, the array of shock absorbers may include an array of compressible cells that can compress when the helmet 12 is impacted. Examples of this are described in U.S. Pat. No. 7,677,538 and U.S. Patent Application Publication 2010/0258988, which are incorporated by reference herein.

The liner 15 may be connected to the outer shell 11 in any suitable way. For example, in some embodiments, the inner liner 15 may be fastened to the outer shell 11 by one or more fasteners such as mechanical fasteners (e.g., tacks, staples, rivets, screws, stitches, etc.), an adhesive, or any other suitable fastener.

Figure 19:
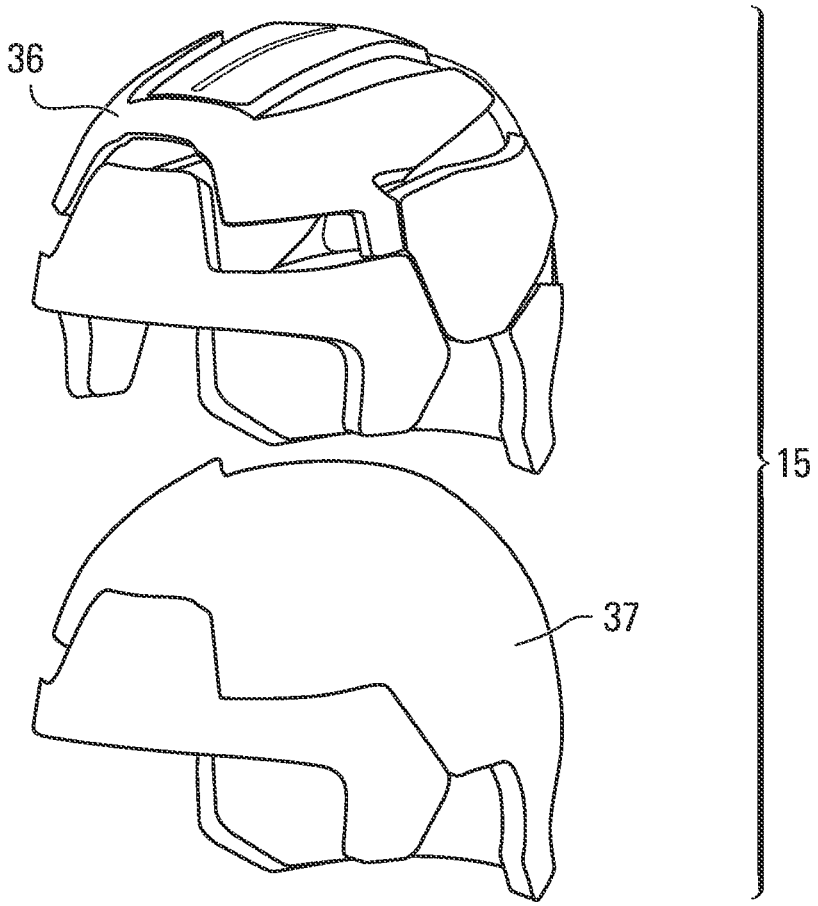

In this embodiment, as shown in FIG. 19, the liner 15 comprises a plurality of pads 36, 37 disposed between the outer shell 11 and the user's head 100 when the helmet 12 is worn. In this example, respective ones of the pads 36, 37 are movable relative to one another and with the shell members 22, 24 to allow adjustment of the fit of the helmet 12 using the adjustment mechanism 40.

In this example, the pads 36 are responsible for absorbing at least a bulk of the impact energy transmitted to the inner liner 15 when the helmet 12 is impacted and can therefore be referred to as "absorption" pads. In this embodiment, respective one of the pads 36 are facing at least part of the front region FR and left side region LS of the user's head 100, at least part of the front region FR and right side region RS of the user's head 100, at least part of the back region BR and left side region LS of the user's head 100, at least part of the back region BR and right side region RS of the user's head 100. The shell member 22 overlays some of the pads 36 while the shell member 24 overlays other ones of the pads 36.

In this embodiment, the pads 37 are responsible to provide comfort to the user's head 100 and can therefore be referred to as "comfort" pads. The comfort pads 37 may comprise any suitable soft material providing comfort to the player. For example, in some embodiments, the comfort pads 37 may comprise polymeric foam such as polyvinyl chloride (PVC) foam, polyurethane foam (e.g., PORON XRD foam commercialized by Rogers Corporation), vinyl nitrile foam or any other suitable polymeric foam material and/or a polymeric structure comprising one or more polymeric materials. In some embodiments, given ones of the comfort pads 37 may be secured (e.g., adhered, fastened, etc.) to respective ones of the absorption pads 36. In other embodiments, given ones of the comfort pads 37 may be mounted such that they are movable relative to the absorption pads 36.

The faceguard 30 is for protecting at least part of the user's face, including his/her eyes. That is, the faceguard 30 may protect an entirety of the user's face, in which case it may be referred to as providing "full-face" protection, or may protect less than the entirety (e.g., half or some other fraction) of the user's face, in which case it may be referred to as providing "half-face" or "partial-face" protection.

In some embodiments, the faceguard 30 comprises a grid 39, sometimes referred to as a "cage", which includes a plurality of wires 28 intersecting one another. The wires 28 may be metallic (e.g., made of steel, titanium and/or other suitable metal). Respective ones of the wires 28 may be connected to one another by welding, by integrally forming (e.g., casting, additively-manufacturing, etc.) them together, and/or by any other means.

In other embodiments, the faceguard 30 comprises a visor 42 that is transparent to allow the user to see through the visor 42 and is configured to withstand impacts during play. Thus, the visor 42, which may sometimes be referred to as a transparent facial protector, constitutes a clear shield comprising clear material 70 to protect at least part of the user's face against impacts. Although the visor 42 is transparent, at least part of the visor 42 may be tinted in some embodiments. In some cases, the visor 42 may be configured to provide protection from radiation (e.g., ultraviolet (UV) radiation). The visor 42 may have any suitable size. In some examples, the visor 42 is dimensioned to cover an eye region and a mouth region of the user's face (e.g., in which case it may sometimes be referred to as a transparent full-face protector). In other examples, the visor 42 is dimensioned to cover the eye region of the user's face to protect his/her eyes and to not cover the mouth region of the user's face (e.g., in which case it may sometimes be referred to as a transparent half- or partial-face protector).

The clear material 70 of the visor 42 may comprise any suitable polymeric material having suitable impact-resistance. More particularly, in this example of implementation, the clear material 70 of the visor 42 comprises polycarbonate. The clear material 70 may comprise any other suitable material in other examples of implementation (e.g., clear nylon, urethane-based material, polymethyl methacrylate, etc.).

The chin member 26 is configured to engage the user's chin to provide comfort and/or secure the helmet 12 to the user's head 100. In this embodiment, the chin member 26 comprises a chinstrap 46 extending from a left lateral side of the helmet 12 to a right lateral side of the helmet 12 and a chin cup 48 configured for cupping the user's chin (e.g., and including padding for comfort or additional protection). In some examples, the chin cup 48 may be mounted to the chin strap 46, the faceguard 30 and/or another component of the helmet 12. In some cases, the chin cup 48 may include a chin-cup strap 49 to mount the chin cup 48 to the faceguard 30.

In this embodiment, the biohazard blocker 14 is configured to be connected to the helmet 12. Thus, the biohazard blocker 14 comprises a connector 47 for connecting the biohazard blocker 14 to the helmet 12. For instance, in some embodiments, the connector 47 of the biohazard blocker 14 may be configured to connect the biohazard blocker 14 to the faceguard 30, the chin member 26, the outer shell 11, and/or another component of the helmet 12. In some examples, the connector 47 of the biohazard blocker 14 may comprise one or more openings for receiving a strap (e.g., the chin-cup strap 49 or the chin strap 46) or other fastener (e.g., a clip) and/or part of the faceguard 30, the chin member 26, the outer shell 11, and/or another component of the helmet 12, and/or may comprise a fastener (e.g., a clip, button, etc.). Also, in some examples, the biohazard blocker 14 is strapless in that it is free of any strap (e.g., earloop or other strap), i.e., does not have any strap, engaging the user's head, as the biohazard blocker 14 is configured to be retained on the user's head solely by interacting with the helmet 12 (e.g., the chin-cup strap 49, the chin strap 46, the chin cup 48, and/or the faceguard 30).

The biohazard blocker 14 may be implemented in various ways in various embodiments.

Figure 2:
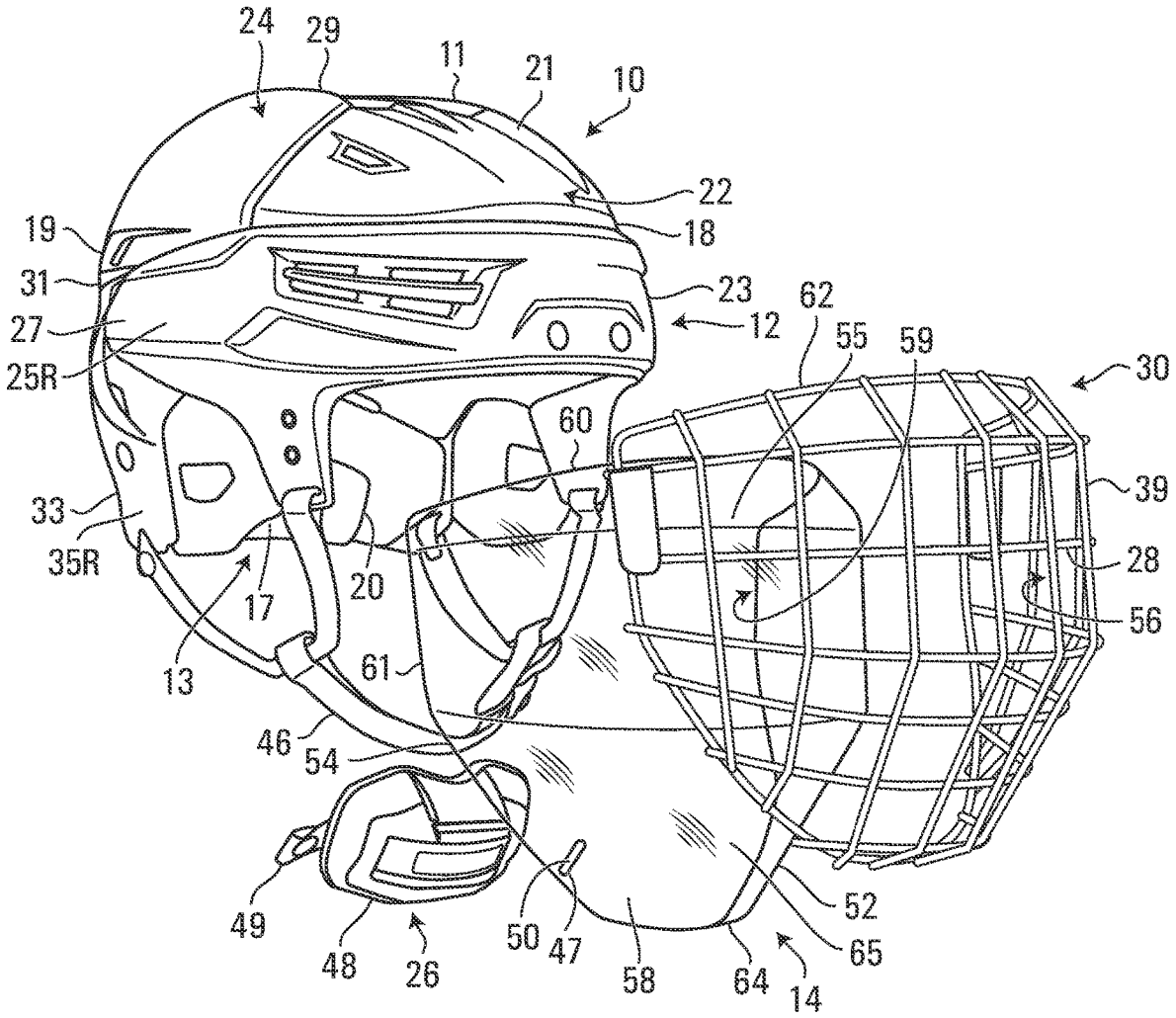

For example, in some embodiments, as shown in FIGS. 1 and 2, the biohazard blocker 14 may comprise a clear shield 52 configured to be positioned in front of, spaced from, and cover at least part the user's face and comprising clear material 54 that the user can see through. In this embodiment, the clear shield 52 is configured to conform to the grid 39.

In this example, the clear shield 52 is configured to fit within the grid 39 and comprises an outer surface 55 that is configured to conform to an inner side 56 of the grid 39. Also, in this example, the clear shield 52 is configured to connect to the chin member 26 and the grid 39. The connector 47 comprises openings 50 to receive the chin-cup strap 49 to secure the clear shield 52 to respective ones of the wires 28 of the grid 39 and retain the clear shield 52 between the grid 39 and the chin cup 48.

The clear shield 52 comprises a thin clear member 58 shaped to protect the user's face and including the clear material 54 allowing the user to see therethrough. In this embodiment, the thin clear member 58 is configured to extend in front of a central region and left and right lateral sides of the user's face, from a top of the user's face to a bottom of the user's face. In this example, the thin clear member 58 is curved between a left lateral side 59 of the clear shield 52 and a right lateral side 61 of the clear shield 52. Also, in this example, the thin clear member 58 is shaped to bend (e.g. curve and/or angularly deflect) towards the user's face towards a top of the thin clear member 58 and towards a bottom of the thin clear member 58. Thus, in this example, the thin clear member 58 is concave in a widthwise direction of the clear shield 52 and in a heightwise direction of the clear shield 52. In some cases, the left and right lateral sides 59, 61 of the clear shield 52 are configured to cover at least part of the user's left and right ears. In this embodiment, the thin clear member 58 is molded (e.g., vacuum formed or otherwise thermoformed) in a mold.

More particularly, in this embodiment, the clear shield 52 is configured to extend at least to the user's chin. In this example, the clear shield 52 is configured to extend below the user's chin. Also, in this embodiment, the clear shield 52 is configured to extend above the user's eyes. A top edge 60 of the clear shield 52 is configured to extend proximate to a top edge 62 of the grid 39. A bottom edge 64 of the clear shield 52 is configured to extend at least to, and in this example below the chin of the user.

The clear material 54 is transparent or otherwise allows the user to see clearly through it. For example, in this embodiment, the clear material 54 may comprise polyethylene terephthalate (PET). In other embodiments, the clear material 54 may comprise polycarbonate or any other suitable material. In some cases, the clear material 54 may be colorless. In other cases, the clear material 54 may be colored (e.g., tinted).

In this embodiment, the thin clear member 58 is antifogging. For example, in this embodiment, the thin clear member 58 comprises an antifogging layer 65, which may be coated or applied as a film on or any other antifogging treatment to the clear material 54. Any suitable antifogging agent (e.g., surfactant or other substances minimizing surface tension) may be used. In some examples of implementation, the clear material 54 of the thin clear member 58 may have antifogging properties.

Figure 3:
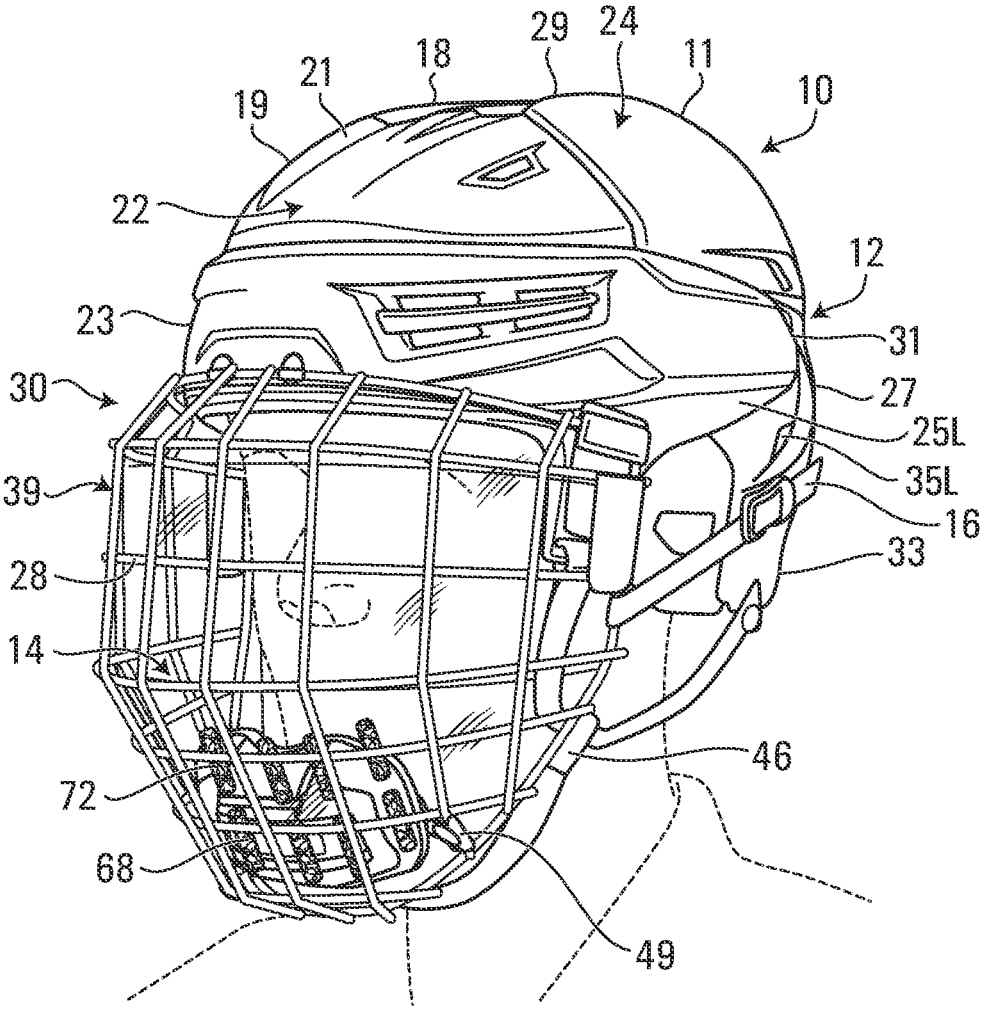
Figure 4:
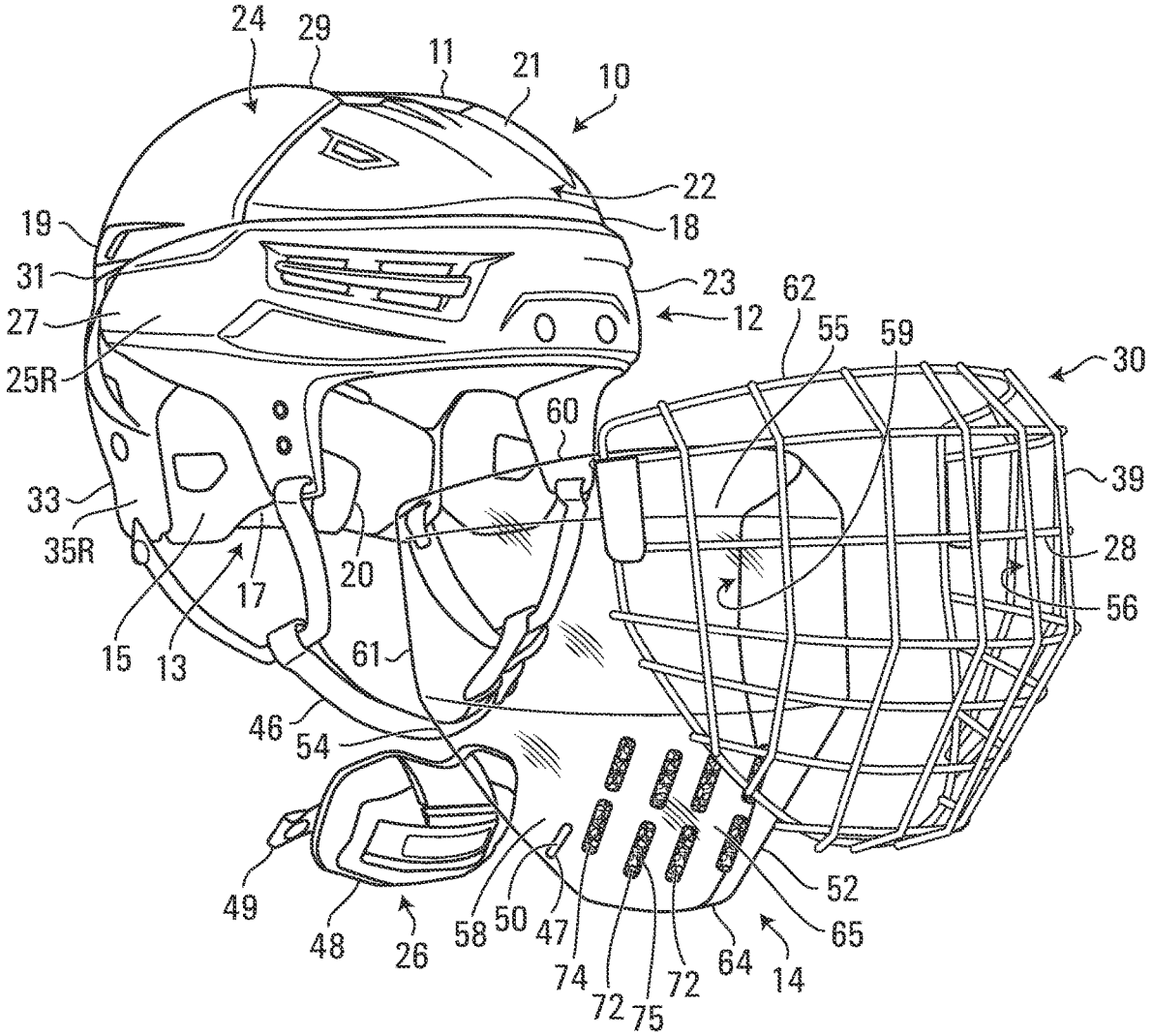

In some embodiments, as shown in FIGS. 3 and 4, the clear shield 52 comprises vents 68 for ventilation. In this embodiment, the vents 68 are disposed in a lower part of the clear shield 52 proximate the mouth region of the user, below a frontmost point of the clear shield 52.

More particularly, in this embodiment, each vent 68 comprises a vent opening 72 in the thin clear member 58. Also, in this embodiment, each vent 68 comprises a filter 74 in the vent opening 72. In this example, the filter 74 comprises fabric 75 to filter pathogens and provide air permeability. More particularly, in this example, the fabric 75 includes nonwoven fabric material. The nonwoven fabric material of the fabric 75 may comprise polypropylene, polystyrene, polyethylene, polyester, and/or other suitable polymers and be made using meltblown or other suitable technology. In other examples, the fabric 75 may include woven fabric material instead of or in addition to nonwoven fabric material. For instance, in some example, the fabric 75 may comprise a nonwoven fabric layer and a woven fabric layer. In this case, the fabric 75 may be washable so that the clear shield 52 is cleanable and reusable.

The filter 74 of each vent 68 may be affixed to the thin clear member 58 in any suitable way. For example, in some embodiments, the filter 74 may be adhesively bonded to the thin clear member 58, ultrasonically welded to the thin clear member 58, or otherwise affixed without sewing to the thin clear member 58. As another example, in some embodiments, the filter 74 may be retained by thermoforming or other molding (e.g., overmolding) of the clear material 54 about the filter 74.

Figure 5:
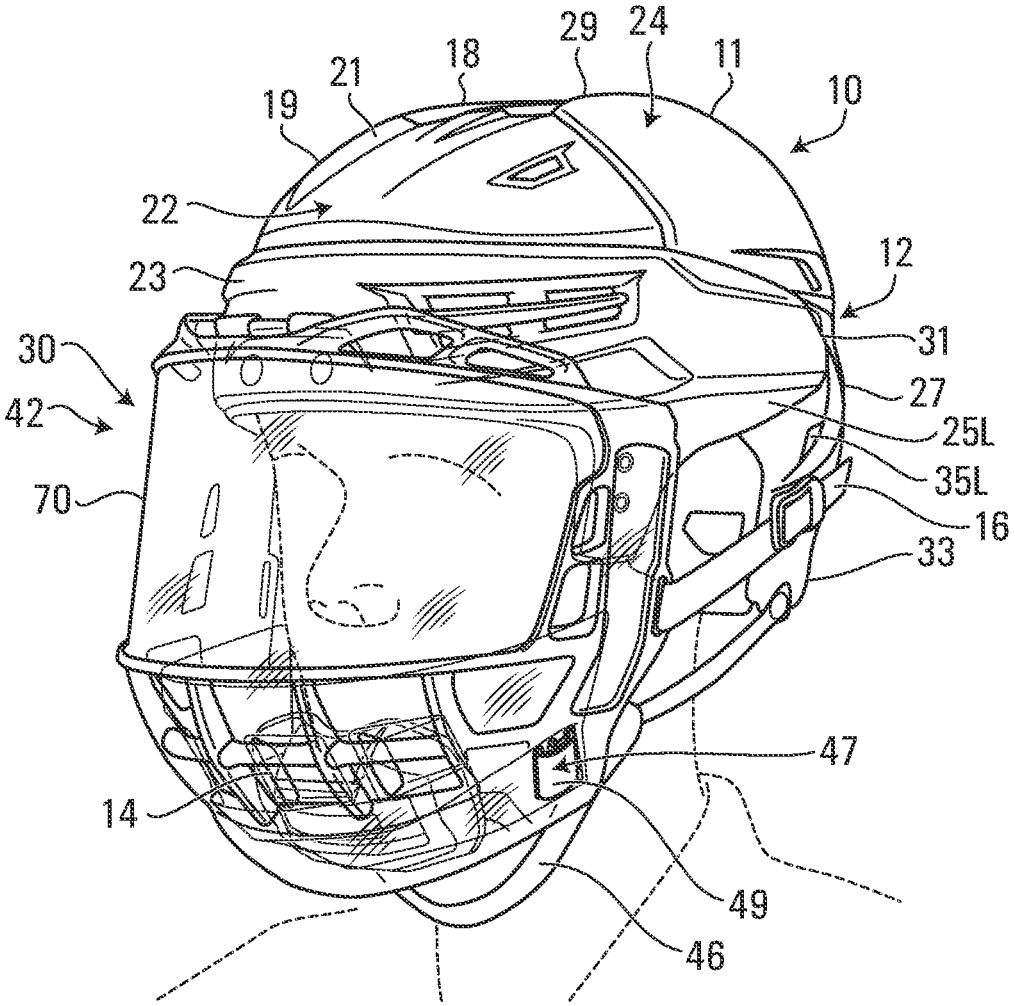
Figure 6:
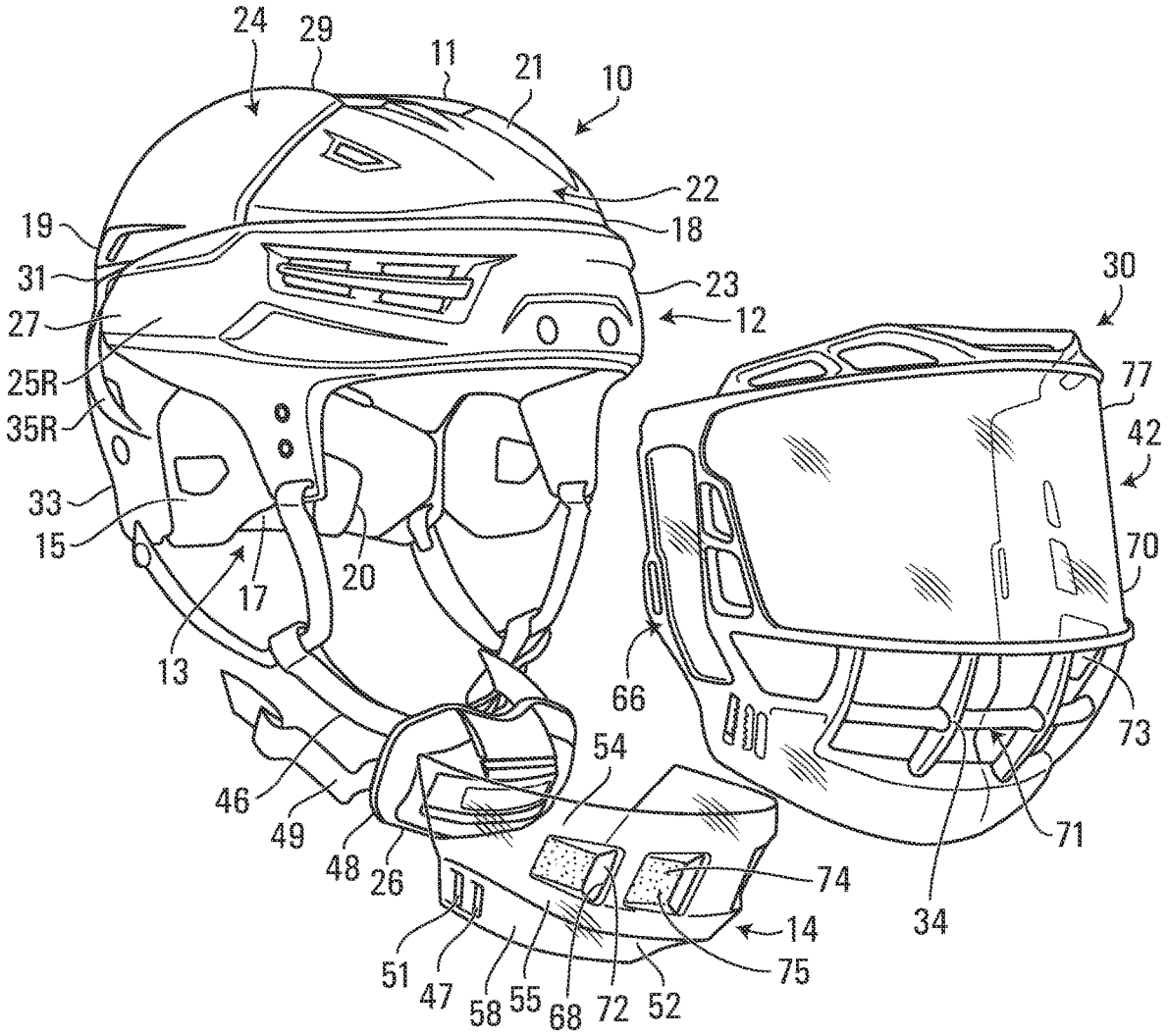

In some embodiments, as shown in FIGS. 5 and 6, the clear shield 52 is configured to conform to the visor 42. In this example, the clear shield 52 is configured to fit within the visor 42 such that its outer surface 55 is configured to conform to an inner side 66 of the visor 42. Also, in this example, the clear shield 52 is configured to connect to the chin member 26 and the visor 42. The connector 47 comprises openings 51 to receive the chin-cup strap 49 to secure the clear shield 52 to the visor 42 and retain the clear shield 52 between the visor 42 and the chin cup 48.

Figure 35:
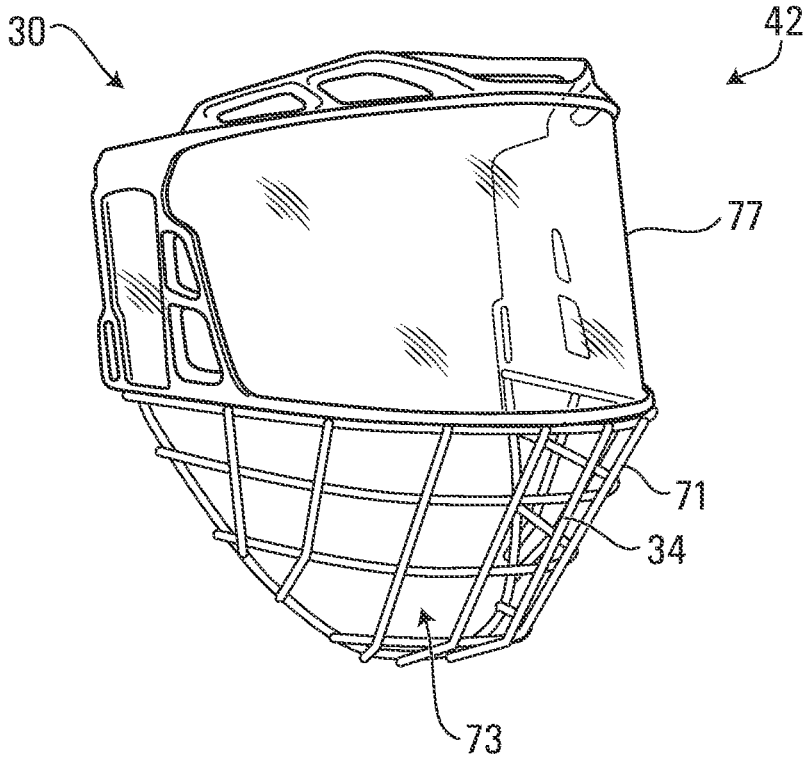
FIG. 35 shows another embodiment of the faceguard.

In this embodiment, the visor 42 comprises a lens 77 and a grid 71 disposed below the lens 77 and comprising vent openings 73, and made of the clear material 70, while the clear shield 52 is configured to overlie the grid 71, including the vent openings 73, of the visor 42. The grid 71 of the visor 42 includes a plurality of elongate members 34 (e.g., bars, wires, etc.) intersecting one another and defining the vent openings 73 therebetween. In this example, the grid 71 of the visor 42 is made of the clear material 70, like the lens 77. In other examples, as shown in FIG. 35, the elongate members 34 of the grid 71 of the visor 42 may be metallic (e.g., made of steel, titanium and/or other suitable metal), and connected to one another by welding, by integrally forming (e.g., casting, additively-manufacturing, etc.) them together, and/or by any other means.

More particularly, in this embodiment, the thin clear member 58 is configured to extend in front of the central region and the left and right lateral sides of the user's face, from an intermediate region of the user's face to the bottom of the user's face. The thin clear member 58 is configured to terminate without overlying at least a majority (i.e., a majority or an entirety) of the lens 77. In this example, the thin clear member 58 is curved between the left lateral side 59 of the clear shield 52 and the right lateral side 61 of the clear shield 52. In this embodiment, the thin clear member 58 is molded (e.g., vacuum formed or otherwise thermoformed).

In this example, the clear shield 52 is thinner than the lens 77 of the visor 42. Also, in this example, the clear material 54 of the clear shield 52 may be different (e.g., less rigid) than the clear material 70 of the visor 42.

Figure 45:
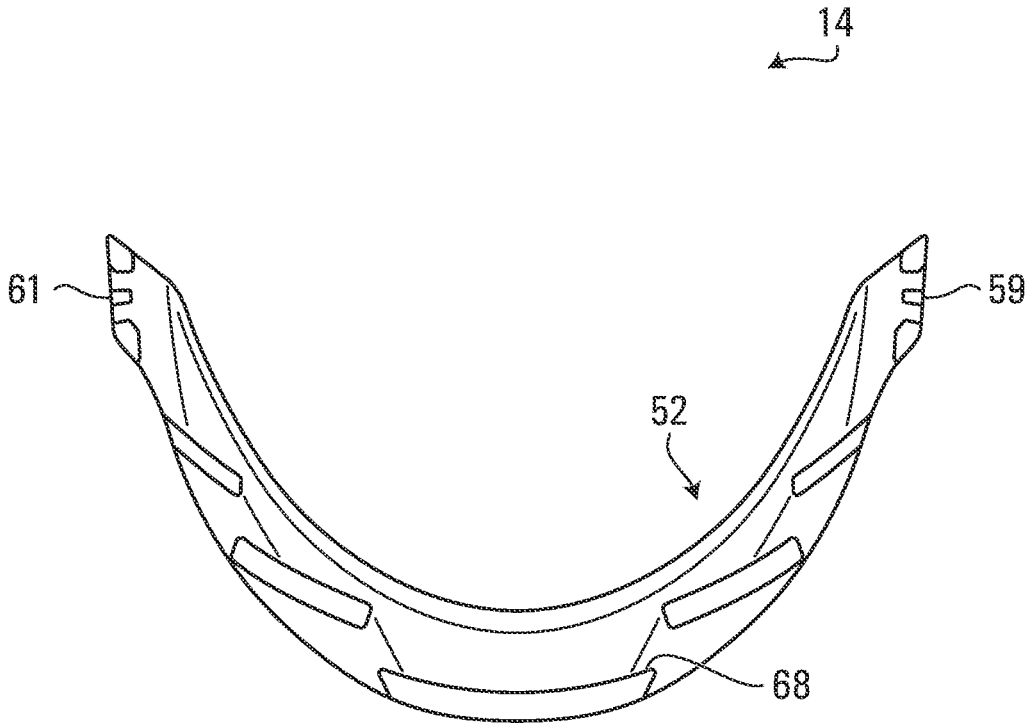
FIG. 45 is a top view of the clear shield of FIG. 44.
Figure 46:
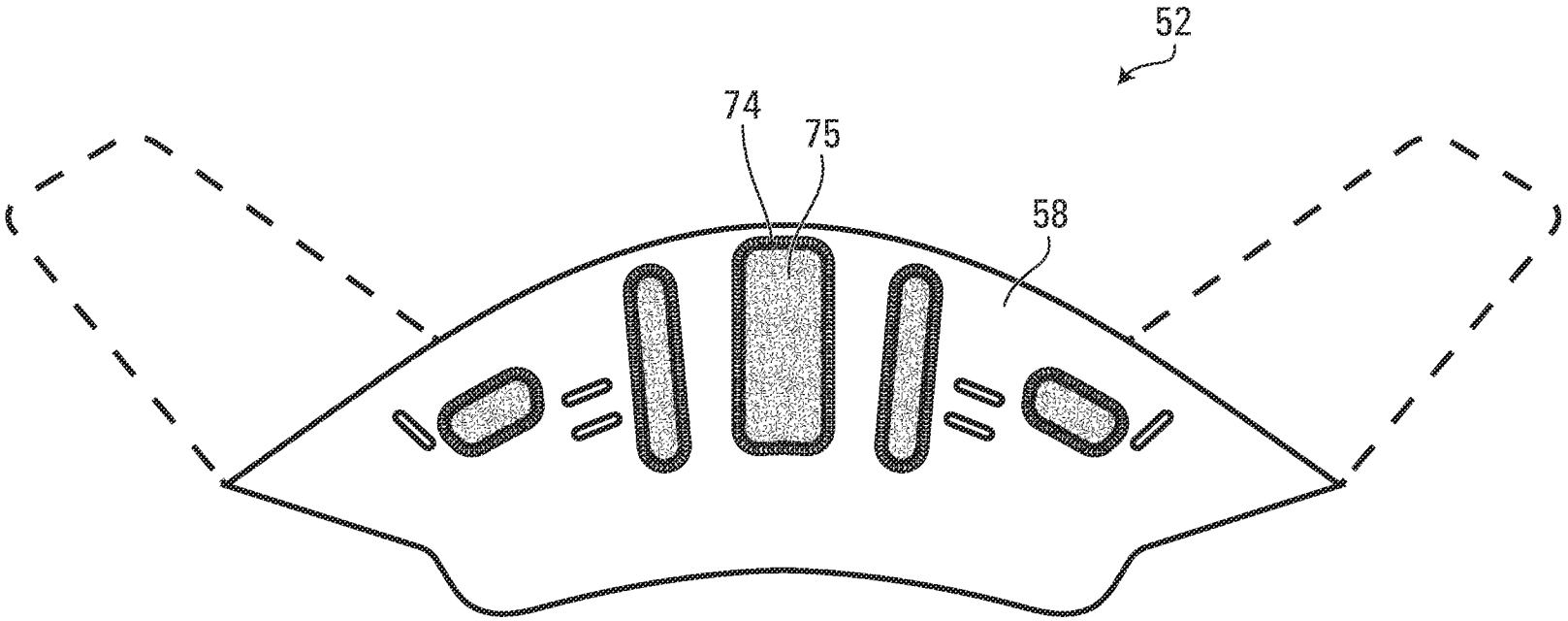
FIG. 46 is a flat pattern of the clear shield of FIG. 44.
Figure 47A:
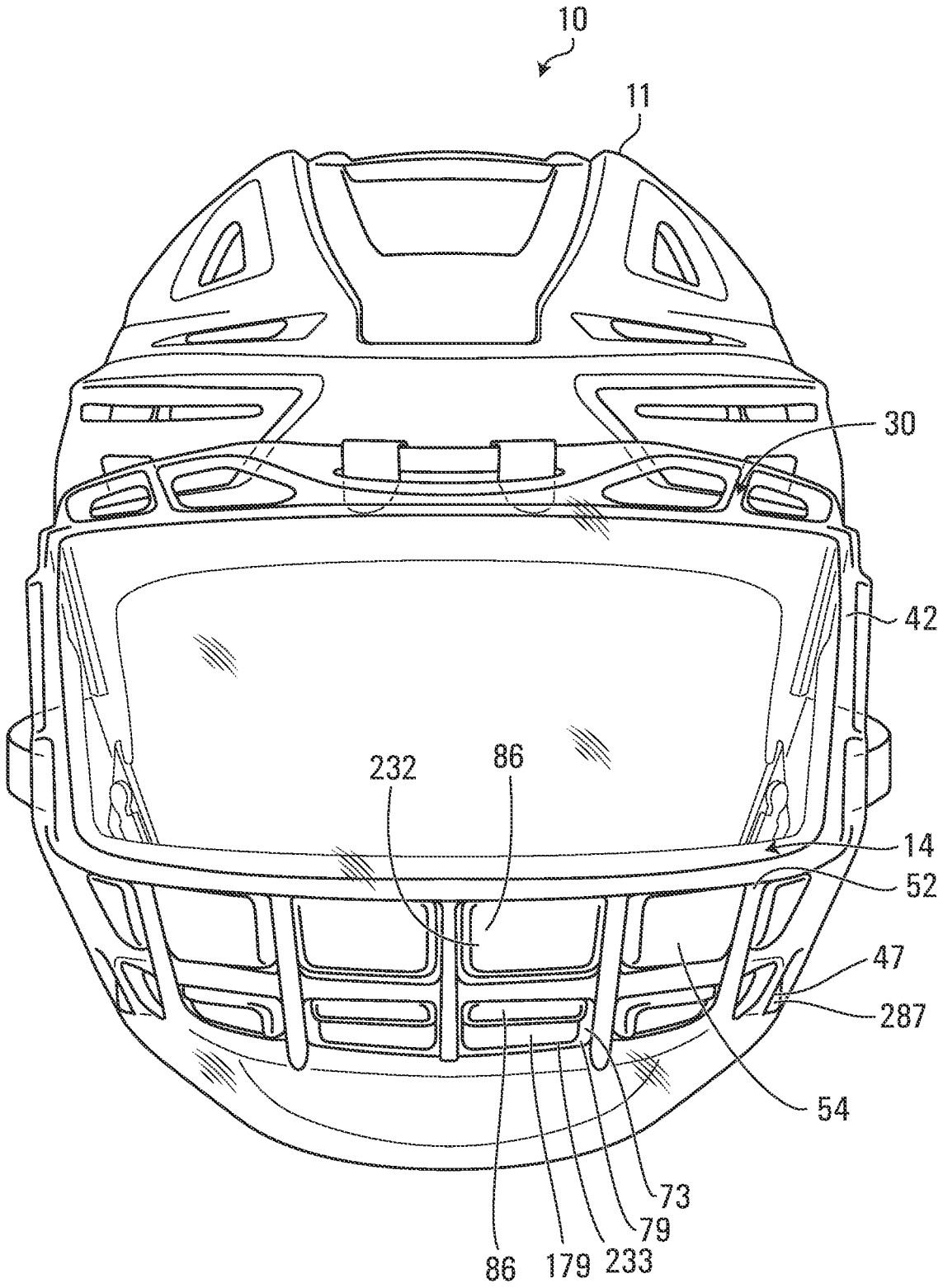
FIGS. 47A to 47D show an embodiment in which the clear shield is interlocked with the faceguard.
Figure 47B:
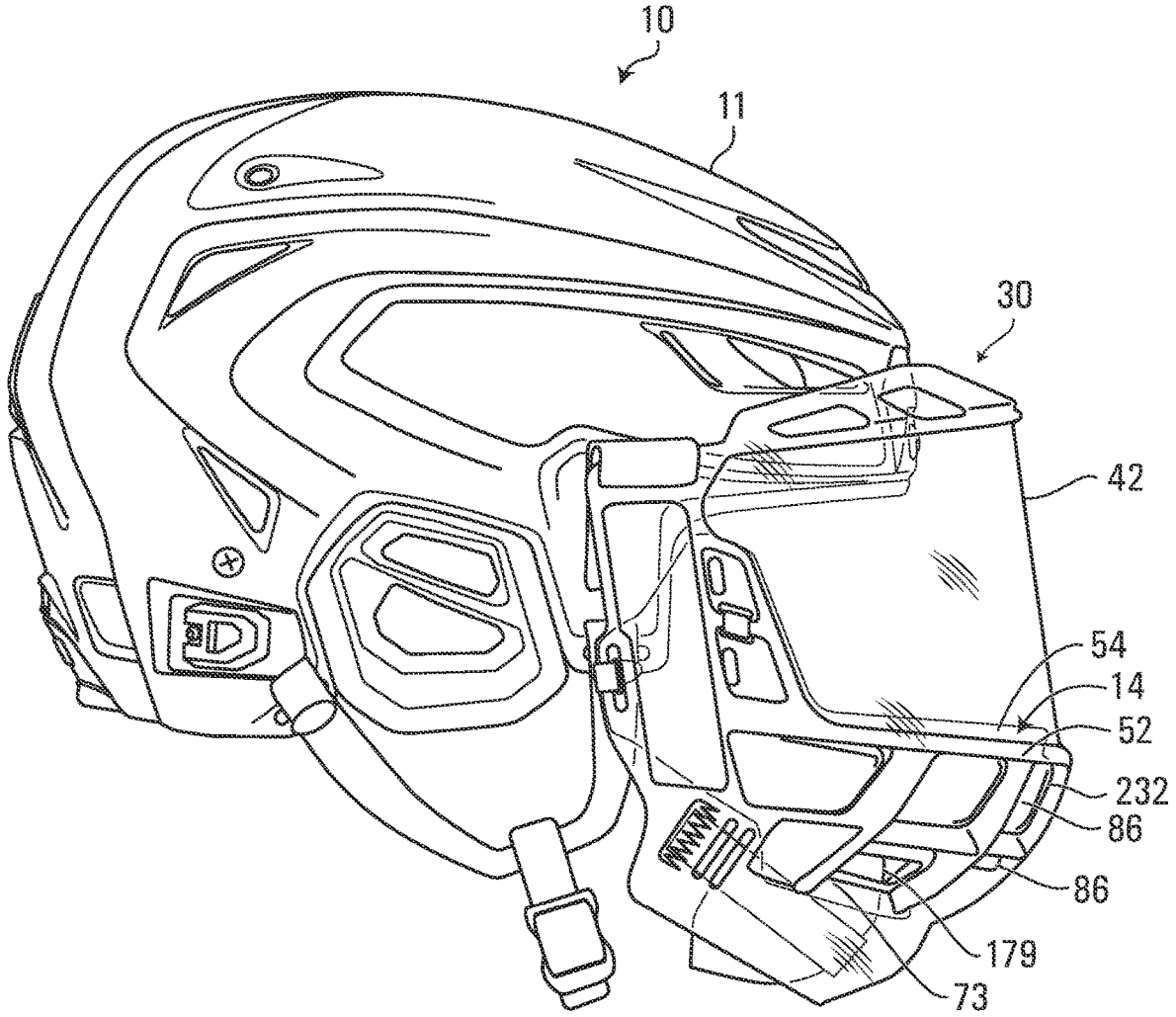
Figure 47C:
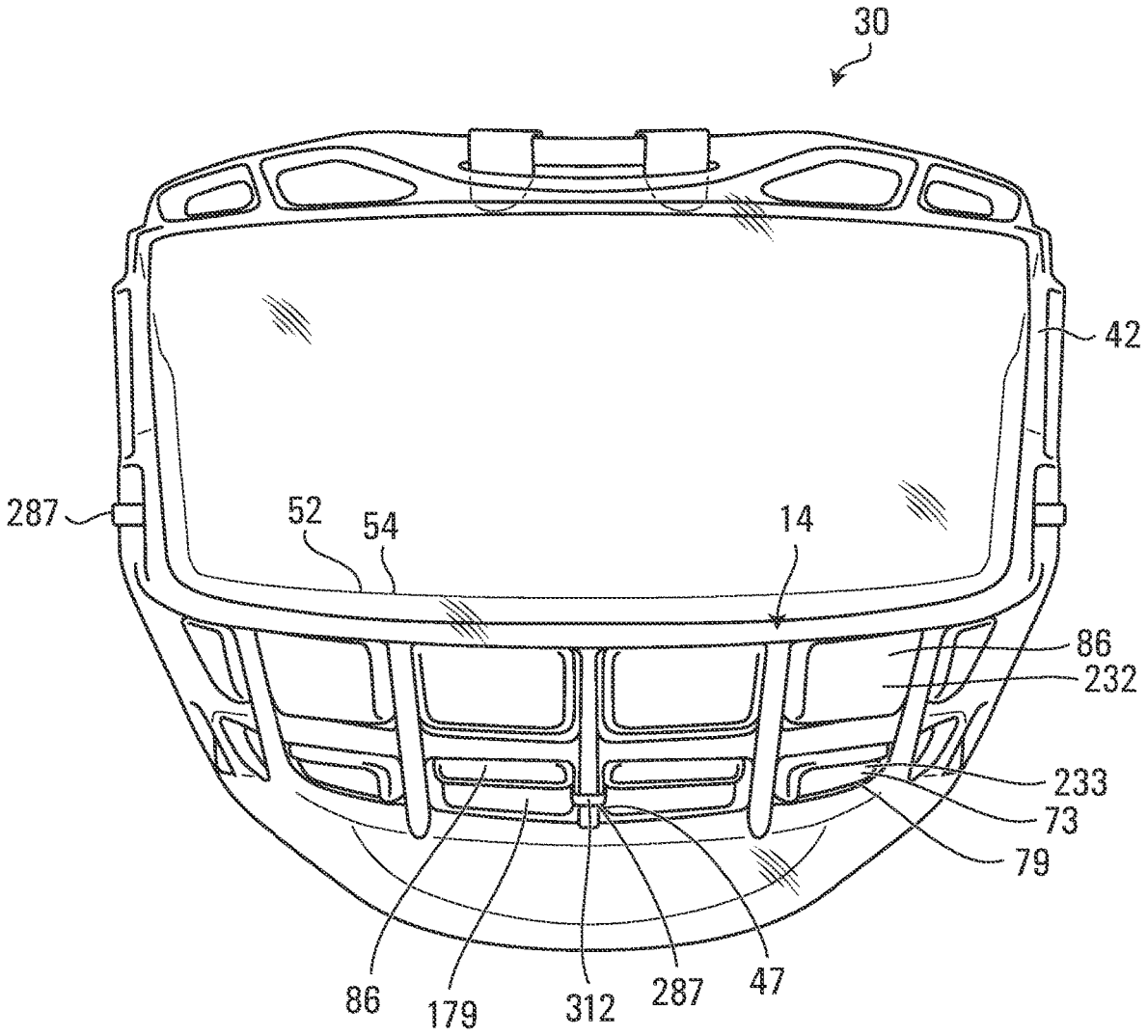
Figure 47D:
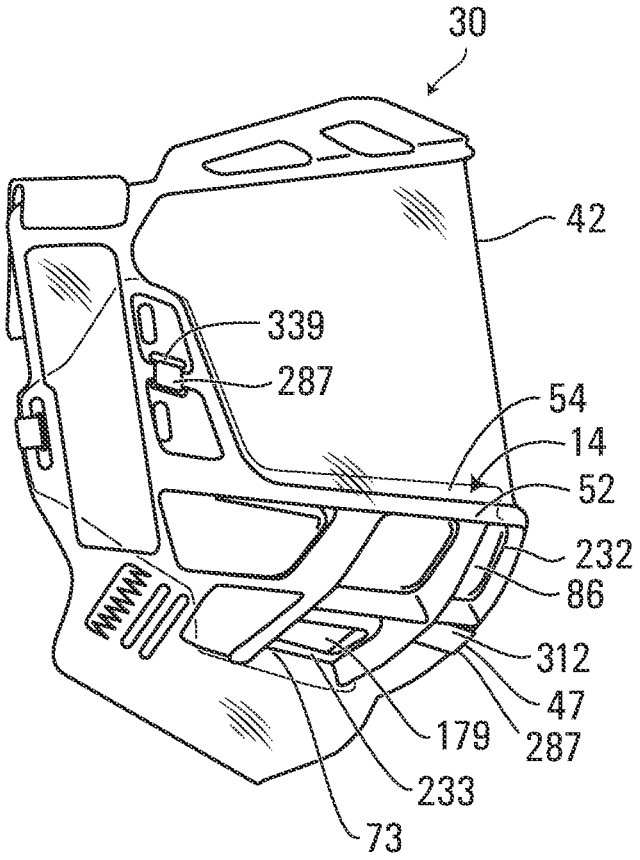
Figure 47E:
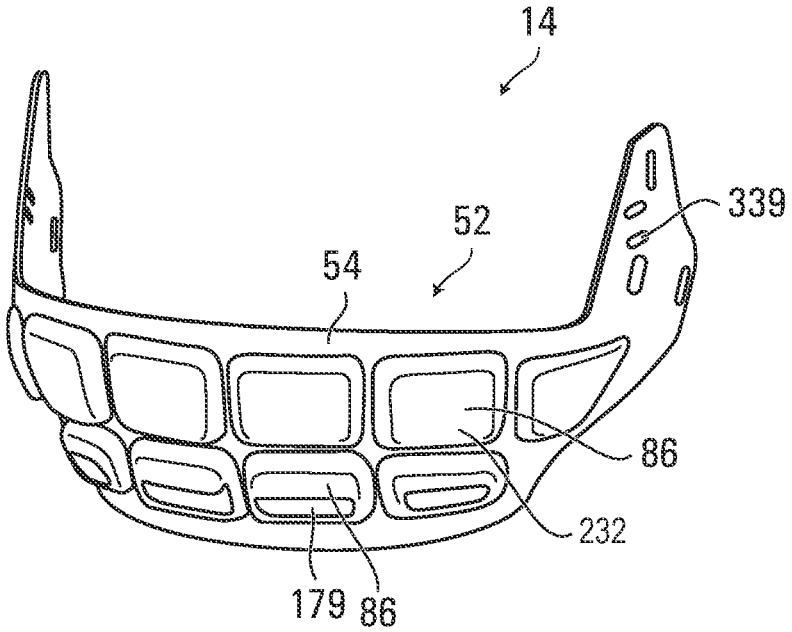
FIG. 47E is a perspective view of the clear shield of FIGS. 47A to 47D.
Figure 47F:
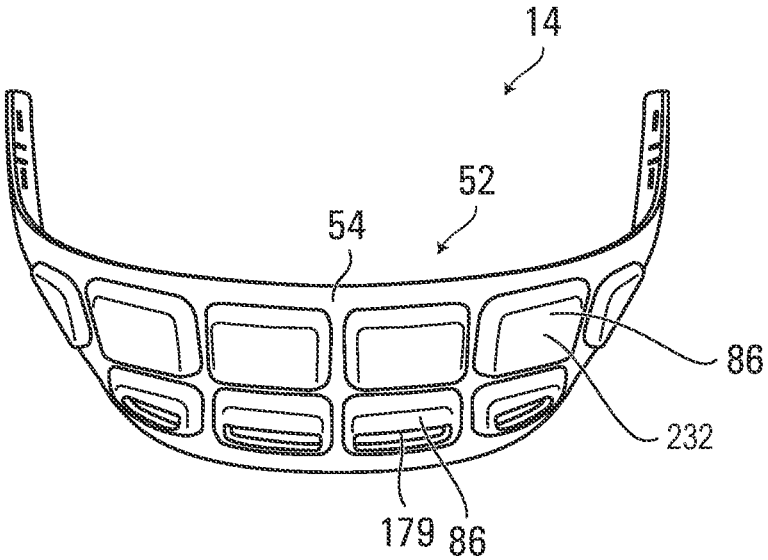
FIG. 47F is a front view of the clear shield of FIGS. 47A to 47D.
Figure 47G:
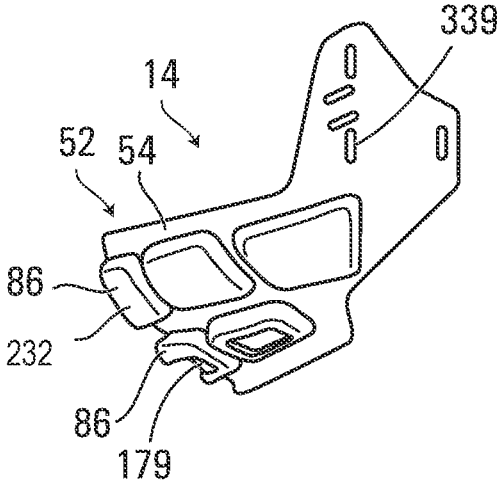
FIG. 47G is a side view of the clear shield of FIGS. 47A to 47D.
Figure 47H:
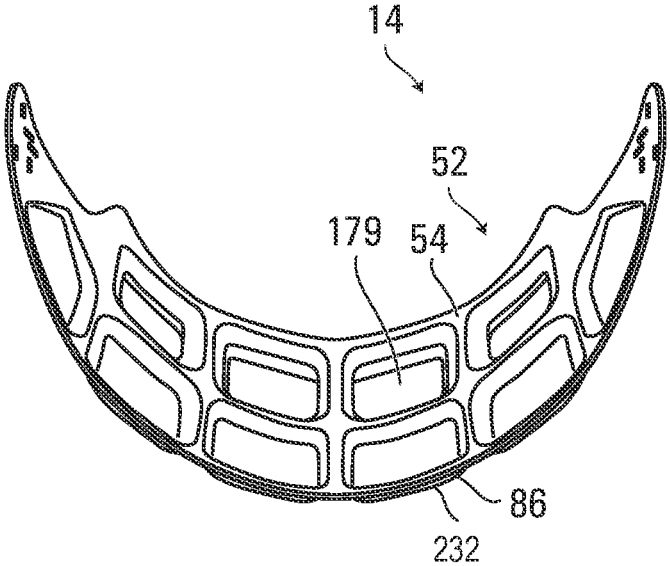
FIG. 47I shows an embodiment of a fastener fastening the clear shield of FIGS. 47A to 47H to the faceguard.
Figure 47I:
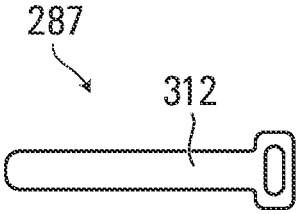
Figure 48:
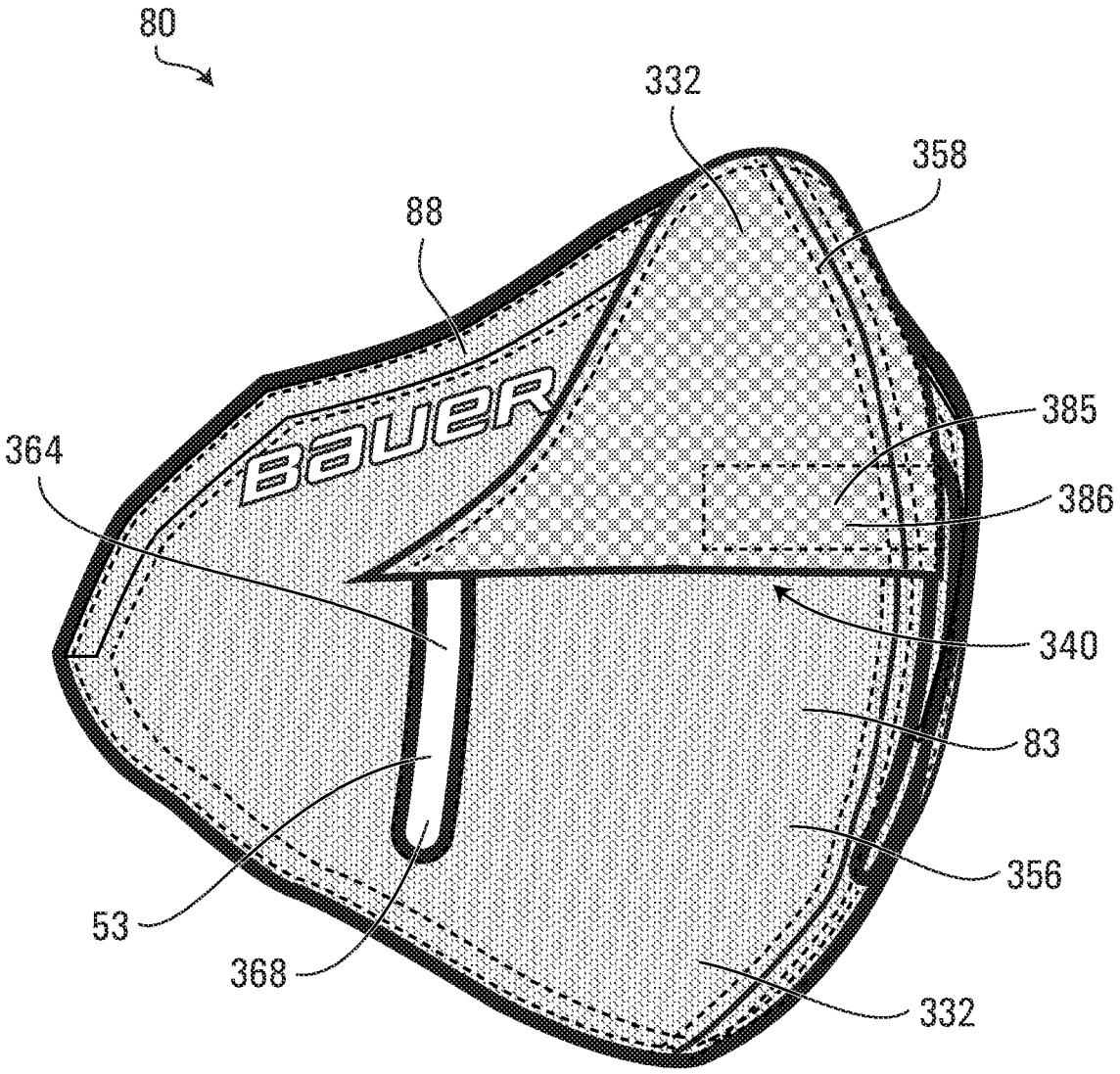
FIG. 48 shows another embodiment of the mask comprising a variant of the hydration opening.
Figure 49:
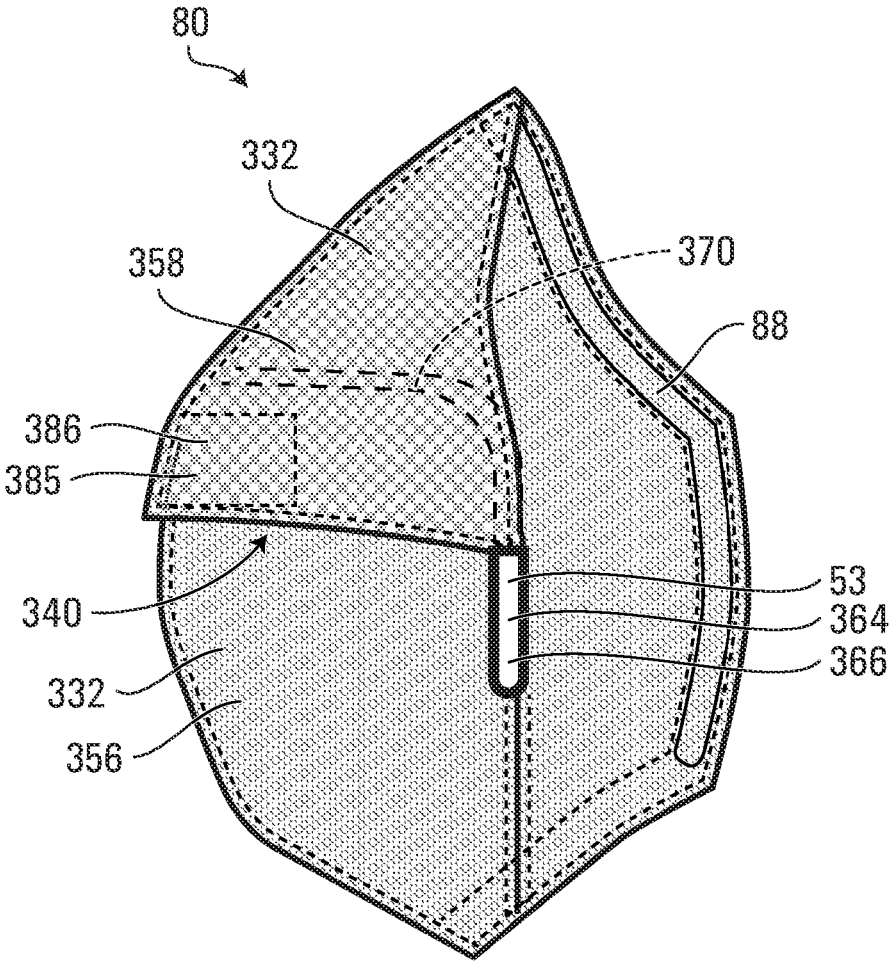
FIG. 49 is a side view of the mask of FIG. 48.
Figure 50:
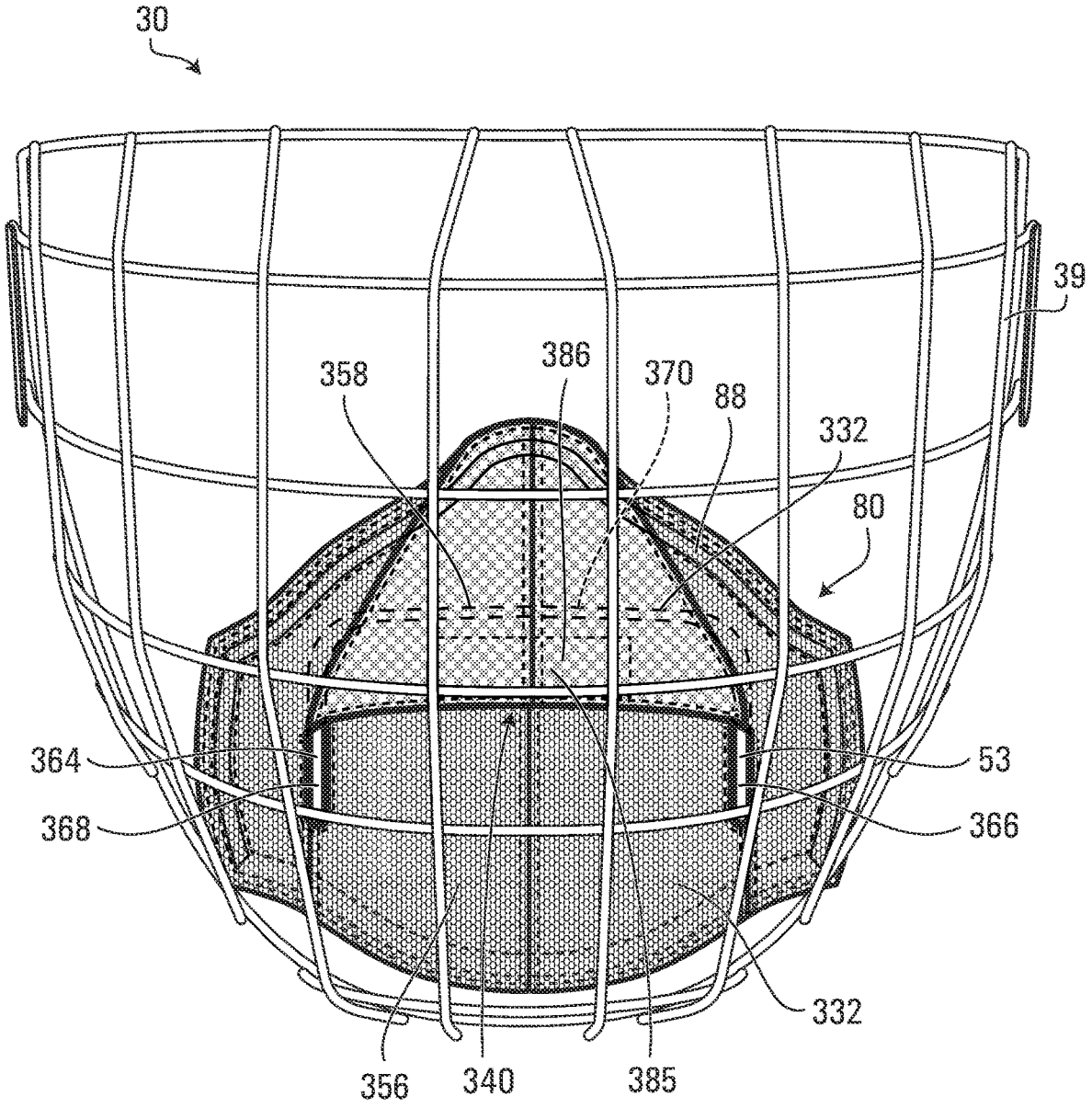
FIGS. 50 and 51 show examples of the mask of FIG. 48 mounted adjacent to the faceguard.
Figure 51:
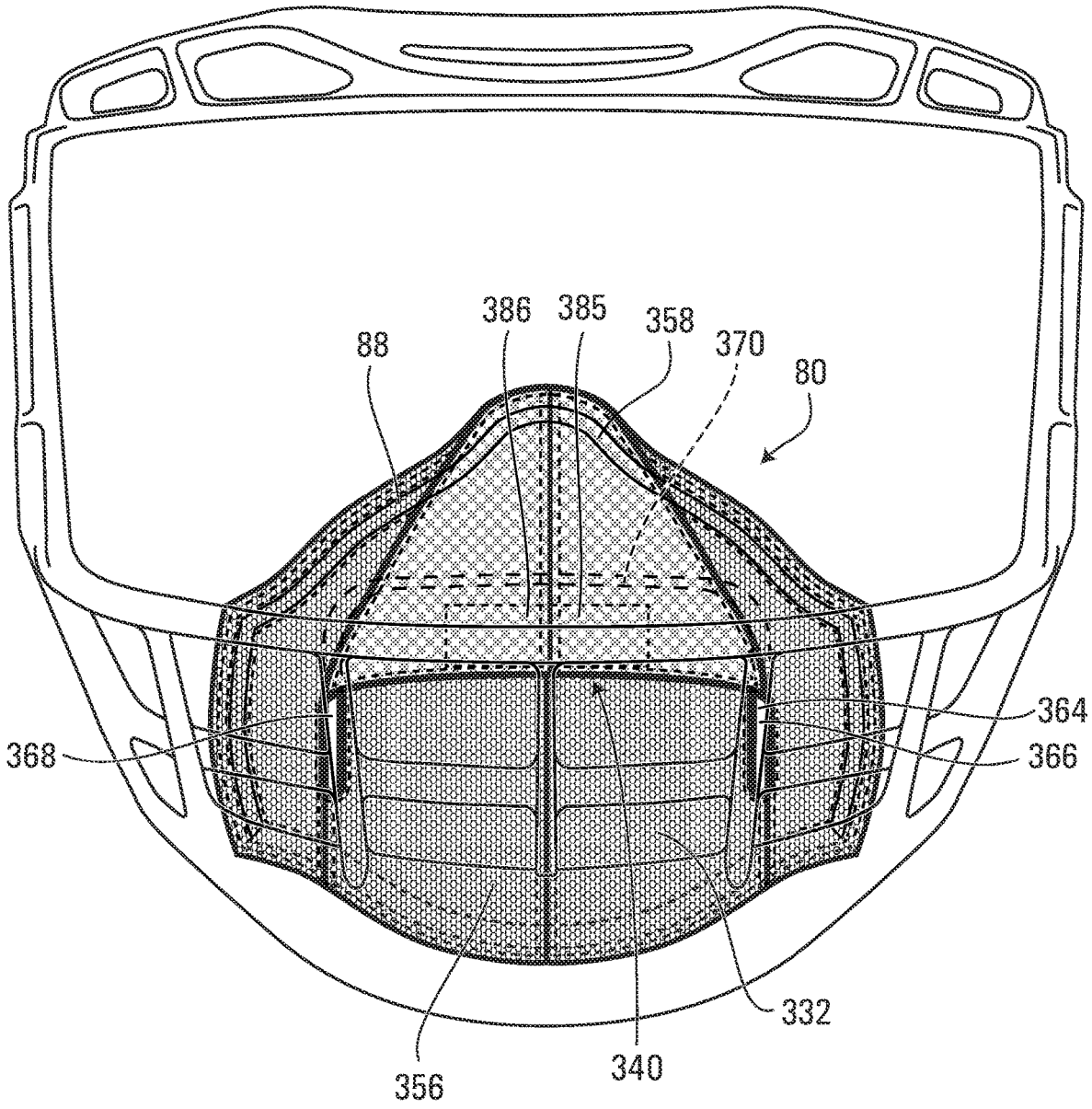
Figure 52:
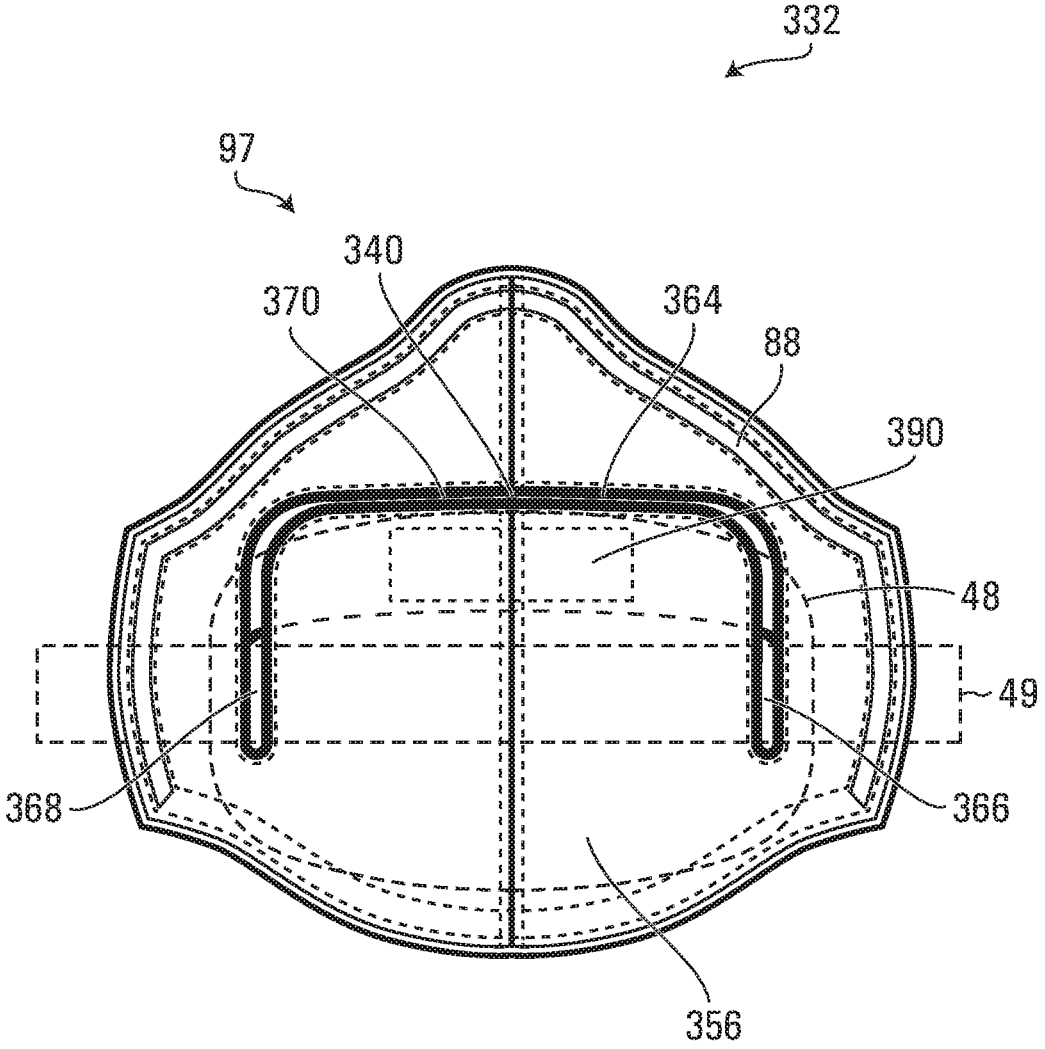
FIG. 52 shows an inner layer of the mask of FIG. 49.
Figure 53:
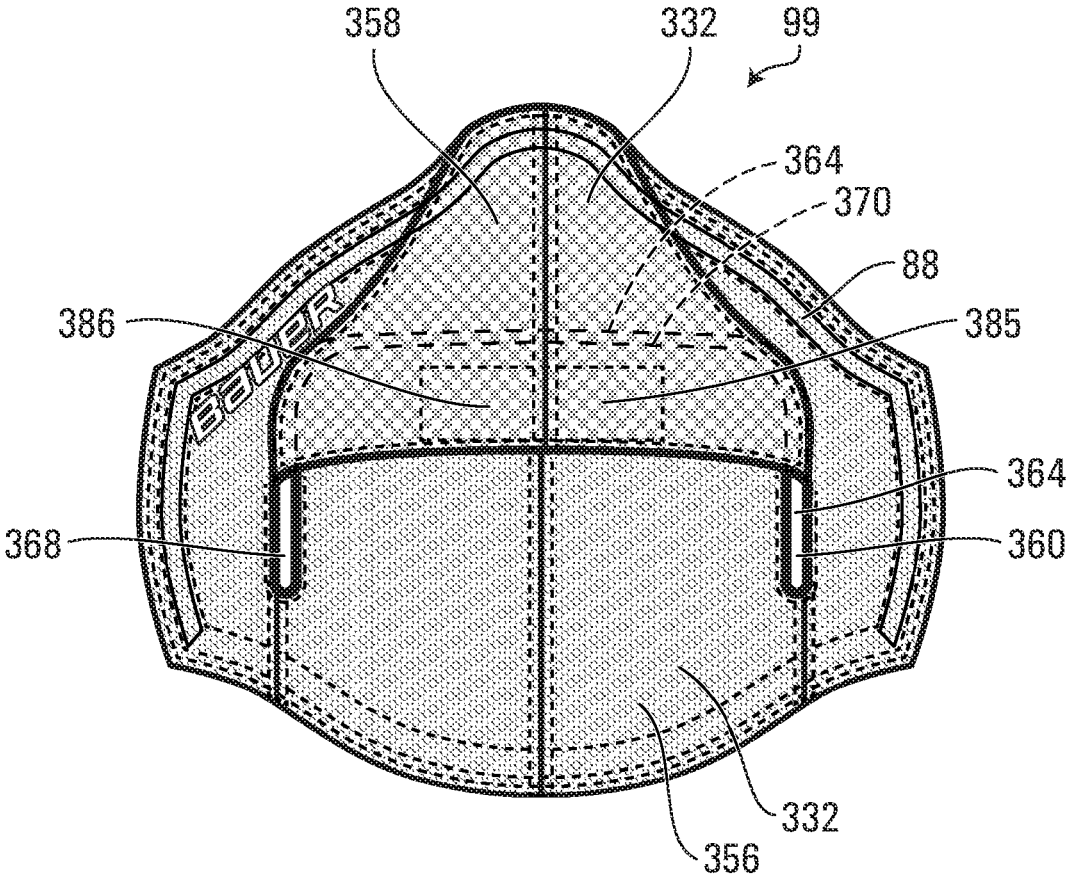
FIG. 53 shows an outer layer of the mask of FIG. 49.
Figure 54:
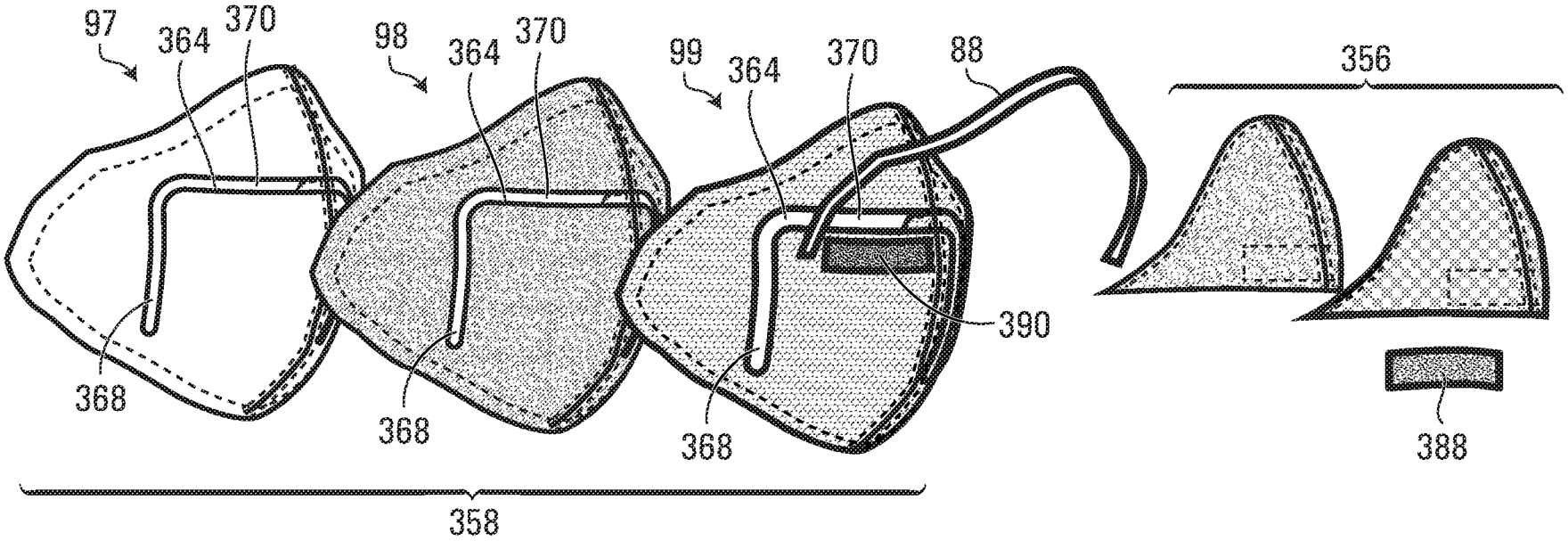
FIG. 54 is an exploded perspective view of the mask of FIG. 48.
Figure 55:
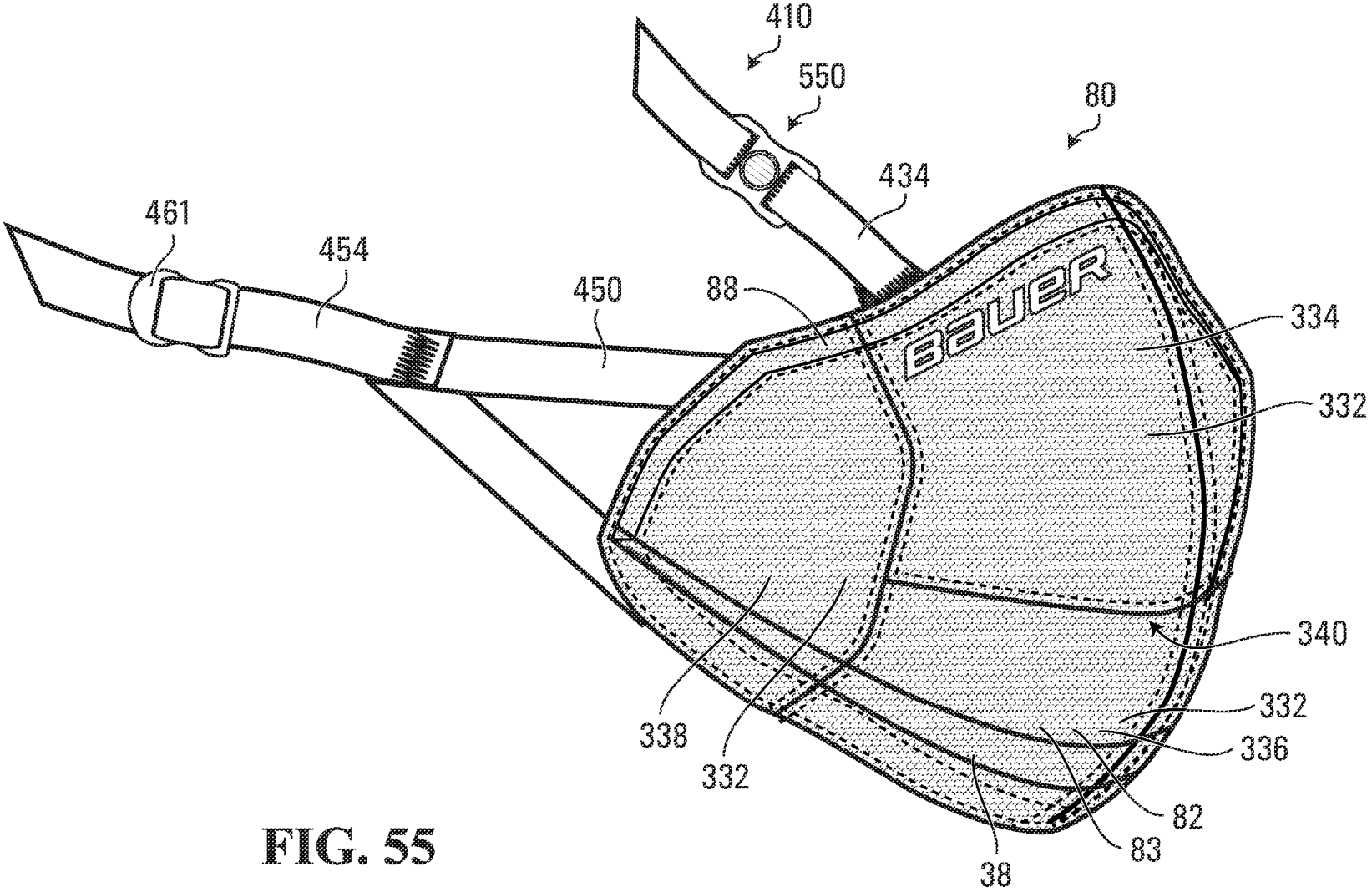
FIG. 55 shows an embodiment of the mask comprising a strap system for fastening the mask to the outer shell of the helmet.
Figure 56:
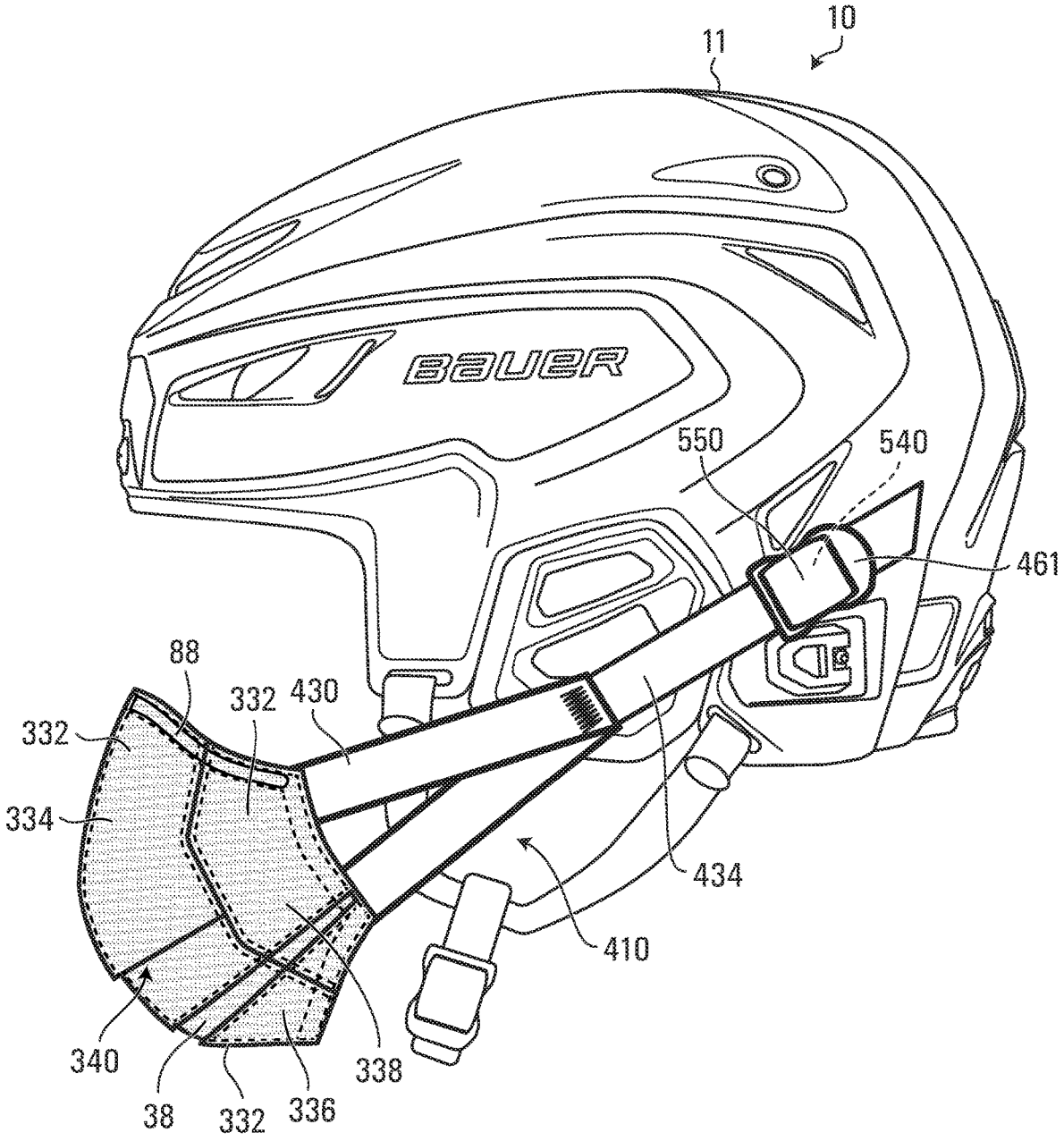
FIG. 56 shows the mask of FIG. 55 fastened to the helmet.
Figure 57:
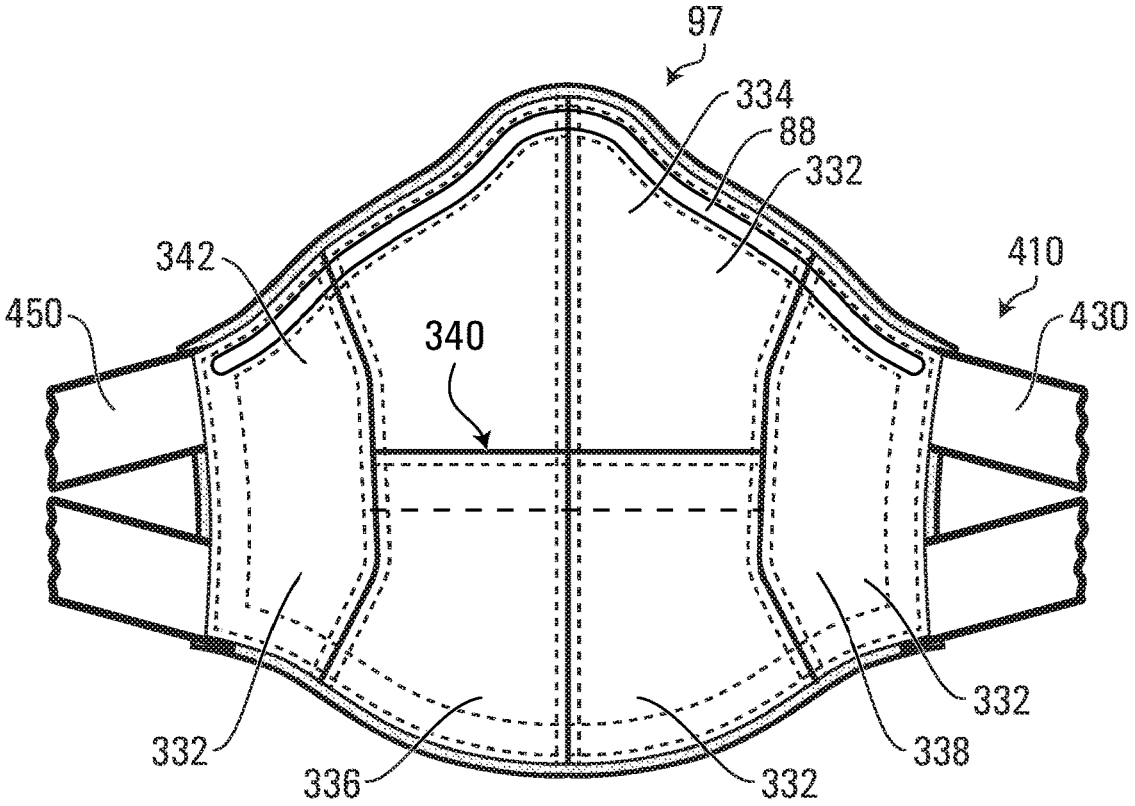
FIG. 57 shows the inner layer of the mask of FIG. 55.
Figure 58:
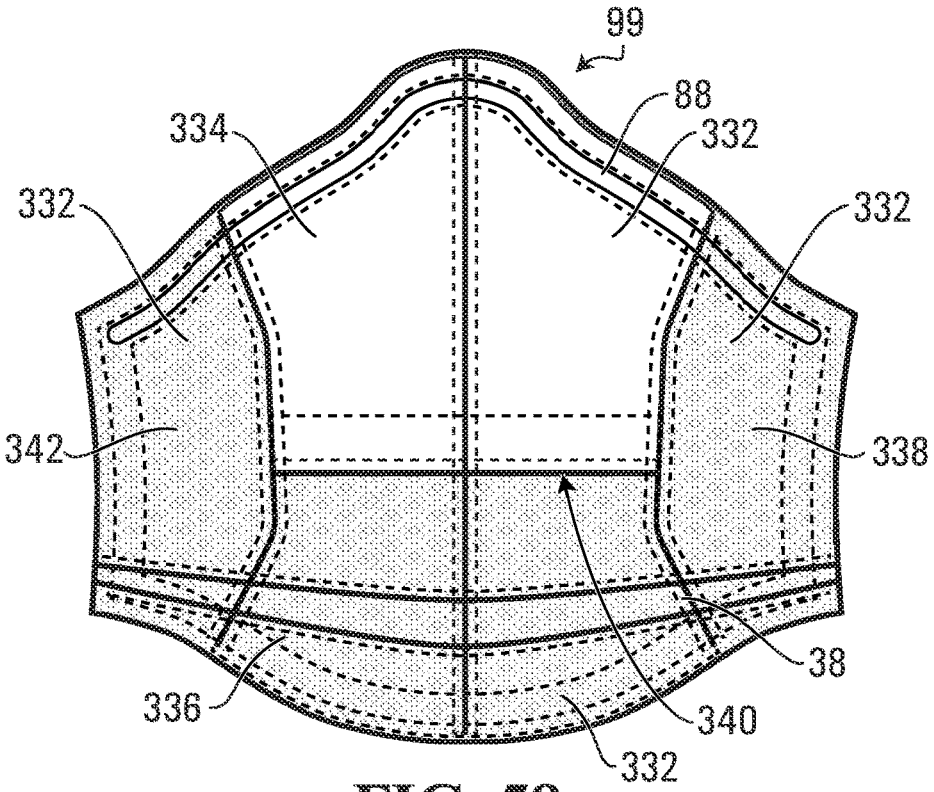
FIG. 58 shows the outer layer of the mask of FIG. 55.
Figure 59:
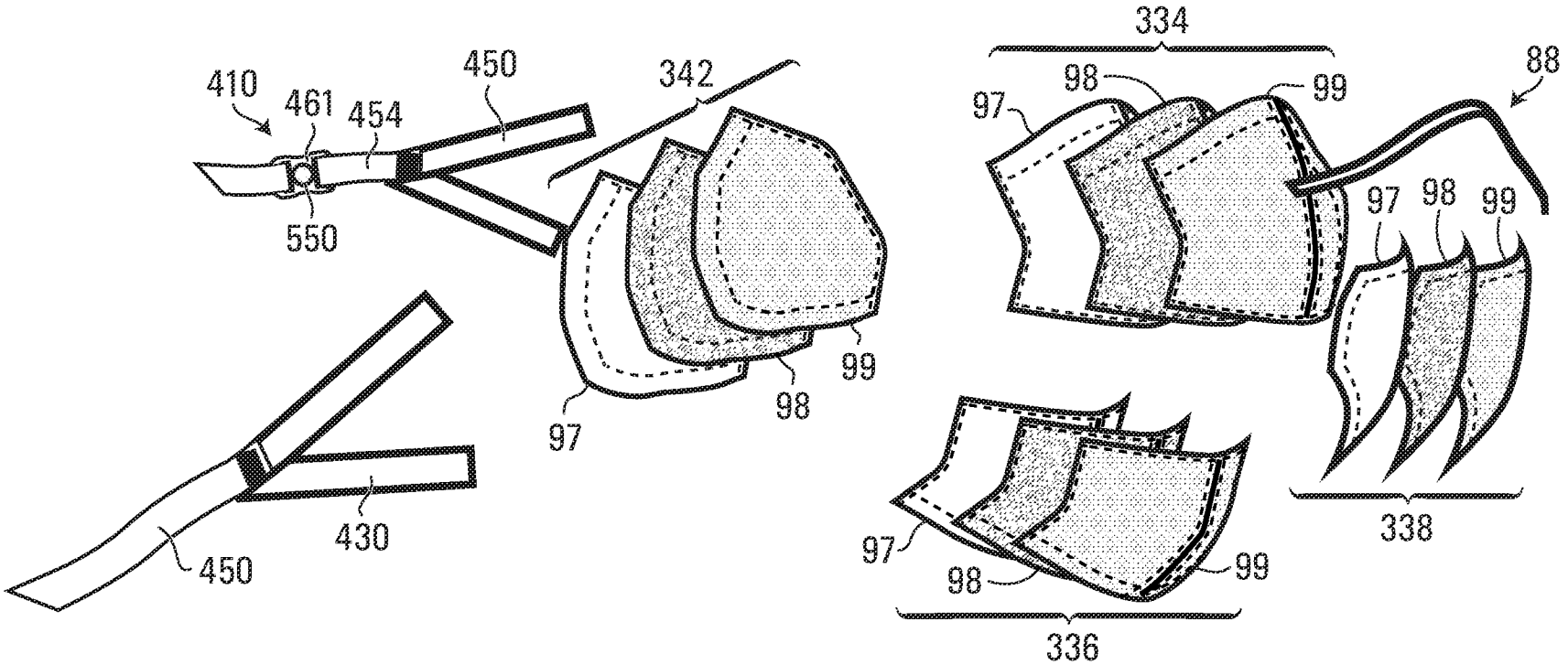
FIG. 59 is an exploded perspective view of the mask of FIG. 55.
Figure 60:
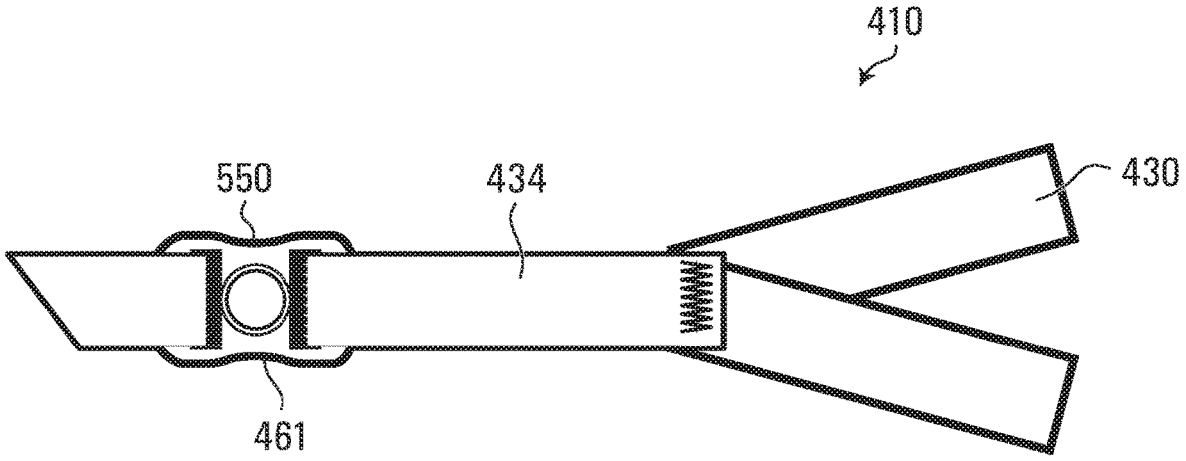
FIG. 60 shows part of the strap system of the mask of FIG. 55.
Figure 61:
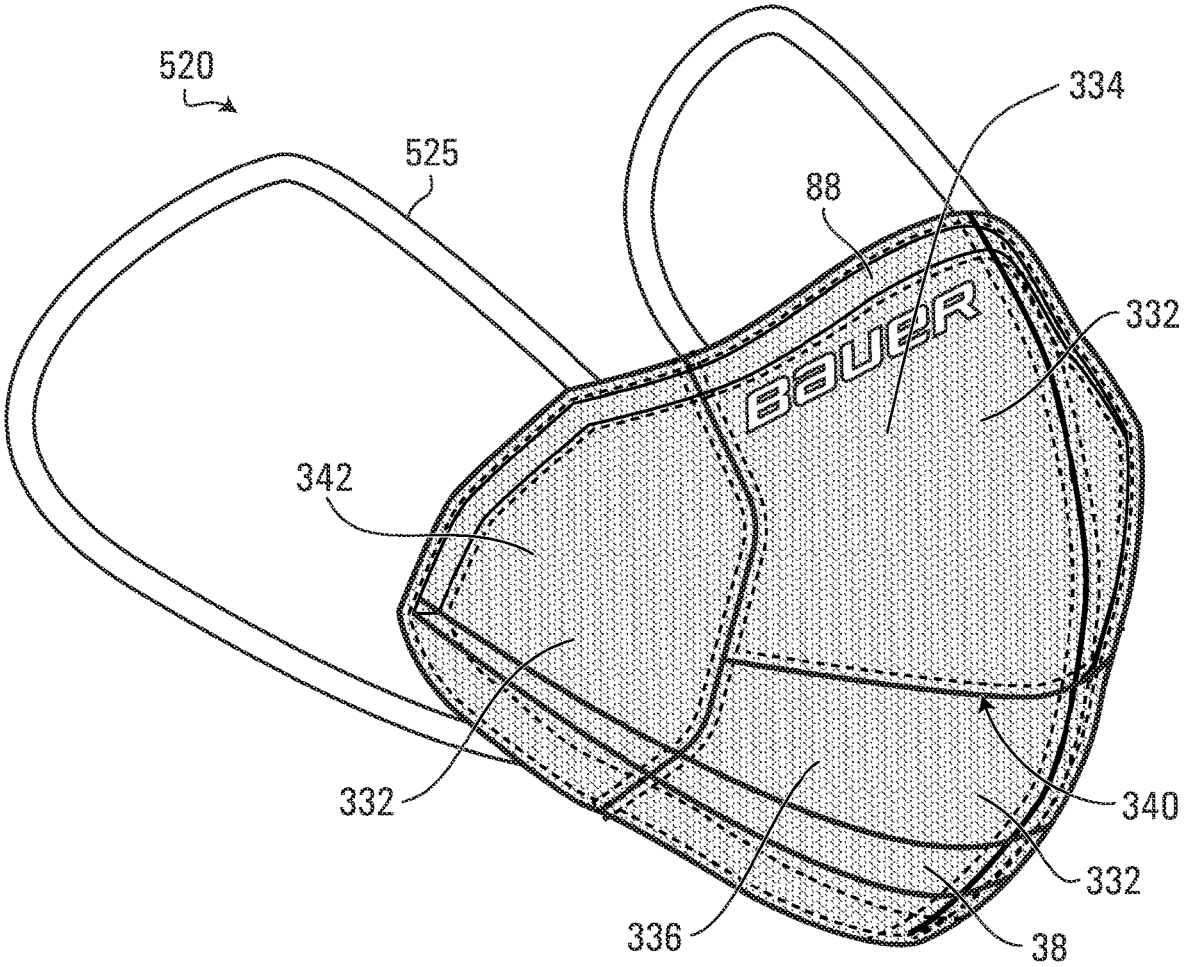
FIG. 61 shows another embodiment of the mask comprising a strap system for retaining the mask on the user's head.
Figure 62:
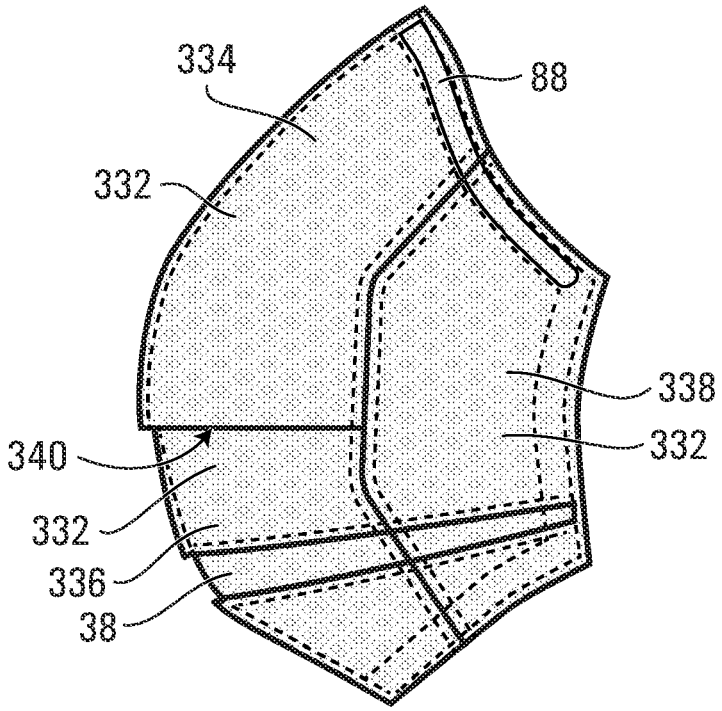
FIG. 62 is a side view of the mask of FIG. 61.
Figure 63:
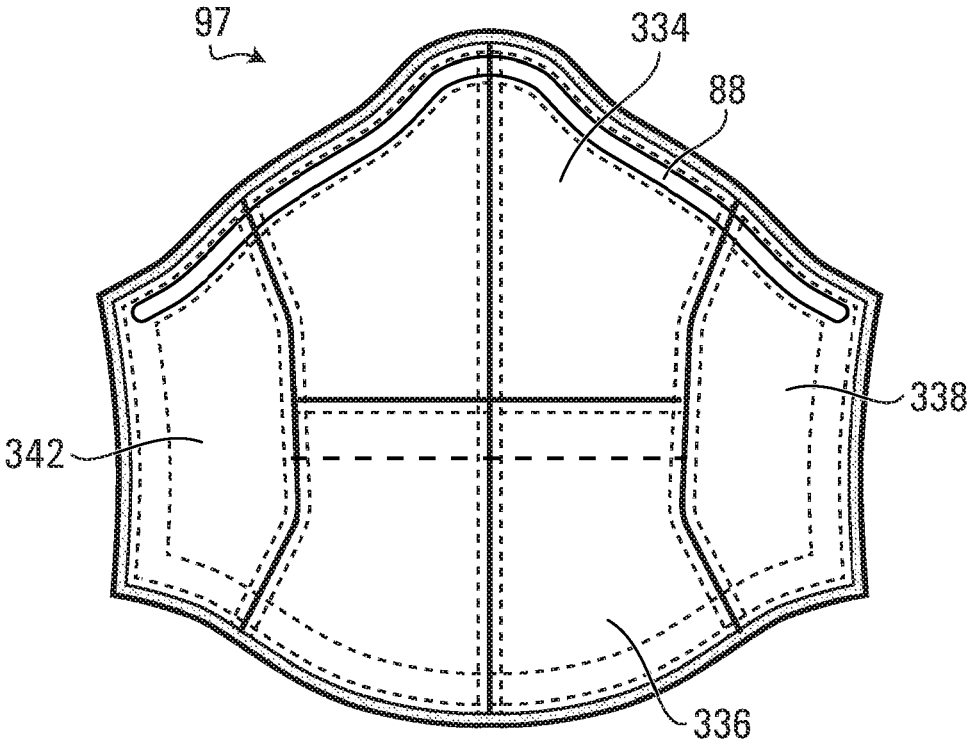
FIG. 63 shows the inner layer of the mask of FIG. 61.
Figure 64:
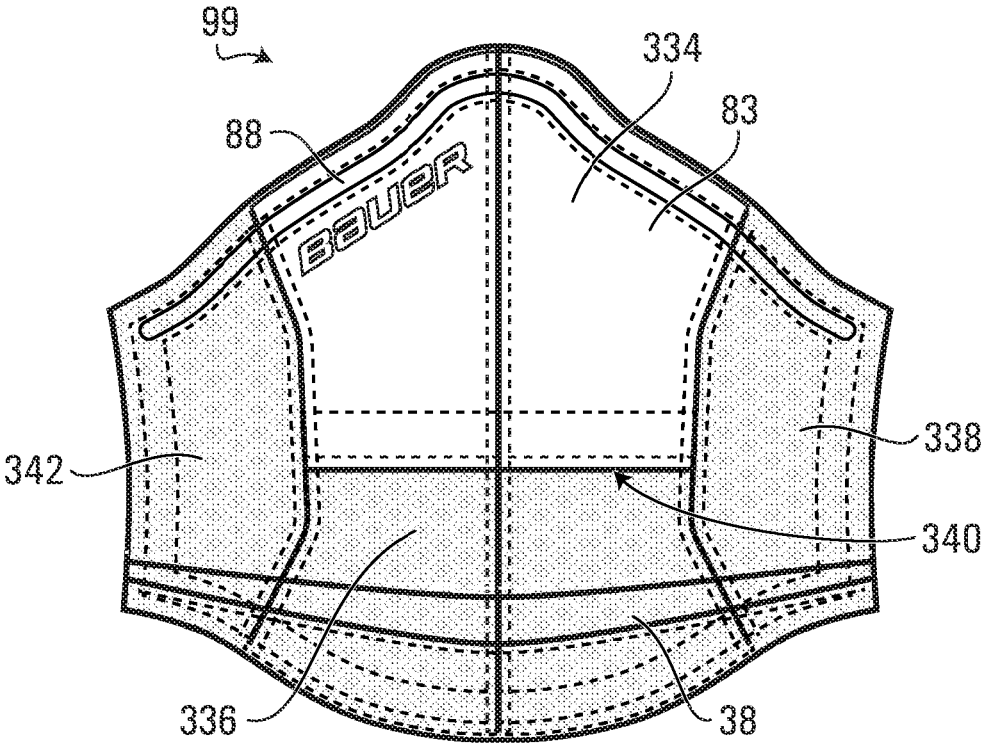
FIG. 64 shows the outer layer of the mask of FIG. 61.
Figure 65:
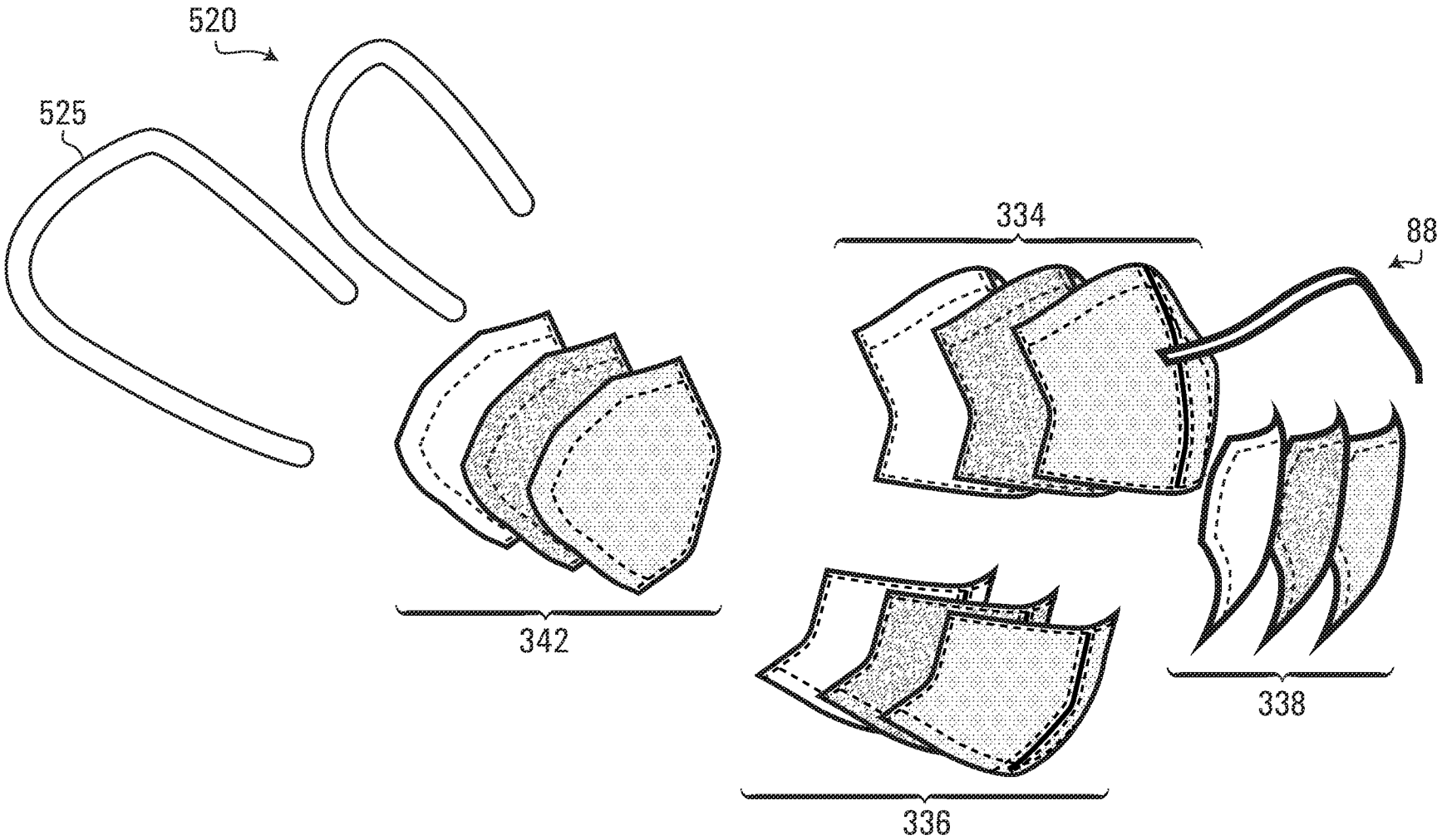
FIG. 65 is an exploded perspective view of the mask of FIG. 61.

In this embodiment, the clear shield 52 comprises the vents 68 for ventilation. The vents 68 of the clear shield 52 are disposed to overlap with or otherwise be adjacent to the vent openings 73 of the visor 42. In this embodiment, each vent 68 comprises the vent opening 72 in the thin clear member 58 and the filter 74 in the vent opening 72. In this case, the filter 74 comprises the fabric 75 to filter pathogens and provide air permeability. Also, in this embodiment, as shown in FIG. 45, the vents 68 are configured to direct airflow laterally (i.e., towards the left and right sides 59, 61 of the clear shield 52) through the clear shield 52. This may help to impede travel of contaminants to or from the user.

Figure 7:
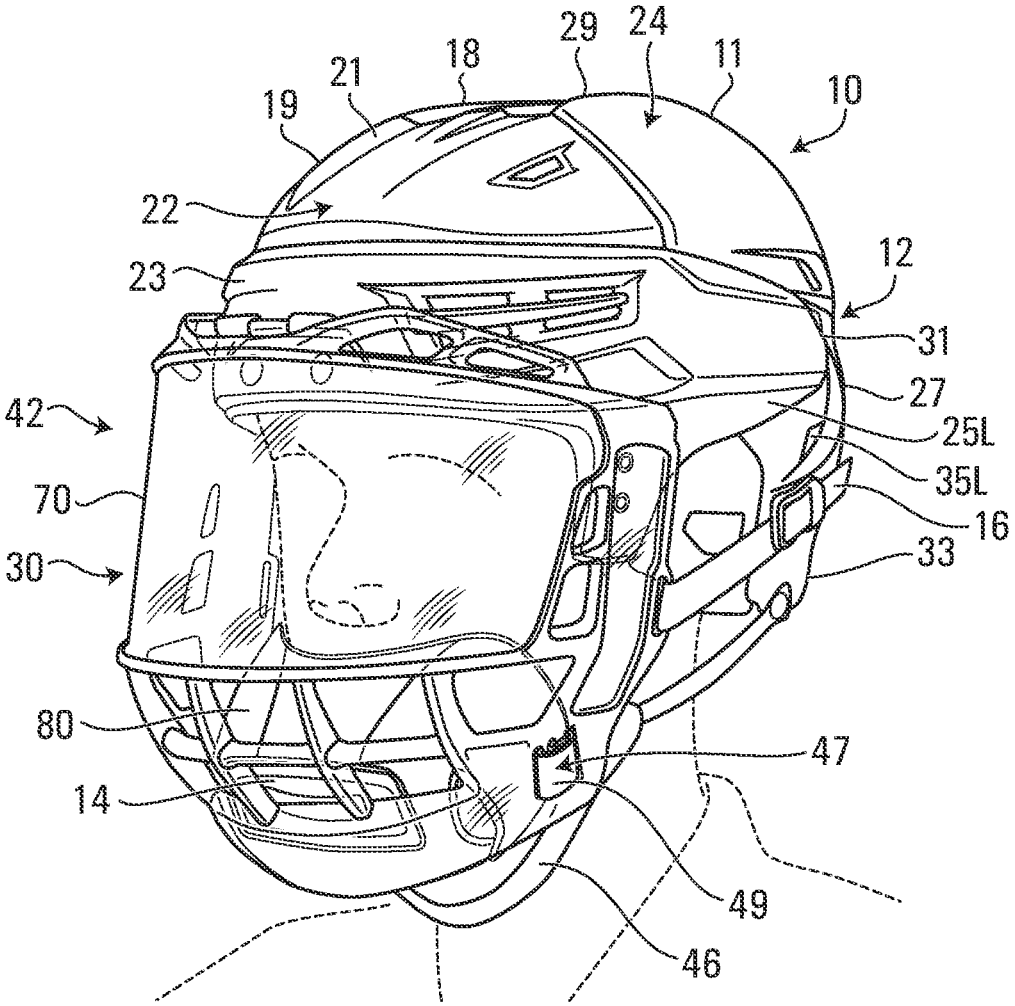
Figure 8:
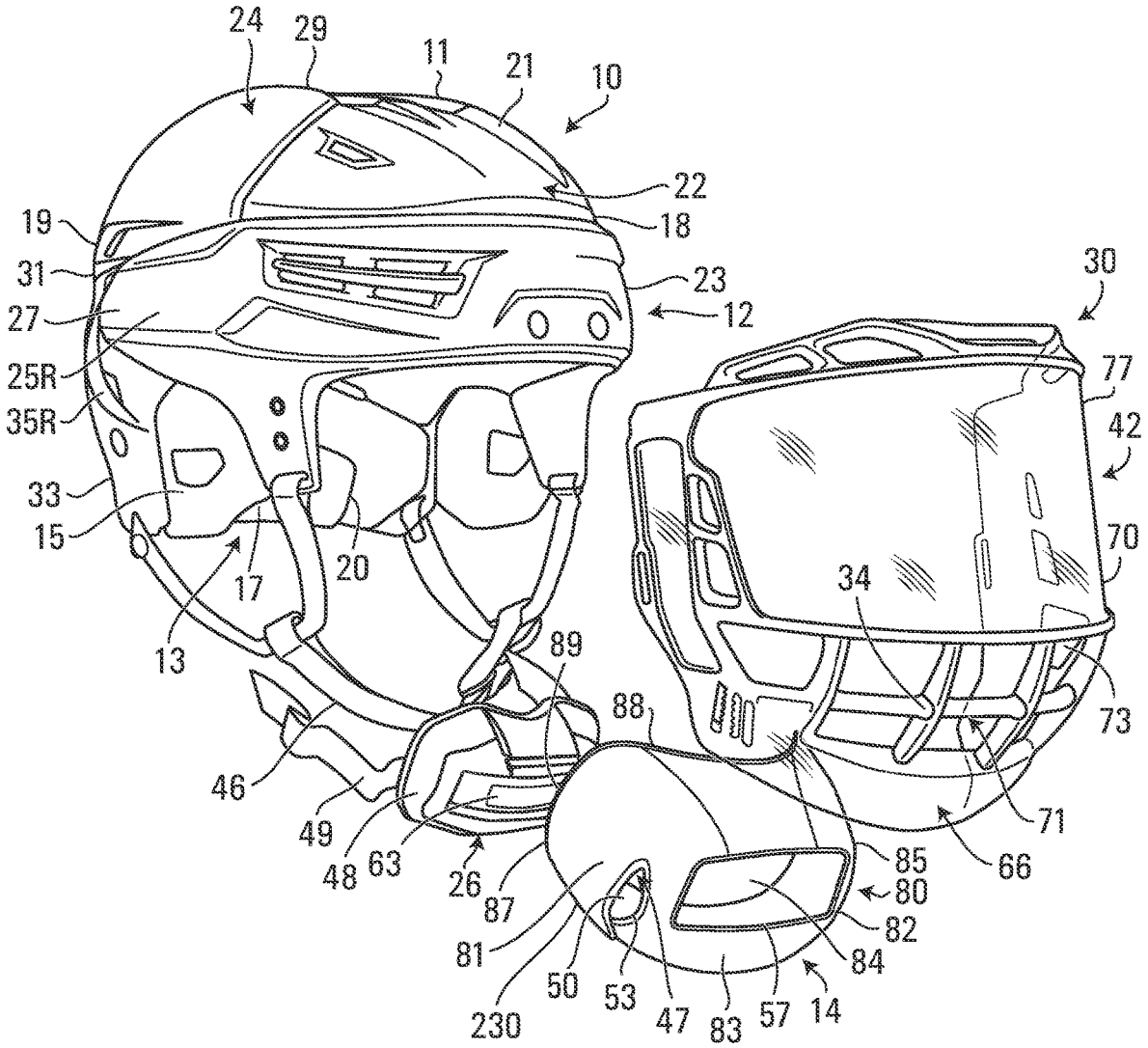

In some embodiments, as shown in FIGS. 7 and 8, the biohazard blocker 14 may comprise a mask 80 configured to engage and cover at least part the user's face.

In this example, the mask 80 is configured to fit within the visor 42 such that an outer surface 81 of the mask 80 faces the inner side 66 of the visor 42. Also, in this example, the mask 80 is configured to connect to the chin member 26 and the visor 42. The connector 47 comprises a central opening 57 to receive a connecting member 63 of the chin cup 48 that projects therein and lateral openings 53 to receive the chin-cup strap 49 to secure the mask 80 to the chin cup 48 and the visor 42 and retain the mask 80 between the visor 42 and the chin cup 48.

In this embodiment, the mask 80 comprises a body 83 shaped to protect the user's face and form a cavity 84 configured to overlie the mouth region of the user. More particularly, in this embodiment, the mask 80 is configured to extend in front of the central region and the left and right lateral sides of the user's face, from below the user's nose to the bottom of the user's face. Thus, in this embodiment, the mask 80 is configured to leave the user's nose uncovered by the mask 80. The mask 80 is configured to terminate without overlying at least a majority of the lens 77. In this example, the mask 80 is configured to extend at least to the user's chin. In this case, the mask 80 is configured to extend below the user's chin. Also, in this example, the mask 80 is curved between a left lateral side 85 of the mask 80 and a right lateral side 87 of the mask 80. The cavity 84 is configured to receive the chin cup 48.

In this example of implementation, the cavity 84 of the mask 80 provides a chamber that may facilitate breathing of the user. In some cases, the mask 80 may be semirigid to be flexible yet self-standing to maintain the cavity 84, even when the chin cup 48 is not received in the cavity 84. This may help to avoid the mask 80 being sucked or otherwise drawn close to or into the user's mouth while breathing.

In this embodiment, the body 83 of the mask 80 comprises fabric 82. The fabric 82 may include any suitable fabric material providing air permeability while protecting against contaminants. For example, in some embodiments, the fabric 82 may include woven fabric material. The woven fabric material of the fabric 82 may comprise polypropylene, polystyrene, polyethylene, polyester, and/or other suitable polymers. In some cases, the fabric 82 may include different fabric materials. For instance, in some cases, the fabric 82 may include a woven fabric layer and a nonwoven fabric layer. In this embodiment, the fabric 82 is washable so that the mask 80 is cleanable and reusable. In other embodiments, the mask 80 may be disposable.

In some embodiments, the mask 80 may comprise one or more face-engaging members configured to engage the user's face and including one or more materials different from the fabric 82. This may enhance comfort and/or engagement of the mask 80 on the user's face, and/or help retain a shape and/or a position of the mask 80 on the user's head.

For instance, in some examples of implementation, the mask 80 may comprise a peripheral member 88 disposed at a periphery of the mask 80, affixed to the body 83 of the mask 80 (e.g., by an adhesive, stitching, etc.), including peripheral material 89 different from the fabric 82, and configured to engage the user's face. For example, in some embodiments, the material 89 of the peripheral member 88 may include foam, an elastomer, or any other cushioning material. Additionally or alternatively, in some embodiments, the peripheral member 88 may include a compliant insert (e.g., soft metallic or polymeric insert) to help maintain the shape of the mask 80 to that it conforms to the user's face.

Figure 9:
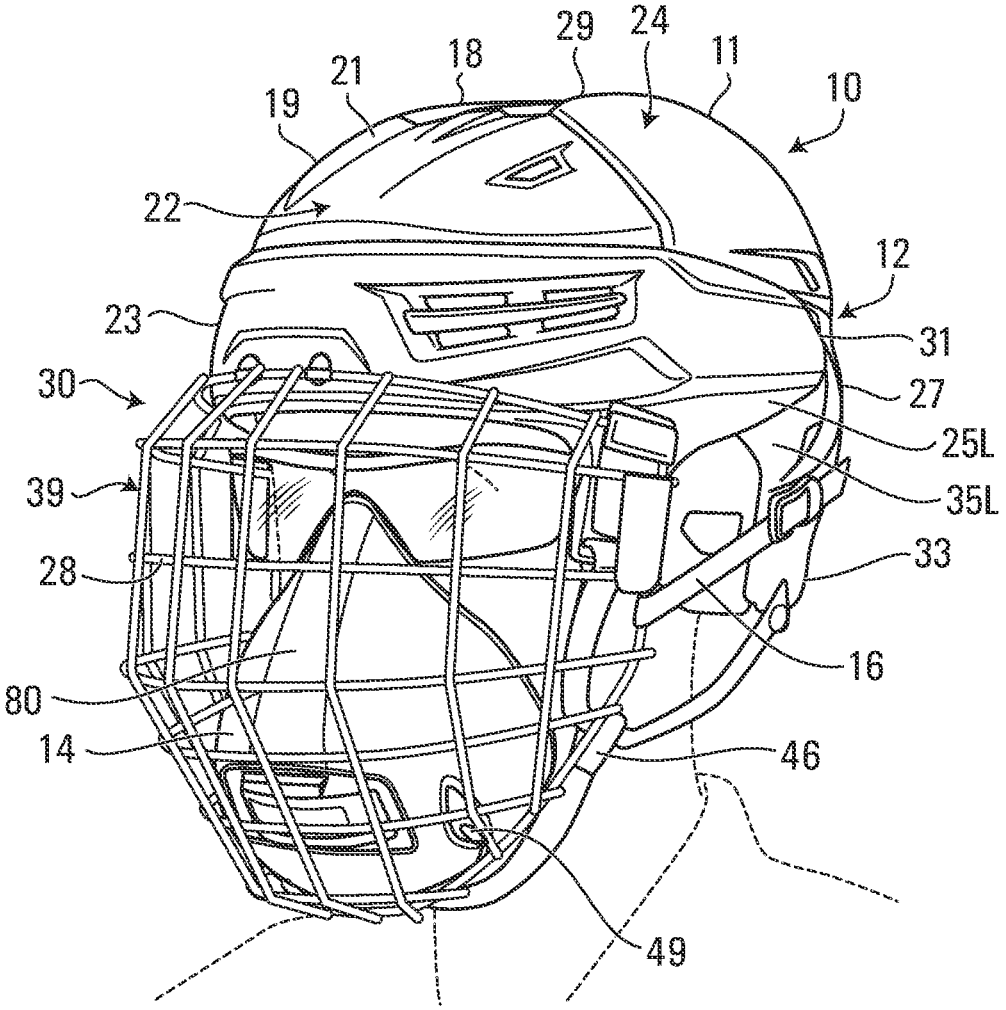
Figure 10:
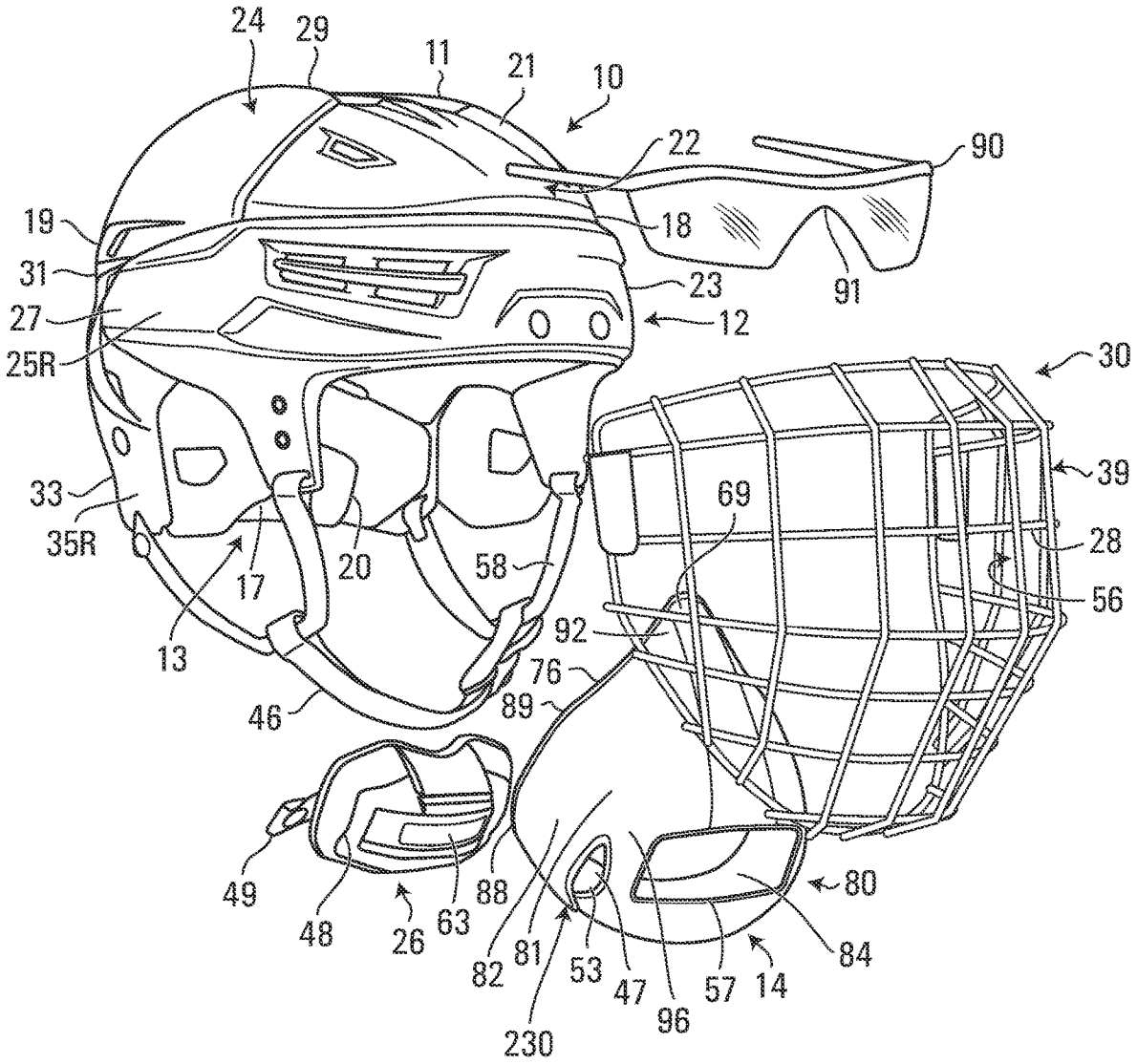

In some embodiments, as shown in FIGS. 9 and 10, the mask 80 is configured to fit within the grid 39 such that the outer surface 81 of the mask 80 faces the inner side 56 of the grid 39. Also, in this example, the mask 80 is configured to connect to the chin member 26 and the grid 39. In this case, the central opening 57 of the connector 47 is configured to receive the connecting member 63 of the chin cup 48 that projects therein and the lateral openings 53 are configured to receive the chin-cup strap 49 to secure the mask 80 to the chin cup 48 and the grid 39 and retain the mask 80 between the grid 39 and the chin cup 48.

In this embodiment, the mask 80, including the cavity 84 formed by its body 83, is configured to overlie the mouth and the nose of the user. More particularly, in this embodiment, the mask 80 is configured to extend in front of the central region and the left and right lateral sides of the user's face, from above a tip of the user's nose to the bottom of the user's face. Thus, in this embodiment, the mask 80 is configured to cover at least part of the user's nose. In this case, the mask 80 is configured to cover at least a majority of the user's nose. More specifically, in this case, the mask 80 is configured to cover substantially an entirety of the user's nose. In this example, the mask 80 is configured to extend at least to the user's chin. In this case, the mask 80 is configured to extend below the user's chin.

In this example of implementation, the cavity 84 of the mask 80 provides the chamber that may facilitate breathing of the user. In some cases, the mask 80 may be semirigid to be flexible yet self-standing to maintain the cavity 84, even when the chin cup 48 is not received in the cavity 84. Also, in this embodiment, the mask 80 is configured to project forwardly and downwardly away from the user's nose and then extend rearwardly towards the user's chin. This may help to avoid the mask 80 being sucked or otherwise drawn close to or into the user's nose and mouth while breathing.

In this embodiment, the mask 80 tapers upwardly such that a nose-covering portion 92 of the mask 80 is narrower than a mouth-covering portion 96 of the mask 80 in a widthwise direction of the mask 80. More particularly, in this embodiment, an upper edge 67 of the mask 80 includes an apex 69 configured to overlie an upper part of the user's nose between his/her eyes and left and right segments 76 that diverge downwardly from the apex 69. This may help the user to see by avoiding to be too close to the user's eyes to be visually obstructive.

For example, in some embodiments, each of the left and right segments 76 of the upper edge 67 of the mask 80 may define an angle relative to the widthwise direction of the mask 80 that may be at least 50°, in some cases at least 55°, in some cases at least 60°, and in some cases even greater.

In some embodiments, the mask 80 may comprise the one or more face-engaging members configured to engage the user's face and including one or more materials different from the fabric 82, such as to enhance comfort and/or engagement of the mask 80 on the user's face, and/or help retain the shape and/or the position of the mask 80 on the user's head.

For instance, in some embodiments, the mask 80 may comprise the peripheral member 88 disposed at the periphery of the mask 80.

Figure 37:
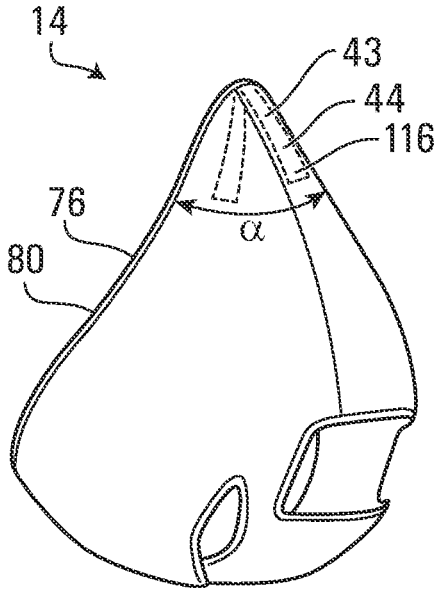
FIG. 37 shows an embodiment of the mask comprising a nose-engaging member.

Also, in some embodiments, as shown in FIG. 37, the mask 80 may comprise a nose-engaging member 43 configured to engage the user's nose and support the mask 80 on the user's nose and including material 116 different from the fabric 82 of the mask 80. For example, in this embodiment, the nose-engaging member 43 is configured to clamp onto the user's nose to help in retaining the mask 80 properly positioned on the user's face. More particularly, in this embodiment, the nose-engaging member 43 is configured to be disposed astride the user's nose, i.e., extend on left and right sides of the user's nose (e.g., by being curved and/or angled). In this case, the nose-engaging member 43 comprises a pair of legs 44 to be disposed on respective ones of the left and right sides of the user's nose. In some examples of implementation, the material 116 of the nose-engaging member 43 may be stiffer than the fabric 82 of the mask 80. For instance, in some cases, the material 116 of the nose-engaging member 43 may be polymeric material (e.g., polyethylene, polypropylene, etc.) molded into a shape of the nose-engaging member 43.

Figure 38:
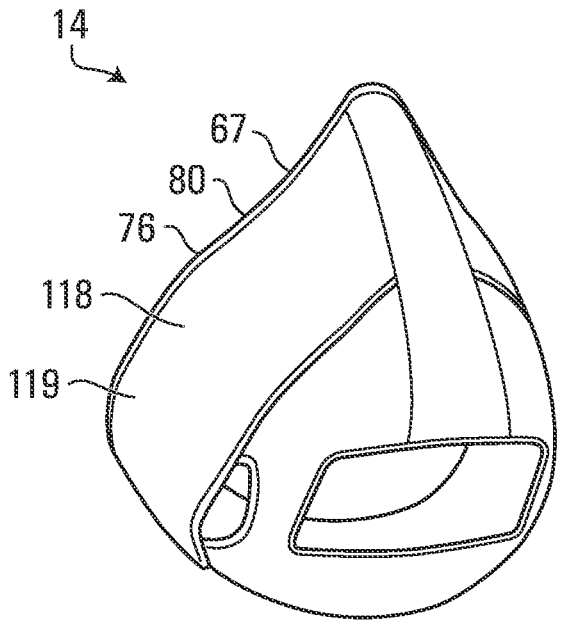
FIG. 38 shows an embodiment of the mask comprising lateral cheek members.

Furthermore, in some embodiments, as shown in FIG. 38, the mask 80 may comprise lateral cheek members 118 configured to overlie left and right cheeks of the user and including material 119 different from the fabric 82 of the mask 80. For instance, this may help to retain the mask 80 in position, including to keep the left and right segments 76 of the upper edge 67 of the mask 80 properly positioned. In some examples of implementation, the material 119 of each of the lateral cheek members 118 may be stiffer than the fabric 82 of the mask 80. For instance, in some cases, the material 119 of each of the lateral cheek members 118 may be polymeric material (e.g., polyethylene, polypropylene, etc.) molded into a shape of that lateral cheek member.

In some embodiments, where the grid 39 is used with the mask 80, eyewear 90 may be worn by the user within the grid 39 to protect the user's eyes. In this embodiment, a nose bridge 91 of the eyewear 90 may be shaped complementarily to the nose-covering portion 92 of the mask 80 which is received in the nose bridge 91. In some examples, the eyewear 90 may be antifogging, similarly to that described previously with respect to the thin clear member 58 of the clear shield 52.

In some embodiments, the mask 80 may be removable from the helmet 10 while the chin member 26 (e.g., including the chin cup 48) and/or the faceguard 30 remain connected to a remainder of the helmet 10. For instance, in some embodiments, the mask 80 may be removable from the helmet 10 without removing the chin member 26 (e.g., including the chin cup 48) and/or the faceguard 30 from helmet 10. This may facilitate cleaning and/or replacement of the mask 80 (e.g., without compromising impact protection attributes of the helmet 10).

Figure 36:
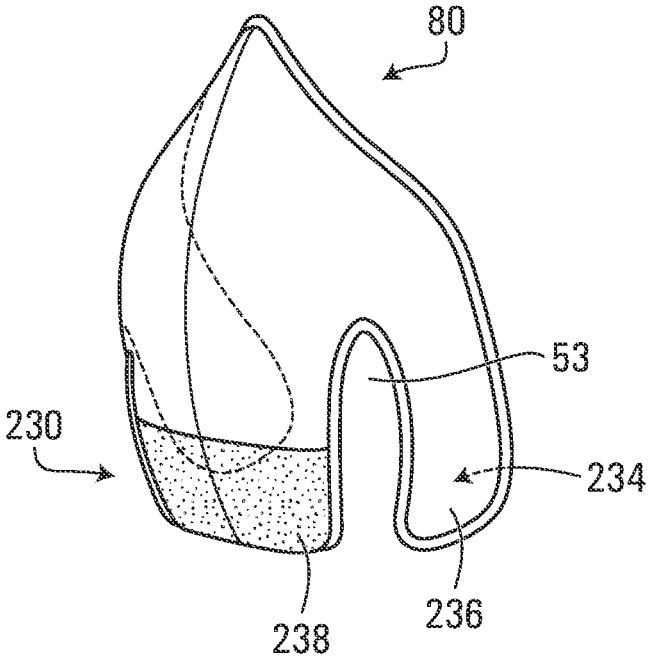
FIG. 36 shows an embodiment of the mask comprising a detachable fastening system.

For example, in some embodiments, and with additional reference to FIG. 36, the connector 47 of the mask 80 may comprise a detachable fastening system 230 to detachably fasten the mask 80 to the chin member 26. More particularly, in this embodiment, the detachable fastening system 230 comprises detachable fasteners 234 to detachably fasten the mask 80 to the chin cup 48 and the chin-cup strap 49, which secures the chin cup 48 to the faceguard 30. In this example, each of the detachable fasteners 234 comprises a hook-and-loop fastener (e.g., including Velcro material) including a hook portion 236 and a loop portion 238 on adjacent parts (e.g., flaps) of the mask 80 that can be moved onto one another to define a respective one of the lateral openings 53 and secure the mask 80 about the chin-cup strap 49 that passes though that respective one of the lateral openings 53. The detachable fasteners 234 may be implemented in any other way in other embodiments (e.g., comprise a clip, a snap button, etc.).

Breathability of the biohazard blocker 14, including the clear shield 52 or the mask 80, allows the user to properly breathe and perform while protecting against contaminants.

For example, in some embodiments, the mask 80 may have: a differential pressure of less than 6 mm $H_2O/cm^2$ and in some cases less than 5 mm $H_2O/cm^2$ according to ASTM F2100-19 (Standard Specification for Performance of Materials Used in Medical Face Masks); a bacterial filtration efficiency of at least 95% and in some cases at least 98% according to ASTM F2100-19; and/or a sub-micron particulate filtration efficiency at 0.1 micro of at least 95% and in some cases at least 98% according to ASTM F2100-19. For instance, in some embodiments, the mask 80 may be a level 1 barrier, in some cases a level 2 barrier, and in some cases a level 3 barrier according ASTM F2100-19. In this embodiment, the mask 80 may be a level 2 barrier according ASTM F2100-19 to be more breathable.

As another example, in some embodiments, the mask 80 may have a differential pressure of less than 5 mm $H_2O/cm^2$ and in some cases less than 4 mm $H_2O/cm^2$ according to MIL-M-36954 C (Mask, Surgical, Disposable—superseded).

As another example, in some embodiments, the air permeability of the fabric 82 of the mask 80 may be at least 100 $cm^3/s/cm^2$, in some cases at least 200 $cm^3/s/cm^2$, in some cases at least 400 $cm^3/s/cm^2$, and in some cases even more according to ASTM D737-18 (Standard Test Method for Air Permeability of Textile Fabrics, ASTM International, West Conshohocken, Pa., 2018).

Figure 24:
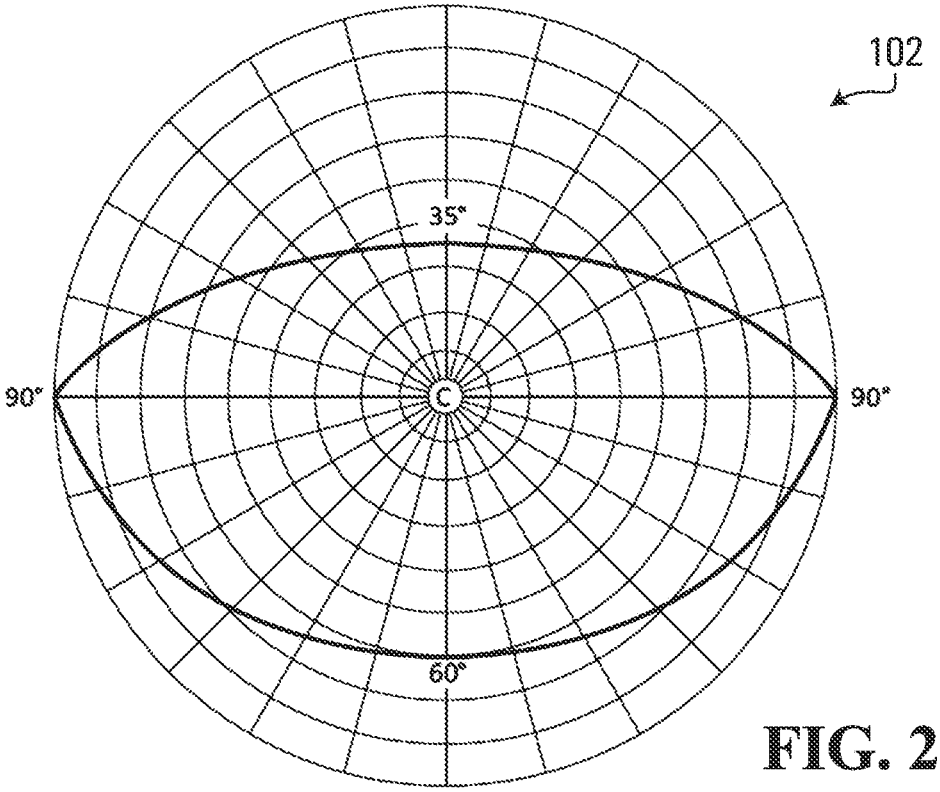
FIG. 24 shows a schematic of a visual field of the protective headgear, including of the faceguard.

The protective headgear 10, including the helmet 12 and the biohazard blocker 14, which may include the clear shield 52 or the mask 80, is configured to allow for proper vision (e.g., to provide an optimal visual field) of the user. For example, in some embodiments as shown in FIG. 24, the protective headgear 10, including the helmet 12 and the biohazard blocker 14, which may include the clear shield 52 or the mask 80, may be configured to provide a field of view 102 without occultation measuring at least 90 degrees temporally rightward from a vertical median, at least 90 degrees temporally leftward from the vertical median, at least 35 degrees superiorly from a horizontal median, and at least 60 degrees inferiorly from the horizontal median. For instance, in some embodiments such as these where it is for hockey, the protective headgear 10, including the helmet 12 and the biohazard blocker 14, which may include the clear shield 52 or the mask 80, may comply with CSA Z262.2-15 (Face protectors for use in ice hockey) clause 5.4.2 e).

In some embodiments, for droplet protection (e.g., from spatter or other droplets), the protective headgear 10, including the helmet 12 and the biohazard blocker 14, which may include the clear shield 52 or the mask 80, may be configured to prevent droplets from contacting a zone of the user's face corresponding to a no-contact zone of CSA Z262.2-15 (FIG. 3) according to ANSI Z87.1-2015 (Occupational and Educational Personal Eye and Face Protection Devices) clause 8.1.1, test method 9.17.1.

In some embodiments, the protective headgear 10, including the helmet 12 and the biohazard blocker 14, which may include the clear shield 52 or the mask 80, may provide coverage according to ANSI Z87.1-2015, clause 8.1.2, test method 9.17.2.

In some embodiments such as these where it is for hockey, the protective headgear 10, including the helmet 12 and the biohazard blocker 14, which may include the clear shield 52 or the mask 80, may provide impact protection so that it complies with CSA Z262.2-15, clause 5.6, test method 7.7.

In various embodiments, as it may be connected to the helmet 10, the biohazard blocker 14 may be used without the user having to touch his/her head (e.g., face, ears, hair, etc.), which may further help to protect against spreading of contaminants.

The protective headgear 10 may be implemented in various other ways in other embodiments.

Figure 34:
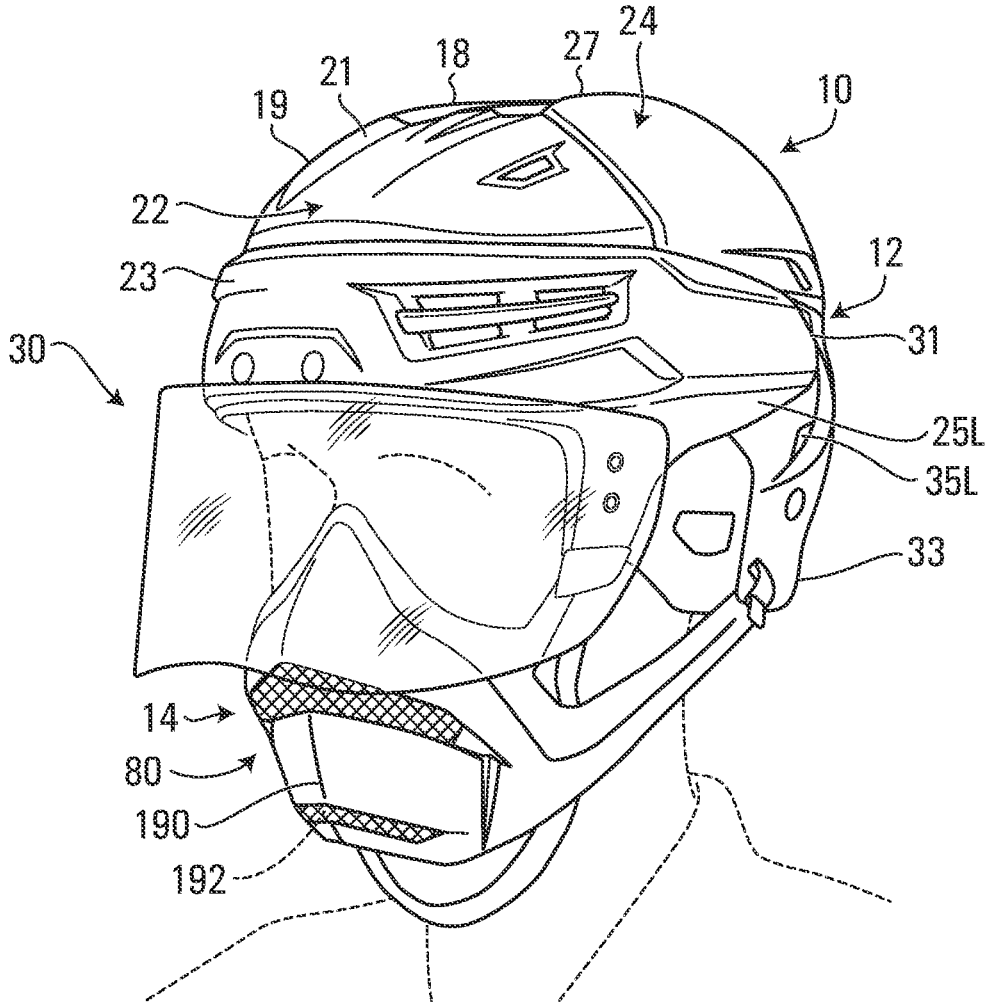
FIG. 34 shows another embodiment of the faceguard.

For example, in some embodiments, as shown in FIG. 34, the mask 80 may be configured to cooperate with the faceguard 30 that provides partial-face protection, i.e., protects less than the entirety (e.g., half or some other fraction) of the user's face, such as the visor 42 or the grid 39 that does not extend to the user's chin (e.g., a half clear shield or half cage). In this embodiment, the mask 80, including the cavity 84 formed by its body 83, is configured to overlie the mouth and the nose of the user. More particularly, in this embodiment, the mask 80 is configured to extend in front of the central region and the left and right lateral sides of the user's face, from above the tip of the user's nose to the bottom of the user's face. In this example, the mask 80 is configured to extend at least to the user's chin. In this case, the mask 80 is configured to extend below the user's chin.

In this embodiment, the mask 80 overlaps with the faceguard 30 even though the faceguard 30 extends over less than the entirety of the user's face. In some examples, the mask 80 may also provide impact protection to a part, such as the nose region and mouth region, of the user's face that is unprotected by the faceguard 30. Thus, in some examples, the mask 80 may comprise rigid material 190 (e.g., polycarbonate, high-density polyethylene, or any other polymeric material, which may be fiber-reinforced polymeric material) to protect against impacts. Also, in some examples, the mask 80 may comprise cushioning material 192 (e.g., foam) disposed inwardly of the rigid material 190 for impact energy absorption and comfort.

In some embodiments, the mask 80 may be connected to the outer shell 11 of the helmet 10. For instance, in some embodiments, the mask 80 may be secured to each of the shell members 22, 24 (e.g., via snap buttons, hook-and-loop fasteners, or other fasteners which may be adhesively bonded or otherwise affixed to the outer shell 11) and/or to another component of the helmet 10 (e.g., the chin member 26, earloops, etc.).

Figure 43:
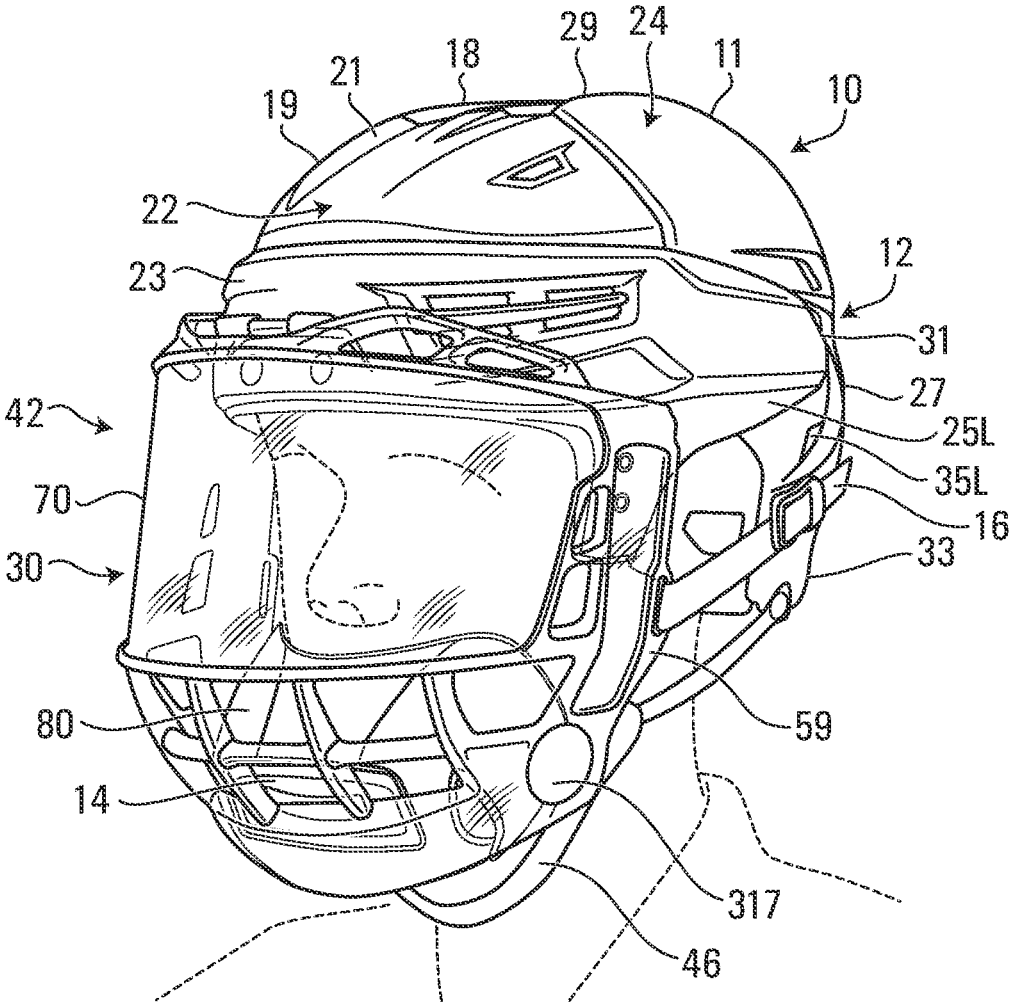
FIG. 43 shows an embodiment of the mask fastened by fasteners on lateral sides of the faceguard.
Figure 44:
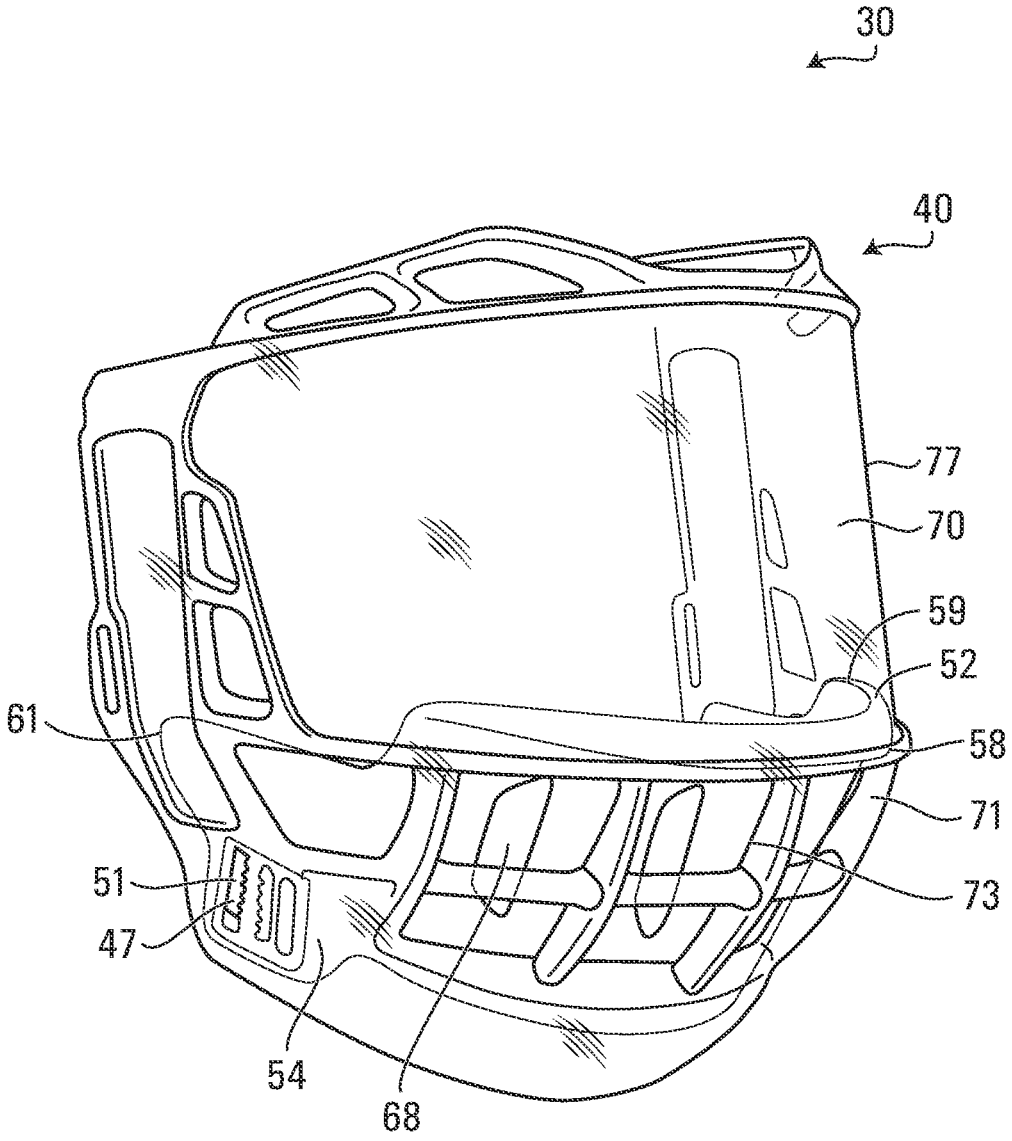
FIG. 44 shows another embodiment of the faceguard and the clear shield.

Alternatively or additionally, in some embodiments, the mask 80 may be secured to the faceguard 30. For example, in some embodiments, as shown in FIG. 43, the mask 80 may be fastened by fasteners 317 (e.g., adhesive, screws, rivets, snap buttons, clips, etc.) on the lateral sides 59, 61 of the faceguard 30. This may help to reduce visual obstruction.

In other embodiments, as shown in FIGS. 47A to 47I, the connector 47 of the clear shield 52 comprises an interlocking part 232 configured to interlock with an interlocking part 233 of the visor 42 to interlock the clear shield 52 and the visor 42. That is, the clear shield 52 and the visor 42 are in a mechanical interlock relationship in which at least one of the interlocking part 232 of the clear shield 52 and the interlocking part 233 of the visor 42 includes an interlocking space (e.g., comprising one or more holes, recesses, and/or other voids) into which extends an adjacent one of the interlocking part 232 of the clear shield 52 and the interlocking part 233 of the visor 42.

For example, in this embodiment, the interlocking part 232 of the clear shield 52 includes a plurality of interlocking projections 86 extending into voids 79 of the interlocking part 233 of the visor 42 to mate and secure the clear shield 52 to the visor 42. For instance, in this case, the voids 79 of the interlocking part 233 of the visor 42 are implemented by the vent openings 73 of the visor 42. In this example, the interlocking projections 86 of the clear shield 52 are thus shaped to conform to the vent openings 73 of the visor 42. More specifically, in this example, the interlocking projections 86 of the clear shield 52 are generally polygonal (e.g., rectangular or triangular) conforming to the vent openings 73 of the visor 42 that are generally polygonal.

In this embodiment, the interlocking projections 86 of the clear shield 52 extend into and close at least part of each of the vent openings 73 of the visor 42. More particularly, in this embodiment, upper ones of the interlocking projections 86 of the clear shield 52 extend into and close completely (i.e., an entirety of each of) upper ones of the vent openings 73 of the visor 42, while lower ones of the interlocking projections 86 of the clear shield 52 extend into and close less than completely (e.g., less than an entirety of each) of lower ones of the vent openings 73 of the visor 42 such that part of each of the lower ones of the vent openings 73 of the visor 42 remains open. Specifically, in this embodiment, the lower ones of the interlocking projections 86 of the clear shield 52 include vent openings 179 that are smaller than and configured to overlap with the lower ones of the vent openings 73 of the visor 42. The vent openings 179 of the lower ones of the interlocking projections 86 of the clear shield 52 are configured to be located below the user's mouth and face downwardly. This may help to block passage of droplets. In this example, the vent openings 179 of the lower ones of the interlocking projections 86 of the clear shield 52 are hollow, without any filter such as the filter 74 therein.

In some embodiments, the vent openings 179 of the lower ones of the interlocking projections 86 of the clear shield 52 are configured to prevent droplets from contacting the user's eyes according to ANSI Z87.1-2015 (Occupational and Educational Personal Eye and Face Protection Devices) clause 8.1.1, test method 9.17.1. For instance, in some embodiments, the vent openings 179 of the lower ones of the interlocking projections 86 of the clear shield 52 are configured to prevent droplets from contacting a zone of the user's face corresponding to a no-contact zone of CSA Z262.2-15 (FIG. 3) according to ANSI Z87.1-2015 (Occupational and Educational Personal Eye and Face Protection Devices) clause 8.1.1, test method 9.17.1.

In this embodiment, the clear material 54 of the clear shield 52 comprises polyurethane. This may facilitate molding of the clear shield 52 in a mold. In other embodiments, the clear shield 52 may comprise PET, polycarbonate, or any other suitable material.

In this example of implementation, in addition to interlocking with the visor 42, the connector 47 of the clear shield 52 comprises fasteners 287 to fasten the clear shield 52 to the visor 42. More particularly, in this example, the fasteners 287 are hook-and-loop fasteners. For example, in this embodiment, the fastener 287 comprises a hook-and-loop fastener 312 that can be looped about parts of the clear shield 52 and parts of the visor 42 through respective ones of the vent openings 179 of the lower ones of the interlocking projections 86 of the clear shield 52 and fastening openings 339 of the clear shield 52. The fasteners 287 may be implemented in any other way in other examples (e.g., straps with snap fasteners, clips, etc.).

In various embodiments, as shown in FIGS. 42A, 42B, 42C, 42D and 42E, the biohazard blocker 14, which may include the clear shield 52 or the mask 80, may be movable (e.g., pivotable) relative to the outer shell 11 while remaining connected to the helmet 12. For example, this may be useful for the user to drink or otherwise move the biohazard blocker 14 away from his/her face when potential for contaminant exposure is reduced.

More particularly, in this embodiment, the faceguard 30 and the chin cup 48 are pivotable relative to the outer shell 11 so that the biohazard blocker 14, which is connected to the faceguard 30 and the chin cup 48, is also pivotable relative to the outer shell 11. In this example, the faceguard 30 is pivotally mounted to the outer shell 11 via a pivot 312. In this case, the pivot 312 comprises pivot elements 314 that pivotally mount the faceguard to the front portion 23 of the shell member 22. The pivot 312 may be implemented in any other suitable way in other embodiments (e.g., comprise pivot elements on the left and right lateral side portions 25L, 25R of the shell member 22). Faceguard straps 16 fastening the faceguard 30 to the outer shell 11 can be detached to allow pivoting of the faceguard 30, the chin cup 48, and the biohazard blocker 14 relative to the outer shell.

Figure 20:
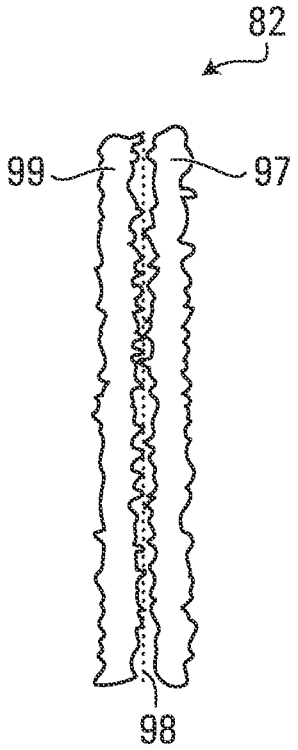
FIGS. 20 and 21 show another embodiment of a body of the mask.

In some embodiments, as shown in FIG. 20, the body 83 of the mask 80, including the fabric 82, may comprise a plurality of layers that may include different materials and/or implement different functionalities. In this embodiment, the body 83 of the mask 80, including the fabric 82, may comprise an inner layer 97, an intermediate layer 98, and an outer layer 99.

For example, in some embodiments, the inner layer 97 of the body 83 of the mask 80 is part of the fabric 82 and may be antimicrobial, such as antibacterial, antiviral, and/or antifungal (e.g., may include one or more antimicrobial agents). For instance, in some embodiments, the inner layer 97 may include fabric material comprising copper (e.g., yarns of copper or a copper alloy), which has antimicrobial properties.

Additionally or alternatively, in some embodiments, the inner layer 97 of the body 83 of the mask 80 may be wicking to wick perspiration away from the user's skin.

As yet another addition or alternative, in some embodiments, the inner layer 97 of the body 83 of the mask 80 may provide a cooling effect perceivable by the user. For instance, in some embodiments, the inner layer 97 may include fabric material comprising active elements to generate the cooling effect. For example, in some embodiments, the inner layer 97 may be configured to cool down when absorbing moisture as the user breathes and sweats, i.e., a moisture-activated cooling fabric material. For instance, the active elements may be swellable elements configured to swell when absorbing moisture to create the cooling effect. As another example, in some embodiments, the inner layer 97 may be configured to cool down when absorbing heat from the user, i.e., a heat-activated cooling fabric material. For instance, the active elements may be phase-change material (PCM) elements (e.g., microencapsulated PCM elements) configured to change phase when absorbing heat to create the cooling effect. Examples of materials that can be used for the cooling effect include Nexar™ polymers which may be commercially obtained from Kraton Performance Polymers Inc., Houston, Tex., Thermocules™ PCM elements which may be commercially obtained from Outlast Technologies LLC, Boulder, Colo., materials commercially obtained from CoolCore, Portsmouth, N.H.; IceFil by Ventex, Luxicool, Cool Jade, Advansa's Thermo Cool, and HeiQ's Adaptive, etc.

For example, in some embodiments, the inner layer 97 of the body 83 of the mask 80 may include 50% cooling yarn and 50% antimicrobial yarn.

In some embodiments, a material of the intermediate layer 98 of the body 83 of the mask 80 may be filtering to filter ambient air and/or exhalation of the user. For example, in some embodiments, the intermediate layer 98 may include a high-efficiency particulate air (HEPA) fabric or other filtering fabric ply of the fabric 82. In some embodiments, the intermediate layer 98 may be configured to electrostatically filter contaminants (e.g., include electrostatically charged fibers). Alternatively or additionally, in some embodiments, the intermediate layer 98 may be configured to actively filter contaminants, i.e., may comprise active particles. These active particles are "active" in that they have a property allowing them to induce a chemical and/or physical reaction in response to a stimulus at their surface which filters the contaminants. For instance, in some embodiments, the active particles have an adsorptive property that causes them to adsorb the contaminants. In some cases, the active particles may be porous particles each including a multitude of pores (e.g., several thousands of pores) which can trap the contaminants. In some examples, the active particles may be particles of activated carbon (e.g., derived from nutshells, coconut husk, coal-based substances, etc.).

Figure 21:
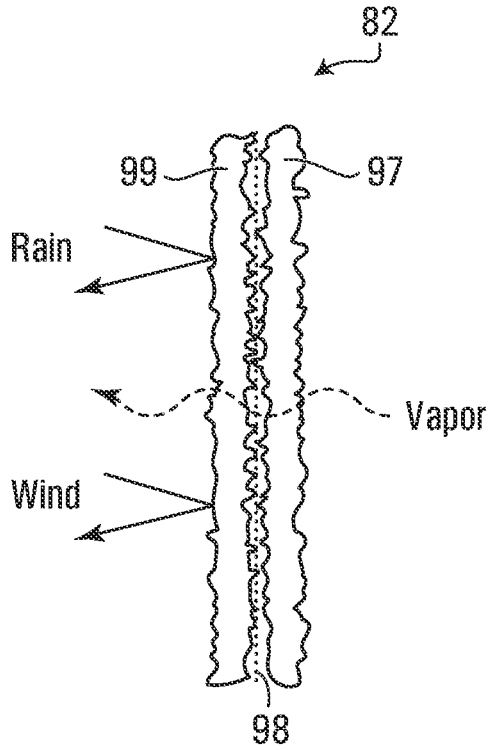

In some embodiments, the outer layer 99 of the body 83 of the mask 80 may be configured to be a waterproof (e.g., splash-proof) breathable barrier (e.g., a membrane) to provide resistance to environmental elements such as wind, water, snow or sleet. In this example, the outer layer 99 may comprise a laminate material or a coated material (e.g. a hydrophilic poly(ethylene oxide) membrane). While the outer layer 99 may be configured to be windproof and/or waterproof, the fabric 82 may still be configured to allow vapor to escape, as shown in FIG. 21. This may contribute to desirable attributes of the mask 80 such as breathability, antifogging etc. The outer layer 99 may be configured to have additional features such as radiation-blocking properties (e.g., capable of blocking UV radiation).

Figure 39:
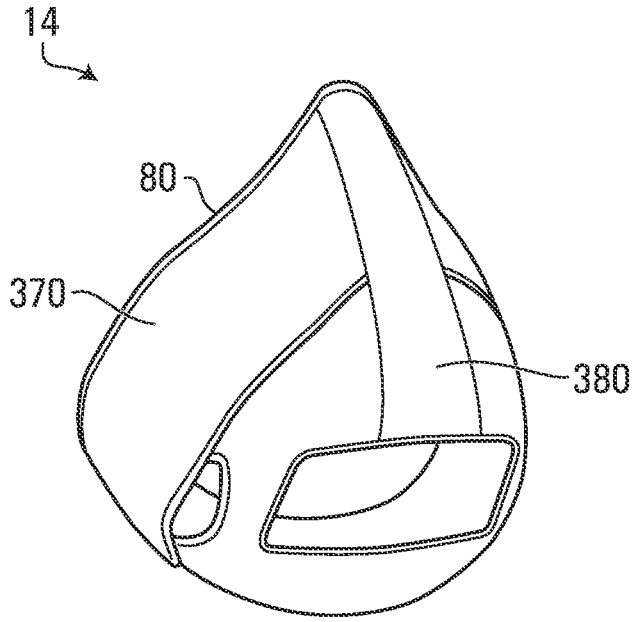
FIG. 39 shows an embodiment of the mask comprising left and right lateral portions that are more breathable than a central portion.

In some embodiments, portions of the mask 80 that are configured to overlie different regions of the user's face may be structurally different. For example, in some embodiments, as shown in FIG. 39, left and right lateral portions 370 of the mask 80 may be more breathable (e.g., more air permeable) than a central portion 380 of the mask 80 disposed between the left and right lateral portions 370 of the mask 80 in the widthwise direction of the mask 80, while the central portion 380 of the mask 80, which is configured to overlie the user's mouth and nose, may be more effective at blocking contaminants than the left and right lateral portions 370 of the mask 80. This may allow more air to circulate yet maintain greater contaminant blocking where the mask 80 is aligned with the user's mouth and nose.

In some embodiments, the mask 80 may be configured to interact with the chin member 26 of the helmet 10 in any other way. For instance, in some embodiments, the mask 80 may wrap completely around the chin cup 48 without any central opening such as the central opening 57 that receives any part such as the connecting member 63 of the chin cup 48. In other embodiments, the chin member 26 may be configured to be disposed over the mask 80 such that the mask 80 lies between the user's face and the chin member 26.

Figure 22:
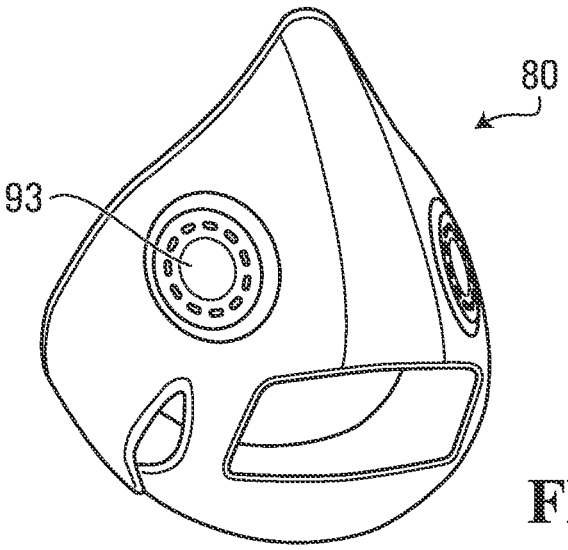
FIG. 22 shows another embodiment of the mask comprising one or more breathing valves.

In some embodiments, as shown in FIG. 22, the mask 80 may comprise one or more breathing valves 93. This may facilitate the user's inhalation or exhalation and/or help to reduce buildup of heat and humidity within the cavity 84 of the mask 80 and/or potential for fogging (e.g., of the visor 42 or the eyewear 90). In some examples, the breathing valve 93 may be configured to increase air flow into the mask 80 breathable by user when the user skates or otherwise moves faster. The user may then have access to more oxygen when he/she exerts more physical effort.

Figure 40:
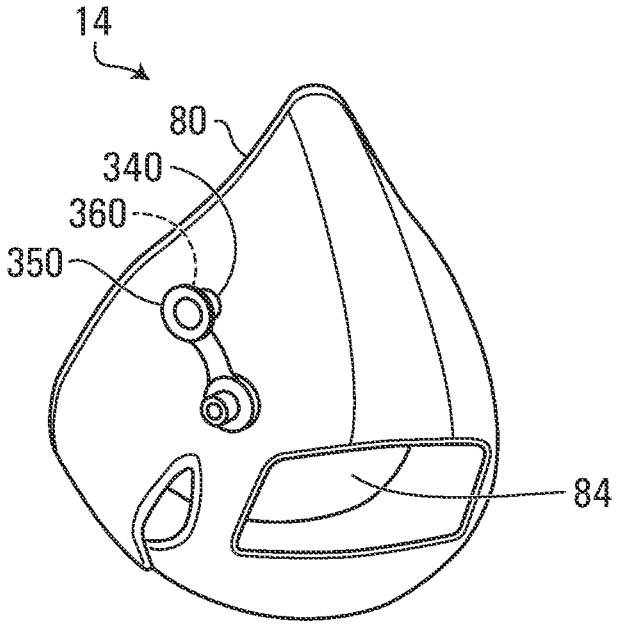
FIG. 40 shows an embodiment of the mask comprising a hydration opening.

In some embodiments, as shown in FIG. 40, the mask 80 may comprise a hydration opening 340 configured to allow the user to drink potable liquid (e.g., water, sports drink, etc.) through the mask 80. This may be useful for the user to drink without removing or otherwise moving the mask 80. In some cases, this may also facilitate placement and removal of a mouthguard by the user without removing or otherwise moving the mask 80.

More particularly, in this embodiment, the hydration opening 340 of the mask 80 comprises a hydration port 350 configured to receive the potable liquid from an outlet of a bottle (e.g., a spout and/or a straw) and is in fluid communication with a suction element 360 within the cavity 84 of the mask 80 that the user can suck on to draw the potable liquid. In some cases, the hydration port 350 may comprise a hydration valve that is configured to open only when the user drinks (e.g., sucks on the suction element 360).

In other embodiments, as shown in FIGS. 48 to 54, the mask 80 comprises portions 332 of the body 83 of the mask 80 that are movable relative to one another to open the hydration opening 340 of the mask 80 and close the hydration opening 340 of the mask 80.

For example, in this embodiment, respective ones of the portions 332 of the body 83 of the mask 80 include respective parts of the fabric 82 of the body 83 of the mask 80, such as respective parts of one or more of the inner layer 97, the intermediate layer 98, and the outer layer 99, which are movable relative to one another to open and close the hydration opening 340 of the mask 80.

More particularly, in this embodiment, the portions 332 of the body 83 of the mask 80 that are movable relative to one another to open and close the hydration opening 340 of the mask 80 include a main section 356 and covering section 358 that is movable away from the main section 356 to open the hydration opening 340 of the mask 80 and movable towards the main section 356 to close the hydration opening 340 of the mask 80. In this example, the mask 80 comprises a slot 364 including left and right segments 366, 368 and a central segment 370 between the left and right segments 366, 368, and the hydration opening 340 of the mask 80 comprises part of the slot 364. In this case, the left and right segments 366, 368 of the slot 364 implement the lateral openings 53 to receive the chin-cup strap 49 to secure the mask 80 to the chin cup 48 and the faceguard 30 and retain the mask 80 between the faceguard 30 and the chin cup 48, while the central segment 370 of the slot 364 implement the hydration opening 340 of the mask 80.

The hydration opening 340 of the mask 80 is opened by moving the covering section 358 away from the main section 356. Conversely, the hydration opening 340 of the mask 80 is closed by moving the covering section 358 towards from the main section 356. In this example, the covering section 358 and the main section 356 overlap when the hydration opening 340 is closed, as this may further help block contaminants. Also, in this example, the mask 80 comprises a retainer 385 to retain the covering section 358 relative to the main section 356 so that the hydration opening 340 is closed. For example, in this embodiment, the retainer 385 comprises a hook-and-loop fastener 386 that includes a hook portion 388 on a given one of the covering section 358 and the main section 356 and a loop portion 390 on an opposite one of the covering section 358 and the main section 356.

In other embodiments, as shown in FIGS. 55 to 60, the portions 332 of the body 83 of the mask 80 that are movable relative to one another to open and close the hydration opening 340 of the mask 80 include an upper central section 334, a lower central section 336, a left lateral section 338, and a right lateral section 342 of the body 83 of the mask 80 that are movable away from one another to open the hydration opening 340 of the mask 80 and movable towards one another to close the hydration opening 340 of the mask 80. In this example, the hydration opening 340 of the mask 80 is defined by space (e.g. a gap) between respective ones of the upper central section 334, the lower central section 336, the left lateral section 338, and the right lateral section 342 of the body 83 of the mask 80 when they are moved away from one another. Also, in this example, these respective ones of the upper central section 334, the lower central section 336, the left lateral section 338, and the right lateral section 342 of the body 83 of the mask 80 overlap when the hydration opening 340 is closed, as this may further help block contaminants. In this embodiment, the hydration opening 340 of the mask 80 is defined by the space between the upper central section 334 and the lower central section 336 of the body 83 of the mask 80 when they are moved away from one another. Also, the upper central section 334 and the lower central section 336 of the body 83 of the mask 80 overlap when the hydration opening 340 is closed.

In this embodiment, the mask 80 comprises a strap system 410 configured to fasten the mask 80 to fastening elements 540 disposed on (e.g., affixed to) left and right side portions of the outer shell 11 of the helmet 10. In this embodiment, the fastening elements 540 may be provided to fasten the faceguard 30 to the outer shell 11, but may instead be used to fasten the mask 80 to the outer shell 11. The strap system 410 comprises fastening elements 550 complementary to the fastening elements 540 disposed on the outer shell 11. For instance, in this example, the fastening elements 540 disposed on the outer shell 11 and the fastening elements 550 of the strap system 410 may constitute snap fasteners. In other examples, the fastening elements 540 disposed on the outer shell 11 and the fastening elements 550 of the strap system 410 may implement any other type of fastener.

More particularly, in this embodiment, the strap system 410 of the mask 80 comprises a plurality of left lateral straps 430 that converge away from the body 83 of the mask 80 and are affixed (e.g., stitched) to a rear left strap 434 that is configured to extend to the fastening element 540 disposed on the left lateral side of the outer shell 11 and includes the fastening element 550 to cooperate therewith. Similarly, the strap system 410 of the mask 80 comprises a plurality of right lateral straps 450 that converge away from the body 83 of the mask 80 and are affixed (e.g., stitched) to a rear right strap 454 that is configured to extend to the fastening element 540 disposed on the right lateral side of the outer shell 11 and includes the fastening element 550 to cooperate therewith. In this example, each of the left rear strap 434 and the right rear strap 454 may be adjustable to adjust a fit of the mask 80 on the user's head. For instance, in this example, each of the left rear strap 434 and the right rear strap 454 comprises a sliding buckle 461 for adjustability.

The strap system 410 of the mask 80 may be implemented in any other suitable way in other embodiments.

In some embodiments, the mask 80 may be used without being connected to the helmet 12. For instance, in some embodiments, as shown in FIGS. 61 to 65, the mask 80 may comprises a strap system 520 for securing the mask 80 to the user's head without connection to the helmet 10. In this example, the strap system 520 comprises earloops 525 configured to extend around the user's ears. In other examples, the strap system 520 may comprise a strap configured to extend behind the user's head or any other attachment.

In some embodiments, as shown in FIGS. 55 to 65, the mask 80 may comprise a chin gusset 38. The chin gusset 38 may improve fit of the mask 80 and comfort and protection of the user. For example, the chin gusset 38 may be configured to expand the coverage of the mask 80 as the user opens their mouth (e.g., to drink a potable liquid, to speak, to exhale etc.) such that the mask 80 may remain aligned with the user's mouth and nose. The chin gusset 38 may also enhance the cavity 84 such that the cavity 84 may better accommodate the chin member 26, for instance, in embodiments where the mask 80 is configured to be disposed over the chin member 26.

Figure 41:
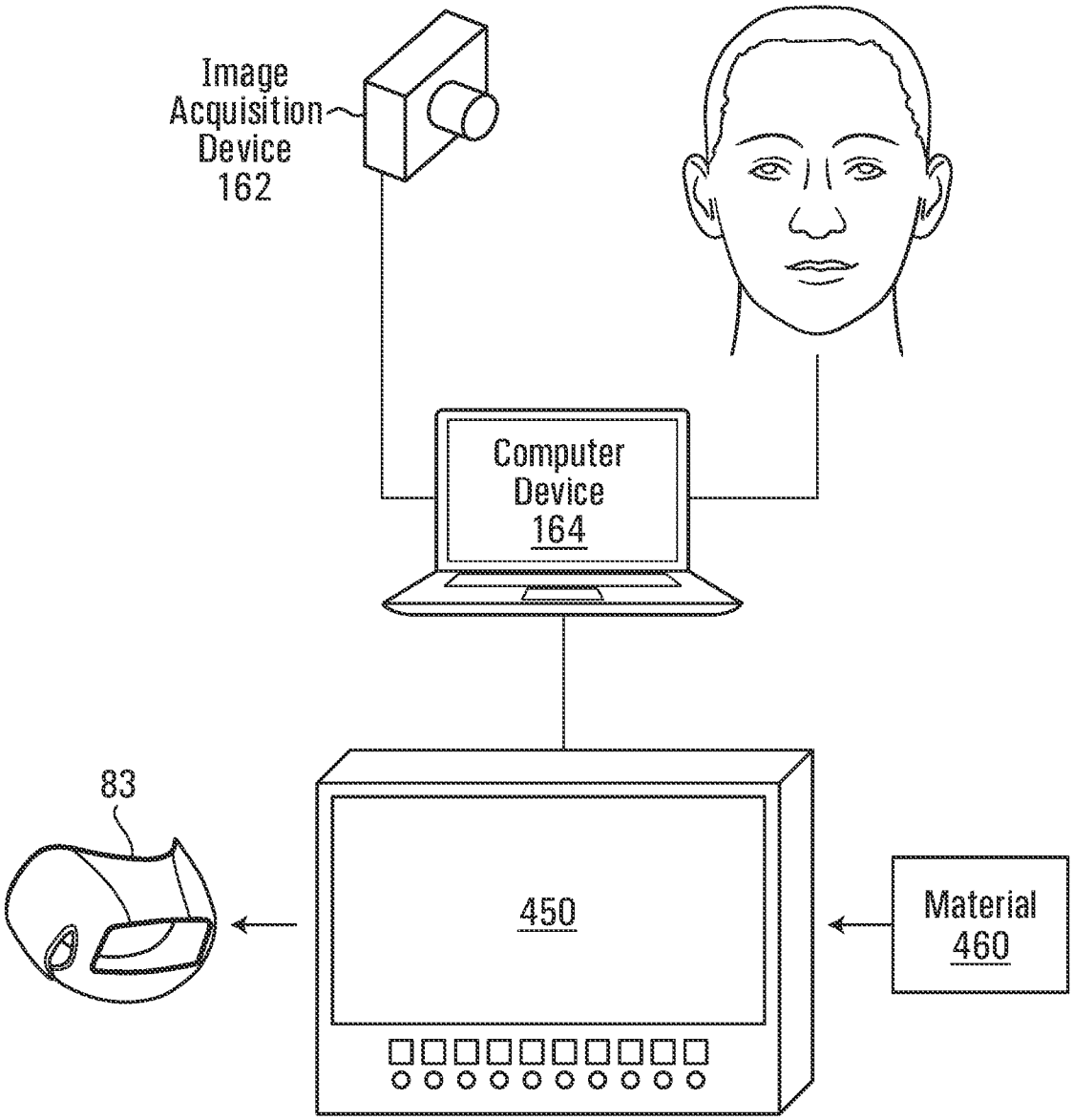
FIG. 41 shows an embodiment of the mask comprising 3D printed material.
Figure 42A:
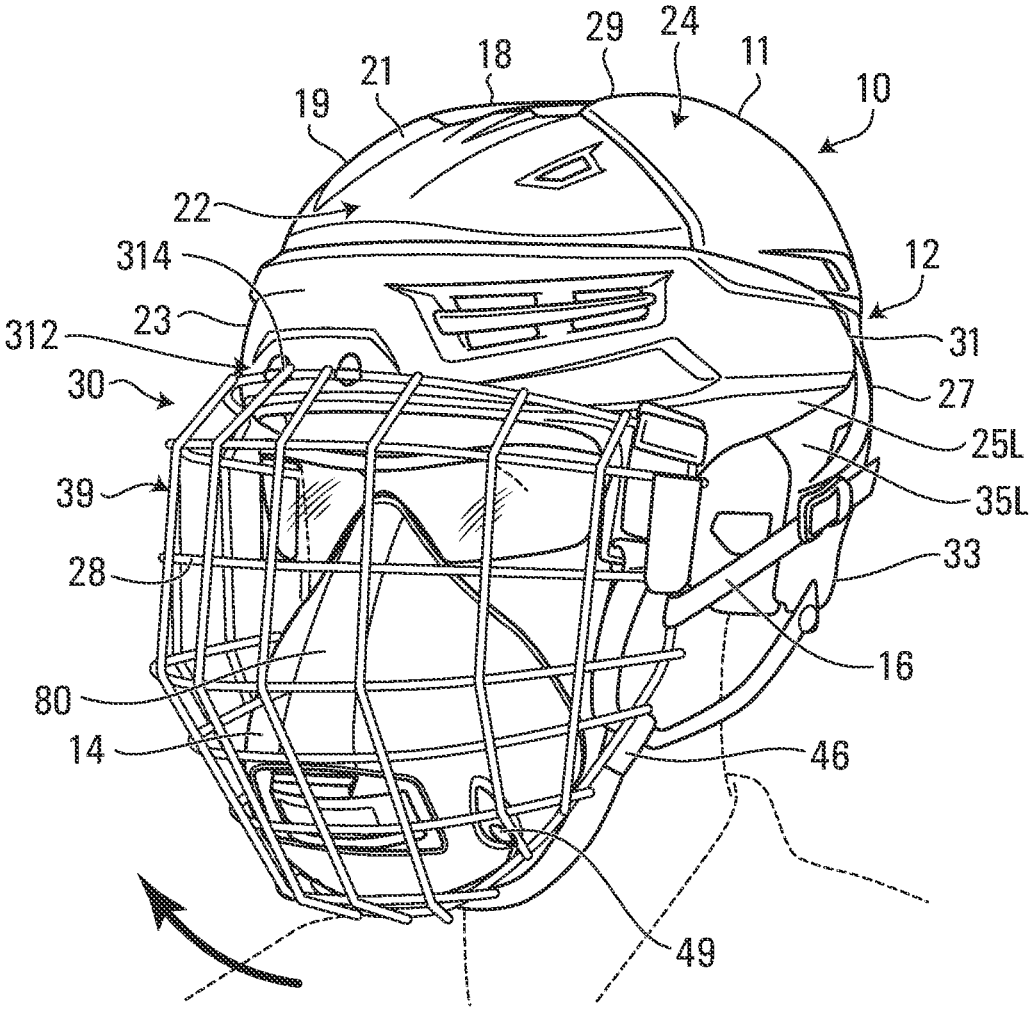
FIGS. 42A, 42B, 42C, 42D and 42E show embodiments of the faceguard pivotably connected to the helmet.
Figure 42B:
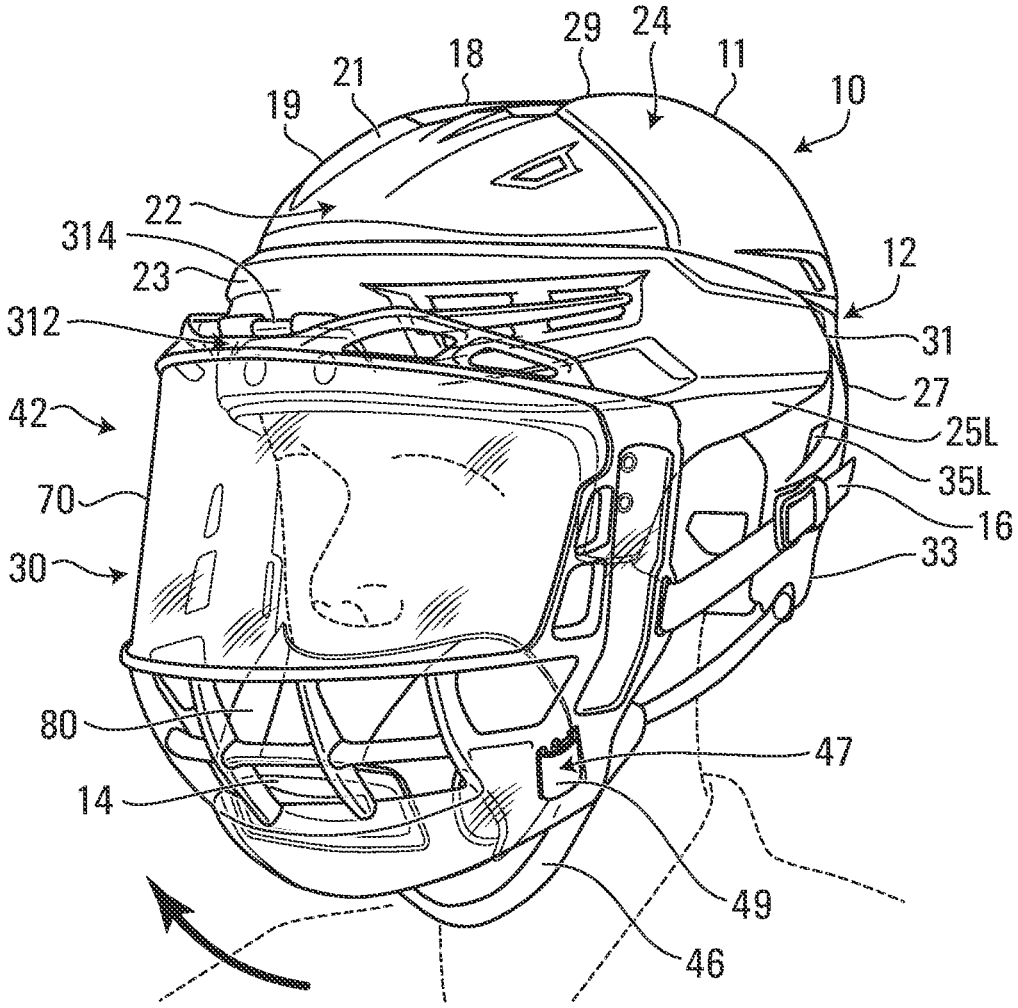
Figure 42C:
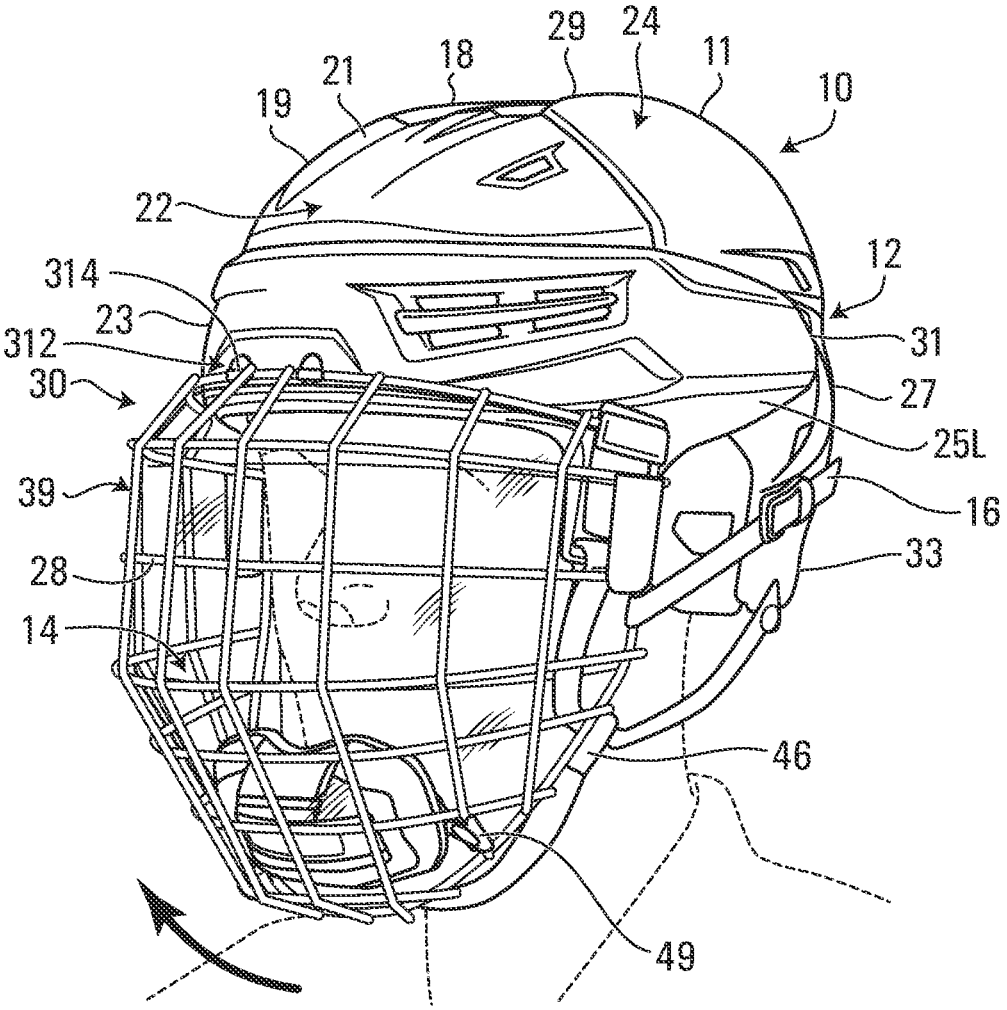
Figure 42D:
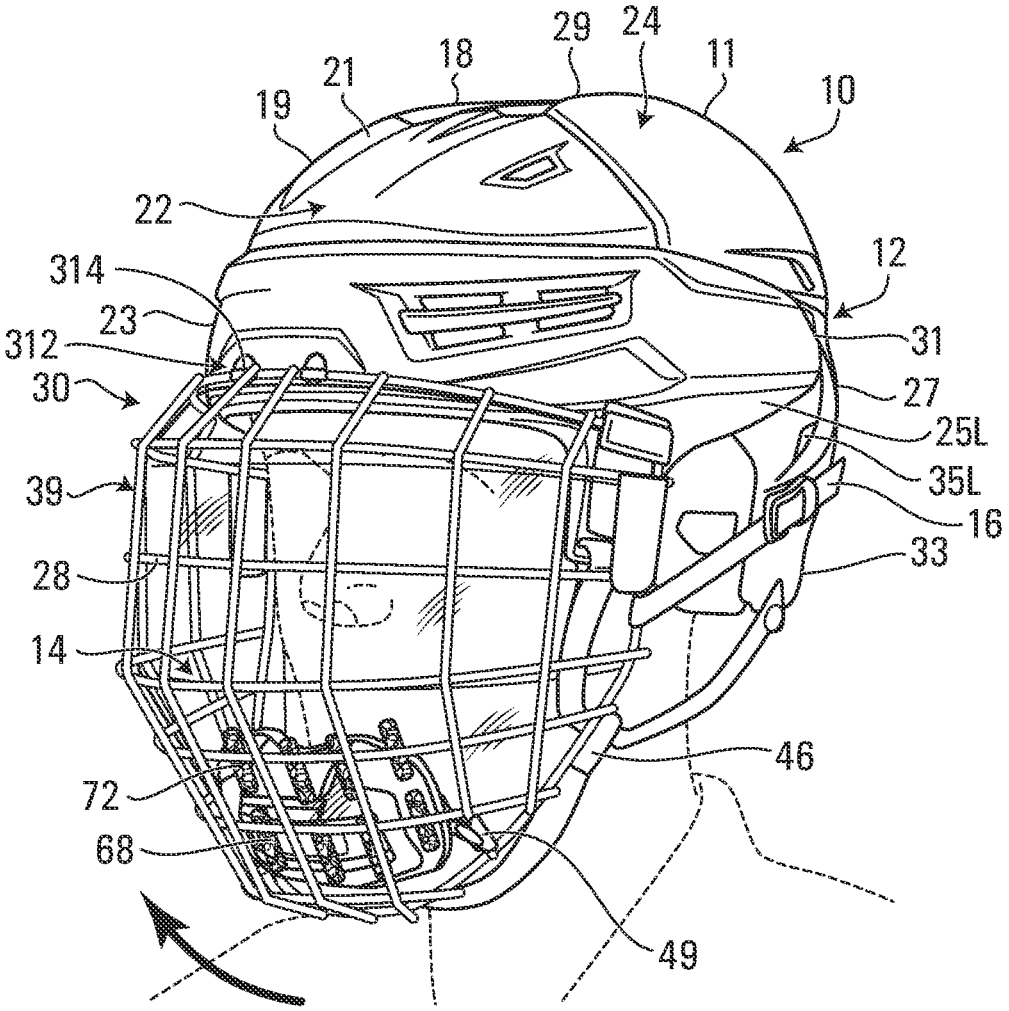
Figure 42E:
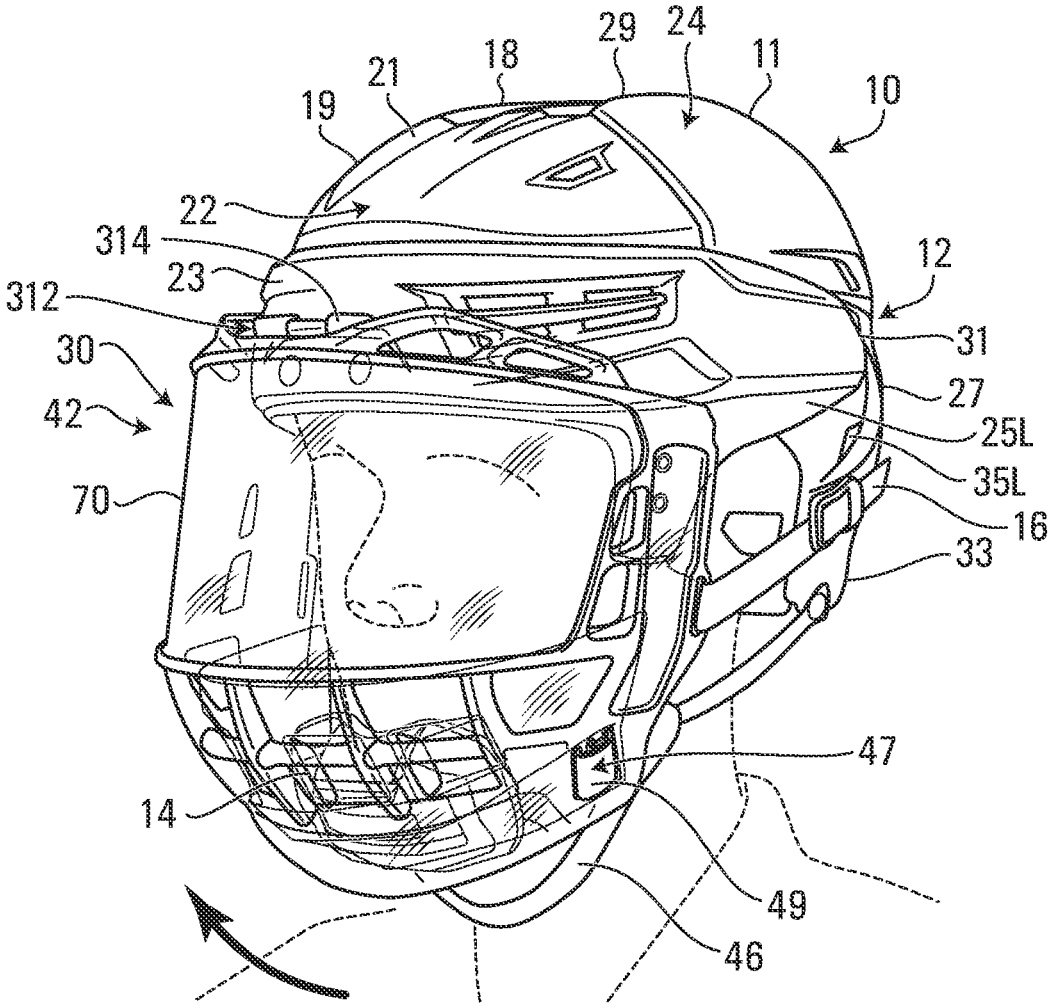

In some embodiments, as shown in FIG. 41, the mask 80 may be customized for the user's face. This may improve fit of the mask 80 and comfort, protection, and vision of the user.

For example, in some embodiments, the user's face is scanned using an image acquisition device 162 and a computing device 164 to obtain 3D model data representative of the user's face. The image acquisition device 162 is configured to capture images of the wearer's face and operatively connected to or integral with the computing device 164. For instance, in some embodiments, the image acquisition device 162 may be implemented as a camera and the computing device 164 may be implemented as a tablet, smartphone, phablet or laptop. In other embodiments, the image acquisition device 162 may be embodied as a specialized external scanning hardware attachment (e.g., scanning gun). This step may be carried out at a retail outlet such as a store, at the user's home or training facility, or at any other suitable location.

The 3D model data representative of the user's face may be used to manufacture the mask 80. For instance, in some embodiments, the 3D model data representative of the user's face may be used to generate 3D model data representative of the mask 80. This may define a design of the mask 80, notably to define the shape of the mask 80, including to ensure proper vision of the user.

In some examples, the 3D model data representative of the mask 80 may be used to 3D print at least part of the body 83 of the mask 80 by 3D printing (a.k.a., additively manufacturing) using a 3D printer 450. Material 460 to make the body 83 of the mask 80 initially provided as feedstock (e.g., powder, liquid, filaments, fibers, and/or other suitable feedstock), which can be referred to as 3D-printed material, is added by the 3D printer 450 that is computer-controlled to create the body 83 of the mask 80 in its three-dimensional form (e.g., layer by layer, or by continuous liquid interface production from a pool of liquid, or by applying continuous fibers, or in any other way, normally moldlessly, i.e., without any mold). In some embodiments, the 3D-printed material 460 of the mask 80 may be polyurethane or any other suitable polymeric material (e.g., which may be comfortable for the user).

Any 3D-printing technology may be used to make the mask 80. For instance, in some embodiments, one or more of the following additive manufacturing technologies may be used individually or in combination: material extrusion technologies, such as fused deposition modeling (FDM); vat photopolymerization technologies, such as stereolithography (SLA), digital light processing (DLP), continuous digital light processing (CDLP) or continuous liquid interface production (CLIP) with digital light synthesis (DLS); powder bed fusion technologies, such as multi-jet fusion (MJF), selective laser sintering (SLS), direct metal laser sintering/selective laser melting (DMLS/SLM), or electron beam melting (EBM); material jetting technologies, such as material jetting (MJ), nanoparticle jetting (NPJ) or drop on demand (DOD); binder jetting (BJ) technologies; sheet lamination technologies, such as laminated object manufacturing (LOM); material extrusion technologies, such as continuous-fiber 3D printing or fused deposition modeling (FDM), and/or any other suitable 3D-printing technology. Examples of suitable 3D-printing technologies may include those available from Carbon (www.carbon3d.com), EOS (https://www.eos.info/en), HP, (https://www8.hp.com/ca/en/printers/3d-printers.html), Arevo (https://arevo.com), and Continuous Composites (https://www.continuouscomposites.com/).

In some embodiments, the shape of the mask 80 defined by the 3D model data representative of the mask 80 generated based on the 3D model data representative of the user's face may incorporate desirable features. For example, in some embodiments, the shape of the mask 80 defined by the 3D model data representative of the mask 80 generated based on the 3D model data representative of the user's face may be such that the mask 80 includes the one or more breathing valves 93 that are 3D printed as part of the mask 80.

In other embodiments, the 3D model data representative of the mask 80 may be used to manufacture a mold in which the mask 80 is molded (e.g., injection molded). For instance, in some embodiments, the 3D model data representative of the mask 80 may be used to 3D print the mold by 3D printing. The mold may be made using any other suitable manufacturing technique in other embodiments.

Figure 23:
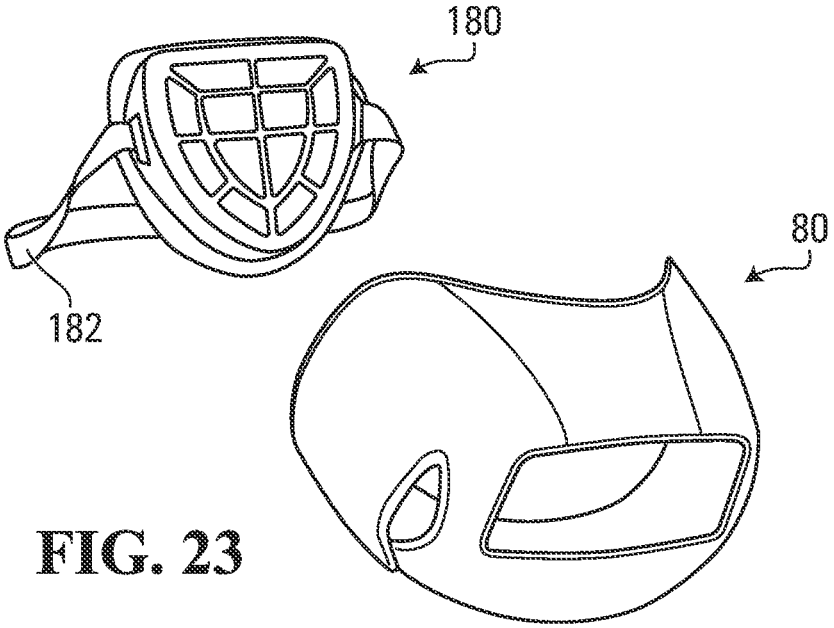
FIG. 23 shows another embodiment in which the mask is a mouth mask and the protective headgear comprises a nose mask separate from the mouth mask.

In some embodiments, as shown in FIG. 23, the mask 80 may be a mouth mask and the protective headgear 10 may comprise a nose mask 180 separate from the mouth mask 80. More particularly, in this embodiment, the mouth mask 80 is configured to extend in front of the central region and the left and right lateral sides of the user's face, from below the user's nose to the bottom of the user's face. Thus, in this embodiment, the mask 80 is configured to leave the user's nose uncovered by the mask 80, while the nose mask 180 is configured to cover at least part of the user's nose. The nose mask 180 comprises a strap system 182 (e.g., a strap configured to extend behind the user's head, earloops, etc.) configured to retain the nose mask 180 on the user's head.

Figure 25:
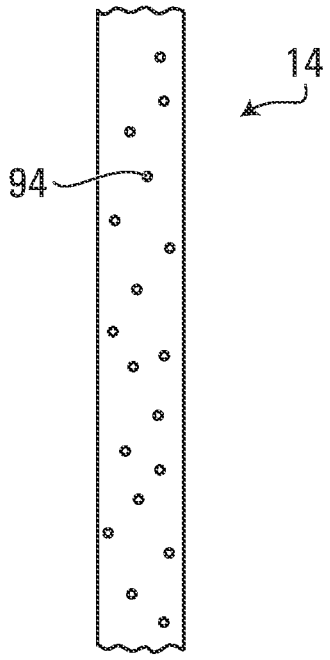
FIG. 25 show an embodiment of the contaminant blocker comprising a disabling substance.

In some embodiments, the eyewear 90 may be part of the mask 80 so that the eyewear 90 is affixed to the body 83 of the mask 80. For example In some embodiments, as shown in FIG. 25, the biohazard blocker 14 may comprise a disabling substance 94 configured to disable (e.g., kill, suppress or otherwise inhibit propagation of) a biological or chemical agent to which the biohazard blocker 14 is potentially exposable. For instance, in some embodiments, where the biohazard blocker 14 is potentially exposable to spatter that may contain a virus or bacteria, the disabling substance 94 may include an antiviral or antibiotic element and/or a disinfectant that kills, suppresses or otherwise inhibits propagation of the virus or bacteria. In some embodiments, the disabling substance 94 may be part of a coating (e.g., sprayed or otherwise applied) on an underlying surface of the biohazard blocker 14. In other embodiments, the disabling substance 94 may be part of a fabric lining or otherwise attached to (e.g., a periphery) of a portion of the biohazard blocker 14. In some cases, the disabling substance 94 may be implemented by a main material of the biohazard blocker 14, such as the clear material 54 of the clear shield 52 (e.g., self-sterilizing plastic or an antibacterial polymer). In some cases, the disabling substance 94 may be provided during manufacturing of the biohazard blocker 14 and may be time-released or activated upon encountering the virus or bacteria.

Figure 26:
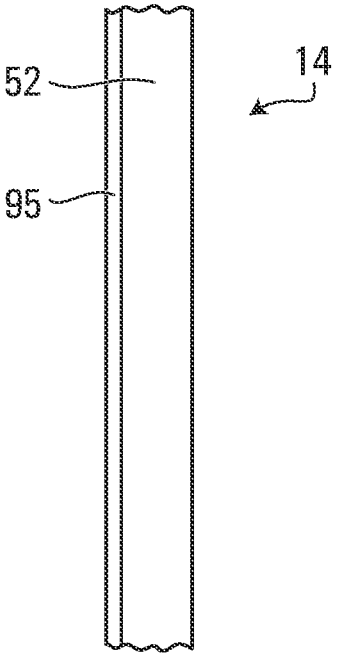
FIGS. 26 and 27 show an embodiment of the contaminant blocker comprising a peelable covering.
Figure 27:
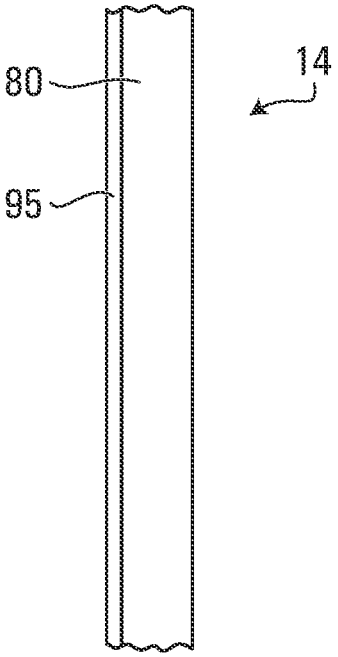

In some embodiments, as shown in FIGS. 26 and 27, the biohazard blocker 14 may comprise a peelable covering 95 (e.g., film) that is configured to be adhesively bonded to and peeled off from the clear shield 52 or the mask 80. When on the clear shield 52, the peelable covering 95 may be clear. In some cases, the peelable covering 95 may include a single peelable layer. In other cases, the peelable covering 95 may include a plurality of peelable layers that can be sequentially peeled off.

Figure 28:
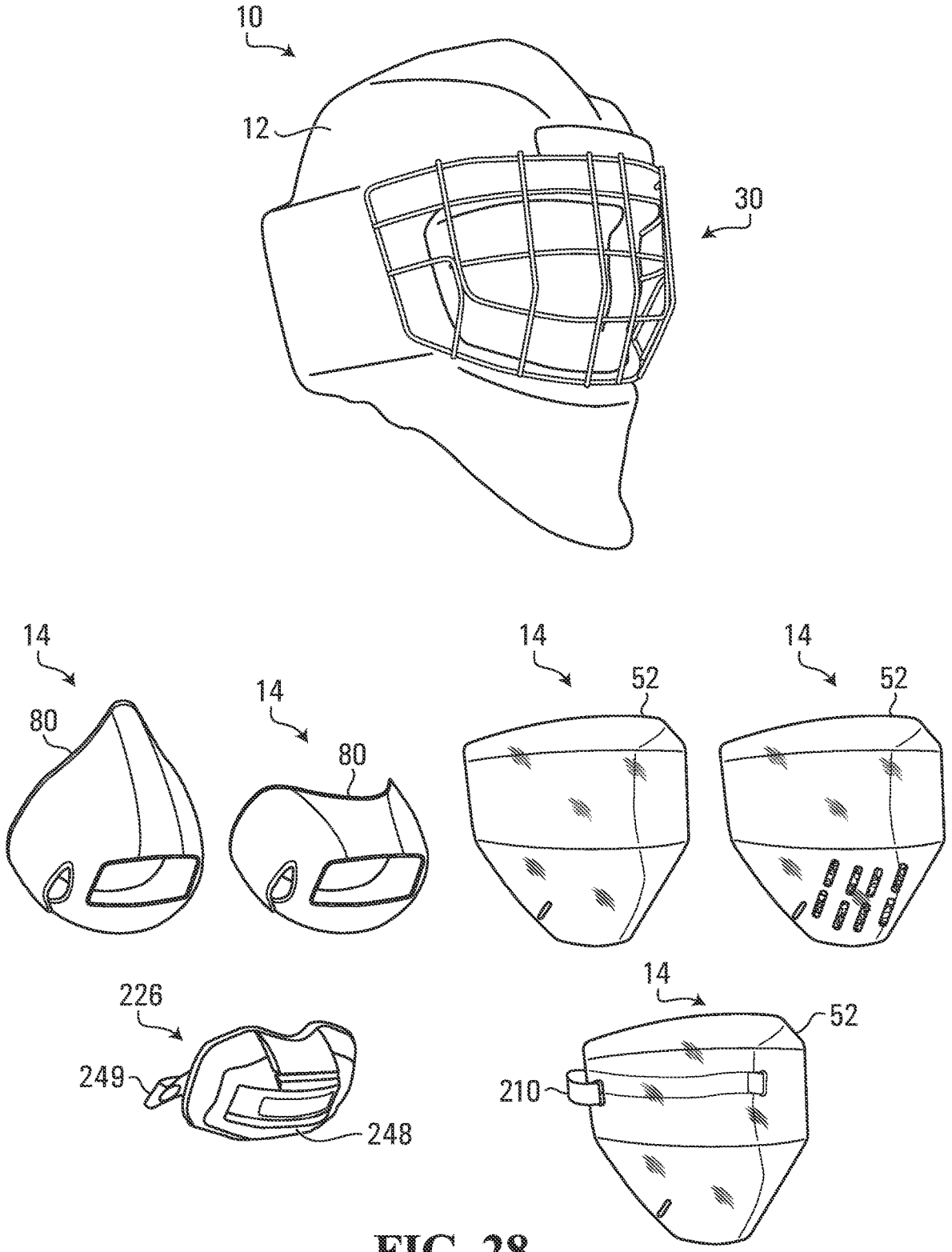
FIGS. 28 to 31 show other embodiments of the protective headgear.

In other examples of implementation, as shown in FIG. 28, the helmet 12 may be a goalie mask for the user who is a hockey goalie (i.e., goalkeeper). In some embodiments where the biohazard blocker 14 comprises the clear shield 52 mounted to the goalie mask, the clear shield 52 may be mounted on an outer side of the grid 39 of the goalie mask such that the grid 39 is disposed between the clear shield 52 and the goalie's face. In other embodiments where the biohazard blocker 14 comprises the clear shield 52 mounted to the goalie mask, the clear shield 52 may be mounted on an inner side of the grid 39 of the goalie mask such that the clear shield 52 is disposed between the grid 39 and the goalie's face.

Although in embodiments considered above the helmet 12 is a hockey helmet, in other embodiments, the helmet 12 may be any other helmet usable by a user playing another type of contact sport (e.g., a "full-contact" sport) in which there are significant impact forces due to player-to-player and/or player-to-object contact or engaging in any other type of sports, including athletic activities other than contact sports.

Figure 29:
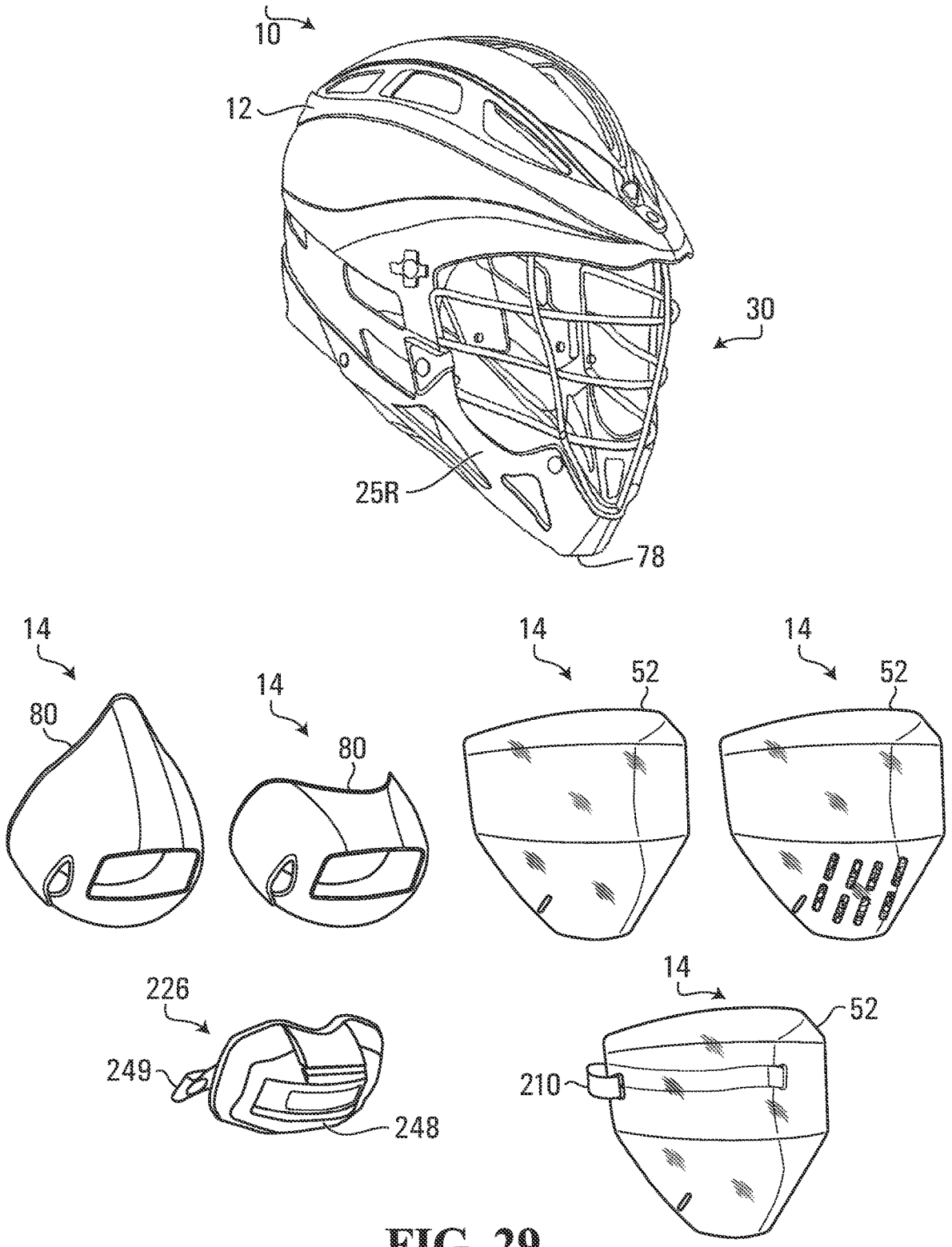
Figure 30:
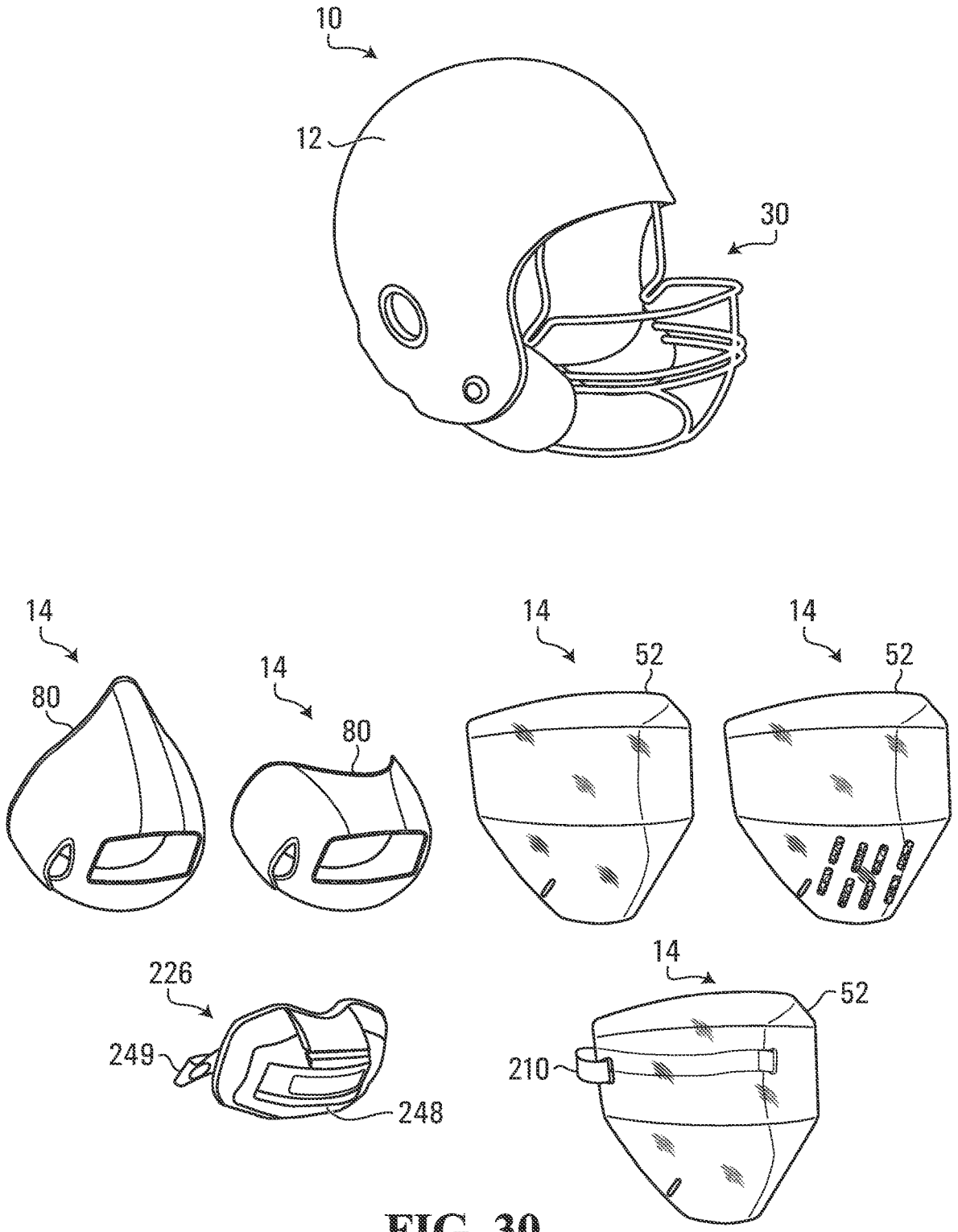
Figure 31:
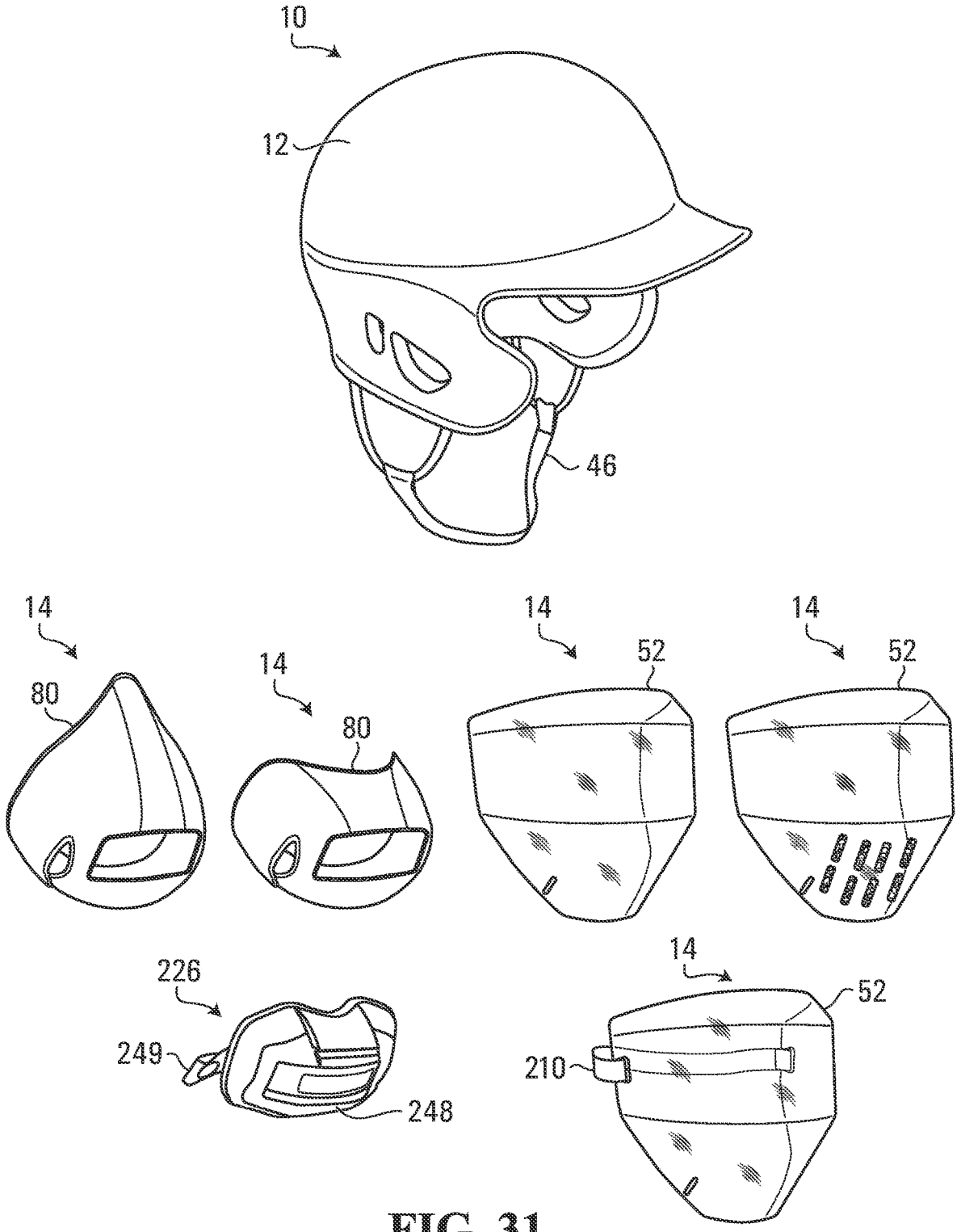

For example, in other embodiments, as shown in FIG. 29, the helmet 12 may be a lacrosse helmet for the user who is a lacrosse player. The chin member 26 of the lacrosse helmet 12 comprises a chin piece 78 extending from the left lateral side portion 25L to the right lateral side portion 25R of the helmet 12 and configured to extend in front of the user's chin. In other embodiments, as shown in FIG. 30, the helmet 12 may be a football helmet for the user who is a football player. In other embodiments, as shown in FIG. 31, the helmet 12 may be a baseball helmet for the user who is a baseball player.

In some of these embodiments shown in FIGS. 28 to 31, the biohazard blocker 14 may interact with the faceguard 30 and/or the chin member 26 of the helmet 12 to be retained on the user's head. Alternatively, in some cases, a chin member 226 similar to the chin member 26 (e.g., comprising a chin cup 248 and a chin-cup strap 249) may be provided for the helmet 12 to connect with the biohazard blocker 14, and/or the biohazard blocker 14 may comprise a strap system 210 (e.g., a strap configured to extend behind the user's head, earloops, etc.) or other attachment for securing the biohazard blocker 14 to the user's head 100.

Figure 32:
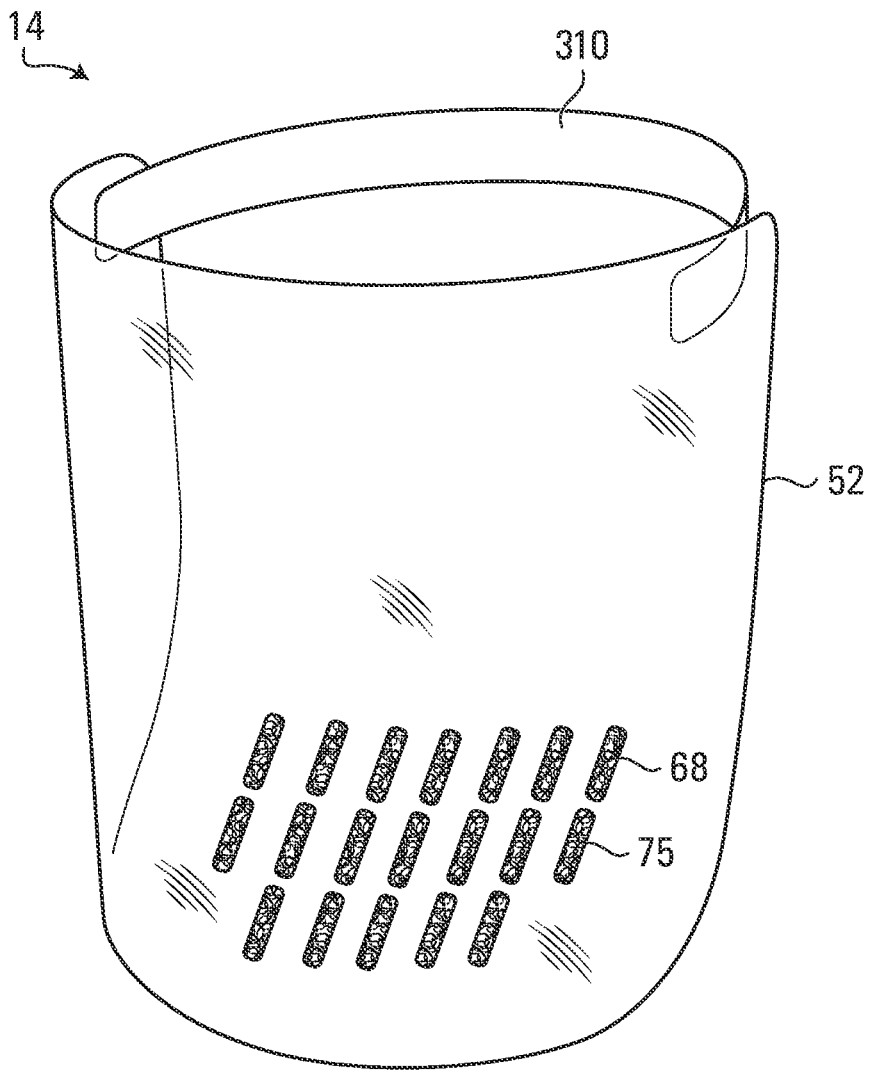
FIGS. 32 and 33 show embodiments in which the contaminant blocker, which may comprise the clear shield or the mask, may be used without any helmet.
Figure 33:
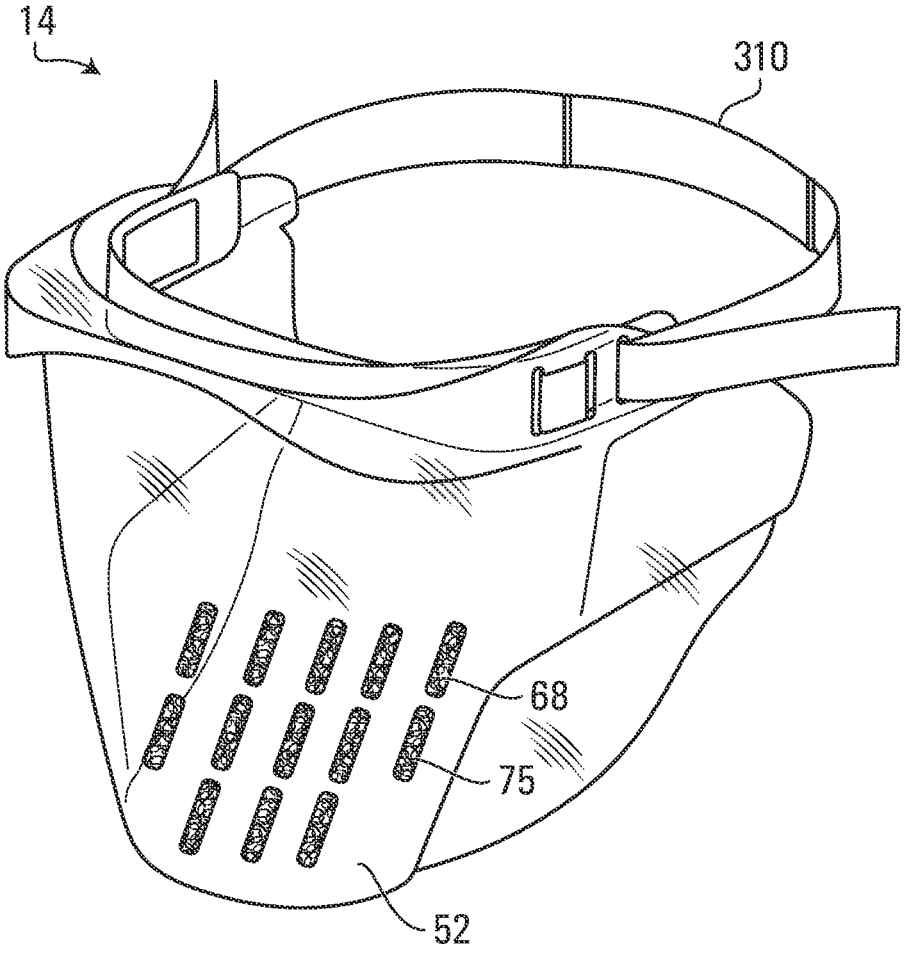

In some embodiments, the biohazard blocker 14, which may comprise the clear shield 52 or the mask 80, may be used without any helmet such as the helmet 12. For instance, in some embodiments, the biohazard blocker 14 may be a standalone article of protective headgear. For example as shown in FIGS. 32 and 33, in some cases, the clear shield 52 including the vents 68 with their fabric 75 to filter pathogens and provide air permeability may be part of a face shield comprising a strap system 310 (e.g., a strap configured to extend behind the user's head, earloops, etc.) or other attachment for securing the face shield to the user's head 100.

While in embodiments considered above the protective headgear 10 is for sports and other athletic activities, the protective headgear 10 may be used for other purposes in other embodiments. For example, in some embodiments, the protective headgear 10 may be worn by the user who may be an individual who is: a motorcyclist; engaging in military activities; involved in law enforcement or other public safety services (e.g., a police officer); in a healthcare establishment and/or providing, receiving or otherwise involved with healthcare (e.g., a medical doctor, a nurse, a paramedic, a dentist, a pharmacist, a patient, a visitor, etc.); in a nursing home; in a laboratory; in a plant or factory (e.g., making food, electronics, etc.); and/or otherwise desiring or required to protect himself/herself and/or others from biological, chemical or other hazards or undesirables.

Certain additional elements that may be needed for operation of some embodiments have not been described or illustrated as they are assumed to be within the purview of those of ordinary skill in the art. Moreover, certain embodiments may be free of, may lack and/or may function without any element that is not specifically disclosed herein.

Any feature of any embodiment discussed herein may be combined with any feature of any other embodiment discussed herein in some examples of implementation.

In case of any discrepancy, inconsistency, or other difference between terms used herein and terms used in any document incorporated by reference herein, meanings of the terms used herein are to prevail and be used.

Any test or standard (e.g., ASTM) referred to herein refers to that test or standard in force at filing of this patent application, unless otherwise noted.

Although various embodiments and examples have been presented, this was for purposes of describing, but should not be limiting. Various modifications and enhancements will become apparent to those of ordinary skill and are within a scope of this disclosure.

The invention claimed is:

1. A protective headgear wearable on a head of a user engaging in a sport, the protective headgear comprising:

a sport helmet configured to protect the user's head against impacts during the sport including with other individuals, the sport helmet comprising:

an outer shell;

a liner disposed within and secured to the outer shell; and a faceguard connected to the outer shell and configured to protect a face of the user against the impacts; and an infectant blocker configured to cover at least part of the user's face, protect against infectants transmittable to or from the user, and be connected to the faceguard;

wherein: the faceguard comprises a grid; and the infectant blocker is configured to be connected to the grid.

2. The protective headgear of claim 1, wherein the infectant blocker comprises a plurality of connecting elements spaced from one another and configured to connect the infectant blocker to the faceguard.

3. The protective headgear of claim 2, wherein the connecting elements of the infectant blocker include a plurality of detachable fasteners.

4. The protective headgear of claim 3, wherein each detachable fastener is configured to be looped about part of the faceguard through an opening of the faceguard.

5. The protective headgear of claim 1, wherein the infectant blocker is configured to conform to the faceguard.

6. The protective headgear of claim 1, wherein the infectant blocker is configured to be disposed between the faceguard and the user's face.

7. The protective headgear of claim 1, wherein: the grid comprises elongate members spaced apart from one another; and the infectant blocker is configured to be connected to respective ones of the elongate members of the grid.

8. The protective headgear of claim 7, wherein the elongate members of the grid are welded together.

9. The protective headgear of claim 1, wherein: the helmet comprises a chin member configured to engage a chin of the user; and the infectant blocker is configured to be mounted between the faceguard and the chin member.

10. The protective headgear of claim 9, wherein the infectant blocker is configured to be connected to the chin member.

11. The protective headgear of claim 9, wherein the infectant blocker comprises an opening to receive part of the chin member.

12. The protective headgear of claim 9, wherein: the chin member comprises a chin cup; and the infectant blocker is configured to be connected to the chin cup.

13. The protective headgear of claim 9, wherein: the chin member comprises a chin-cup strap; and the infectant blocker is configured to be connected to the chin-cup strap.

14. The protective headgear of claim 13, wherein the infectant blocker comprises an opening to receive part of the chin-cup strap.

15. The protective headgear of claim 1, wherein the infectant blocker comprises a clear shield configured to be positioned in front of, spaced from, and cover at least part the user's face and comprising clear material that allows the user to see through the clear shield.

16. The protective headgear of claim 15, wherein the clear shield comprises a thin clear member curved between a left lateral side of the clear shield and a right lateral side of the clear shield.

17. The protective headgear of claim 16, wherein the thin clear member is shaped to bend towards the user's face towards a top of the thin clear member and towards a bottom of the thin clear member.

18. The protective headgear of claim 16, wherein the thin clear member is concave in a widthwise direction of the clear shield and in a heightwise direction of the clear shield.

19. The protective headgear of claim 15, wherein the clear shield comprises a vent.

20. The protective headgear of claim 1, wherein the faceguard comprises a visor.

21. The protective headgear of claim 20, wherein: the visor comprises a lens; the grid is disposed below the lens and comprises vent openings; and the infectant blocker is configured to overlie the grid of the visor.

22. The protective headgear of claim 21, wherein the infectant blocker is configured to interlock with the grid of the visor.

23. The protective headgear of claim 1, wherein the infectant blocker comprises a mask comprising fabric and configured to engage and cover at least part the user's face.

24. The protective headgear of claim 23, wherein: the faceguard is configured to protect less than an entirety of the user's face; and the mask is configured to overlap with the faceguard.

25. The protective headgear of claim 23, wherein the mask comprises a nose-engaging member configured to engage the user's nose and support the mask on the user's nose and including material different from the fabric of the mask.

26. The protective headgear of claim 25, wherein the nose-engaging member is configured to clamp onto the user's nose.

27. The protective headgear of claim 25, wherein the nose-engaging member is configured to be disposed astride the user's nose.

28. The protective headgear of claim 25, wherein the material of the nose-engaging member is stiffer than the fabric of the mask.

29. The protective headgear of claim 23, wherein the mask comprises a plurality of layers including different materials.

30. The protective headgear of claim 23, wherein the mask is configured to wick perspiration away from the user.

31. The protective headgear of claim 23, wherein the mask is configured to provide a cooling effect to the user.

32. The protective headgear of claim 23, wherein left and right lateral portions of the mask are more breathable than a central portion of the mask disposed between the left and right lateral portions of the mask in a widthwise direction of the mask.

33. The protective headgear of claim 23, wherein the mask comprises a hydration opening configured to allow the user to drink potable liquid through the mask.

34. The protective headgear of claim 33, wherein the mask comprises portions movable relative to one another to open and close the hydration opening.

35. The protective headgear of claim 34, wherein respective ones of the portions of the mask movable relative to one another to open and close the hydration opening include respective parts of the fabric of the mask.

36. The protective headgear of claim 35, wherein: the fabric of the mask includes a plurality of layers; and each of the respective parts of the fabric of the mask includes plural ones of the layers of the fabric of the mask.

37. The protective headgear of claim 23, wherein: the helmet comprises a chin member configured to engage a chin of the user; and the mask is removable from the helmet while the faceguard and the chin member remain connected to a remainder of the helmet.

38. The protective headgear of claim 1, wherein the infectant blocker and the faceguard are pivotable relative to the outer shell.

39. The protective headgear of claim 1, wherein the infectant blocker is configured to be detachably fastened to the faceguard to be removable from the helmet.

40. A mask wearable on a head of a user engaging in a sport, the user wearing a sport helmet configured to protect the user's head against impacts during the sport including with other individuals, the sport helmet comprising: an outer shell; a liner disposed within and secured to the outer shell; and a faceguard connected to the outer shell and configured to protect a face of the user against the impacts, the mask being flexible and configured to cover at least part of the user's face and protect against infectants transmittable to or from the user, the mask comprising fabric and a connector for connecting the mask to the faceguard, wherein: the faceguard comprises a grid; and the mask is configured to be connected to the grid.

41. A clear shield wearable on a head of a user engaging in a sport, the user wearing a sport helmet configured to protect the user's head against impacts during the sport including with other individuals, the sport helmet comprising: an outer shell; a liner disposed within and secured to the outer shell; and a faceguard connected to the outer shell and configured to protect a face of the user against the impacts, the clear shield being configured to cover at least part of the user's face and protect against infectants transmittable to or from the user, the clear shield comprising clear material that allows the user to see through the clear shield, the clear shield comprising a connector for connecting the clear shield to the faceguard, wherein: the faceguard comprises a grid; and the clear shield is configured to be connected to the grid.

42. A protective headgear wearable on a head of a user engaging in a sport, the protective headgear comprising:

a sport helmet configured to protect the user's head against impacts during the sport including with other individuals, the sport helmet comprising:

an outer shell;

a liner disposed within and secured to the outer shell; and a faceguard connected to the outer shell and configured to protect a face of the user against the impacts; and an infectant blocker configured to cover at least part of the user's face, protect against infectants transmittable to or from the user, and be connected to the faceguard;

wherein: the faceguard comprises a visor; the visor comprises a lens and a grid disposed below the lens and comprising vent openings; and the infectant blocker is configured to overlie the grid of the visor.

43. A protective headgear wearable on a head of a user engaging in a sport, the protective headgear comprising:

a sport helmet configured to protect the user's head against impacts during the sport including with other individuals, the sport helmet comprising:

an outer shell;

a liner disposed within and secured to the outer shell; and a faceguard connected to the outer shell and configured to protect a face of the user against the impacts; and an infectant blocker configured to cover at least part of the user's face, protect against infectants transmittable to or from the user, and be connected to the faceguard;

wherein: the infectant blocker comprises a mask comprising fabric and configured to engage and cover at least part the user's face; and the mask comprises a hydration opening configured to allow the user to drink potable liquid through the mask.

* * * * *